US009705218B2

(12) United States Patent
Ito

(10) Patent No.: US 9,705,218 B2
(45) Date of Patent: Jul. 11, 2017

(54) RECEPTACLE CONNECTOR, PLUG CONNECTOR AND ELECTRICAL CONNECTOR PROVIDED WITH RECEPTACLE CONNECTOR AND PLUG CONNECTOR

(71) Applicant: YAMAICHI ELECTRONICS CO., LTD., Tokyo (JP)

(72) Inventor: Toshiyasu Ito, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 14/436,430

(22) PCT Filed: Feb. 26, 2013

(86) PCT No.: PCT/JP2013/055016
§ 371 (c)(1),
(2) Date: Apr. 16, 2015

(87) PCT Pub. No.: WO2014/061284
PCT Pub. Date: Apr. 24, 2014

(65) Prior Publication Data

US 2015/0255904 A1 Sep. 10, 2015

(30) Foreign Application Priority Data

Oct. 18, 2012 (JP) ..... 2012-231122

(51) Int. Cl.
*H01R 13/648* (2006.01)
*H01R 12/72* (2011.01)
(Continued)

(52) U.S. Cl.
CPC ..... *H01R 12/721* (2013.01); *H01R 13/6471* (2013.01); *H01R 2107/00* (2013.01)

(58) Field of Classification Search
CPC ..... H01R 23/688; H01R 23/6873; H01R 23/7073; H01R 23/7068; H01R 23/725; H01R 13/26; H01R 13/658
(Continued)

(56) References Cited

U.S. PATENT DOCUMENTS 4,415,216 A * 11/1983 Narozny ..... H01R 23/662 439/465
5,527,587 A 6/1996 Bahm
(Continued)

FOREIGN PATENT DOCUMENTS

CN 1272706 A 11/2000
CN 1964139 5/2007
(Continued)

OTHER PUBLICATIONS

An Office Action issued by the Chinese Patent Office on Jun. 20, 2016, which corresponds to Chinese Patent Application No. 201380054780.1 and is related to U.S Appl. No. 14/436,430.
(Continued)

*Primary Examiner* — Hien Vu
(74) *Attorney, Agent, or Firm* — Studebaker & Brackett PC

(57) ABSTRACT

A receptacle connector includes: a housing provided with an accommodating space having an opening into which a object to be connected is to be inserted; a plurality of contacts to be housed in the accommodating space while being arranged adjacent to one another, the contacts including a plurality of signal line contacts and a plurality of ground contacts; and a conductive member including first connection parts which are each made of a metal material and are electrically connected to the plurality of ground contacts, respectively, and a conductive resin member which is electrically connected to the first connection parts.

16 Claims, 50 Drawing Sheets

(51) Int. Cl.
*H01R 13/6471* (2011.01)
*H01R 107/00* (2006.01)

(58) Field of Classification Search
USPC ..... 439/108, 637, 660
See application file for complete search history.

(56) References Cited

U.S. PATENT DOCUMENTS

| | | | | |
|---|---|---|---|---|
| 5,967,831 | A * | 10/1999 | Yamada | H01R 12/79 439/108 |
| 8,177,564 | B1 * | 5/2012 | Ito | H01R 13/6471 439/108 |
| 2007/0105433 | A1 | 5/2007 | Shioda et al. | |
| 2007/0275605 | A1 * | 11/2007 | Hubbard | H01R 12/721 439/660 |
| 2008/0224732 | A1 | 9/2008 | Krishnan | |
| 2009/0221165 | A1 | 9/2009 | Buck et al. | |
| 2012/0142200 | A1 | 6/2012 | Ito et al. | |
| 2012/0184140 | A1 | 7/2012 | Davis et al. | |
| 2013/0052843 | A1 | 2/2013 | Johnescu et al. | |

FOREIGN PATENT DOCUMENTS

| | | |
|---|---|---|
| CN | 101258679 | 9/2008 |
| CN | 101960674 | 1/2011 |
| CN | 102570186 | 7/2012 |
| CN | 102623852 | 8/2012 |
| JP | 2006-147312 A | 6/2006 |
| JP | 2007-125832 A | 5/2007 |
| WO | 2011/090634 A2 | 7/2011 |

OTHER PUBLICATIONS

International Search Report; PCT/JP2013/055016; May 21, 2013.
Notification Concerning Transmittal of International Preliminary Report on Patentability and Translation of Written Opinion of the International Searching Authority; PCT/JP2013/055016 issued on Apr. 30, 2015.

* cited by examiner

RECEPTACLE CONNECTOR, PLUG CONNECTOR AND ELECTRICAL CONNECTOR PROVIDED WITH RECEPTACLE CONNECTOR AND PLUG CONNECTOR

TECHNICAL FIELD

The present invention relates to a receptacle connector and a plug connector used in an electrical connector, and to an electrical connector provided with the receptacle connector and the plug connector.

BACKGROUND ART

A receptacle connector used in an electrical connector to connect two circuit boards to each other usually includes a plurality of signal line contacts and a plurality of ground contacts, which are arranged parallel to one another. Patent Document 1 discloses a receptacle connector including a common contact disposed in such a way as to extend across multiple adjacent ground contacts, and configured to electrically connect the ground contacts to one another (see FIG. 2). This common contact is molded of a conductive resin material, and has a conductive resin member disposed away from the opposed ground contacts with a predetermined clearance in between; and a plurality of minute contact projections formed to project from a surface of the conductive resin member toward the ground contacts and configured to come into physical contact with the above-mentioned ground contacts (see FIG. 7 and FIG. 8).

PRIOR ART DOCUMENTS

Patent Documents

Patent Document 1: the specification of U.S. Pat. No. 8,177,564

SUMMARY OF INVENTION

Regarding such receptacle connector, there is a request for reduction in size of the receptacle connector as a whole by arranging the multiple signal line contacts and the multiple ground contacts at relatively fine intervals (hereinafter also referred to as a narrow pitch). However, regarding Patent Document 1, the conductive resin member and the multiple minute contact projections in the above-described common contact are entirely constituted of the conductive resin material, and there are manufacturing limitations in molding the minute contact projections at the narrow pitch on the surface of the conductive resin member. As a consequence, the plurality of ground contacts may face with a difficulty in achieving an arrangement of the multiple ground contacts at the narrow pitch.

And so, the present invention aims to provide a receptacle connector and a plug connector and an electrical connector including the receptacle connector and the plug connector. The receptacle connector, a plug connector, and electrical connector can arrange a plurality of contacts at the narrow pitch.

To achieve the above-mentioned described object, a receptacle connector according to the present invention is a receptacle connector used in an electrical connector to connect two circuit boards to each other, the receptacle connector comprises: a housing comprised of an insulative resin material and defines an accommodating space having an opening into which a object to be connected is to be inserted; a plurality of contacts each comprised of a metal material and to be accommodated in the accommodating space while being arranged adjacent to one another, the contacts including a plurality of signal line contacts and a plurality of ground contacts; and a conductive member including at least one first connection part comprised of a metal material and configured to be electrically connected to the plurality of ground contacts, and a conductive resin member configured to be electrically connected to the first connection part.

In the receptacle connector according to the present invention, the first connection part may be in physical contact with the conductive resin member. In the receptacle connector according to the present invention, the first connection part may be in physical contact with the ground contact. In the receptacle connector according to the present invention, the first connection part may be inserted into an opening provided in the conductive resin member, such that a position of the first connection part is made adjustable by reason that the first connection part comes into physical contact with the ground contact. In the receptacle connector according to the present invention, the receptacle connector may include a plurality of first connection parts, and the conductive resin member may be split into a plurality of segments for each of the plurality of first connection parts.

In addition, a plug connector according to the present invention is a plug connector used in an electrical connector to connect two circuit boards to each other, the plug connector comprises: a blade to be inserted into a accommodating space of a receptacle connector being an object to be connected; a plurality of signal line external contact points provided on at least one surface of the blade and disposed corresponding to a plurality of signal line contacts of the receptacle connector; a plurality of ground external contact points arranged adjacent to the plurality of signal line external contact points and disposed corresponding to a plurality of ground contacts of the receptacle connector; and a plug-side conductive member including a plurality of first plug-side connection parts each comprised of a metal material and configured to be electrically connected to at least one ground external contact point among the plurality of ground external contact points, and a plug-side conductive resin member configured to be electrically connected to the first plug-side connection parts.

In the plug connector according to the present invention, the first plug-side connection part may be in physical contact with the plug-side conductive resin member. In the plug connector according to the present invention, the first plug-side connection part may be in physical contact with the ground external contact point. In the plug connector according to the present invention, the first plug-side connection part may be inserted into an opening provided in the plug-side conductive resin member, such that a position of the first plug-side connection part is made adjustable by reason that the first plug-side connection part comes into physical contact with the ground external contact point. In the plug connector according to the present invention, the plug connector may include a plurality of first plug-side connection parts, and the plug-side conductive resin member may be split into a plurality of segments for each of the plurality of first plug-side connection parts.

According to the present invention, the first connection parts to be electrically connected to the plurality of ground contacts are each comprised of a metal material. In addition, the conductive resin member to be electrically connected to the first connection parts is also provided. This makes it easier to dispose the first connection parts in accordance with the plurality of contacts arranged at a narrow pitch. As a consequence, it is possible to increase the freedom of arrangement of the plurality of signal line contacts and the plurality of ground contacts, and to achieve reduction in size of the electrical connector comprised from the receptacle connector and the plug connector.

DESCRIPTION OF EMBODIMENTS

First Embodiment

A first embodiment of an electrical connector according to the present invention is illustrated in FIG. 1 to FIG. 6. Note that in the description of this embodiment: "front" and "back" directions respectively refer to a +x direction and a −x direction in FIG. 1; "left" and "right" directions respectively refer to a +y direction and a −y direction therein; and "upper" and "lower" directions respectively refer to a +z direction and a −z direction therein.

Figure 1:
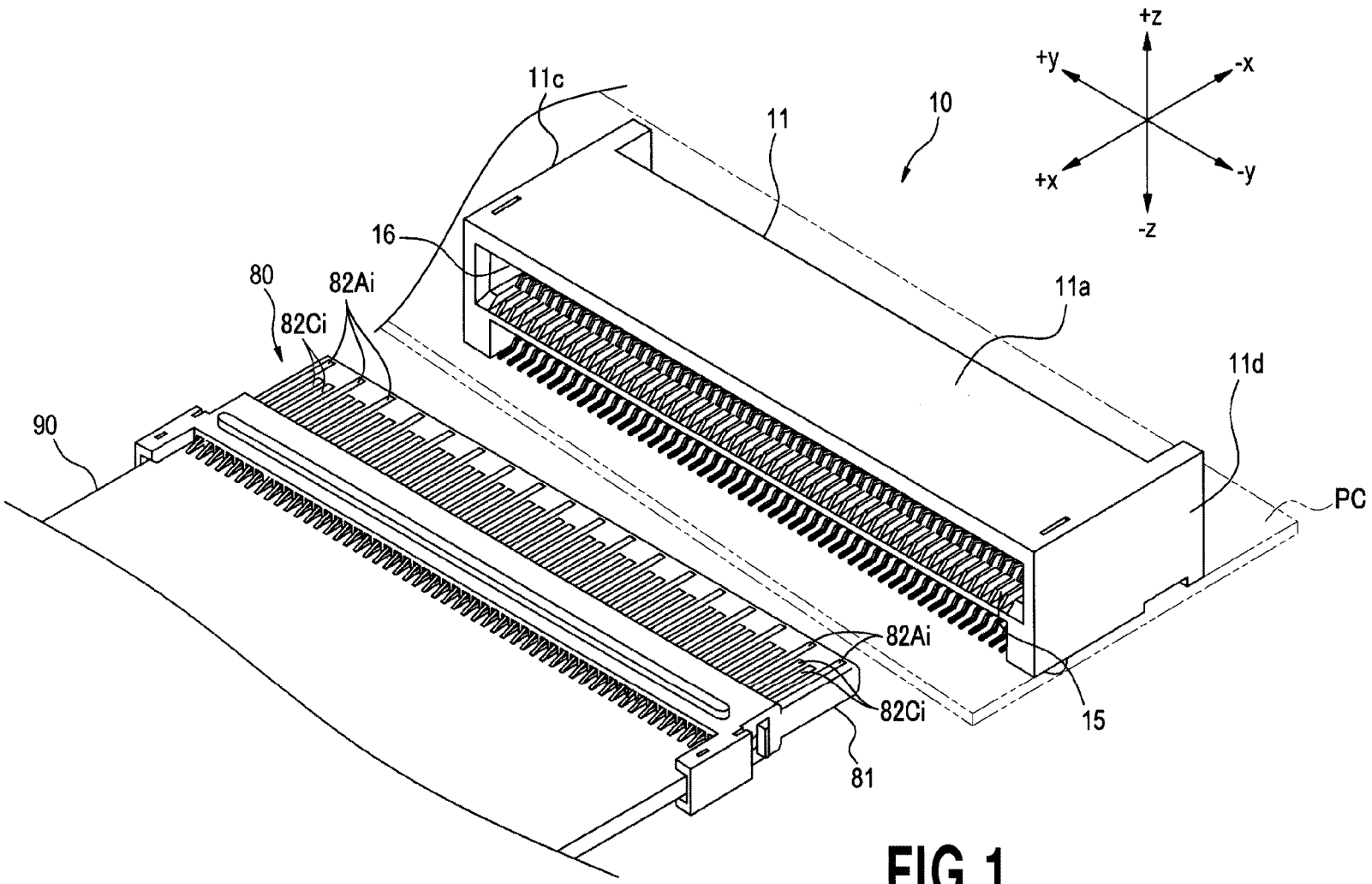
FIG. 1 is a perspective view of a receptacle connector and a plug connector according to a first embodiment of the present invention, which illustrates a state before the receptacle connector and the plug connector are connected to each other.

As illustrated in FIG. 1, in the first embodiment, an electrical connector for connecting two circuit boards, namely, a circuit board 90 and a circuit board PC to each other is provided with a receptacle connector 10 (an example of the object to be connected) and a plug connector 80 (another example of the object to be connected) to be detachably/attachably inserted into the receptacle connector 10.

The receptacle connector 10 is attached onto a surface of the circuit board PC. The plug connector 80 to be inserted into the receptacle connector 10 is attached to the printed wiring board 90 as the other circuit board. The printed wiring board 90 may be a flat cable (an FFC) or a flexible wiring board (hereinafter also referred to as an FPC), for example.

Without limitation to the foregoing example, the printed wiring board 90 (its external terminal portions) may be designed to be inserted directly into the receptacle connector 10 without the intermediary of the plug connector 80, for instance.

Figure 2A:
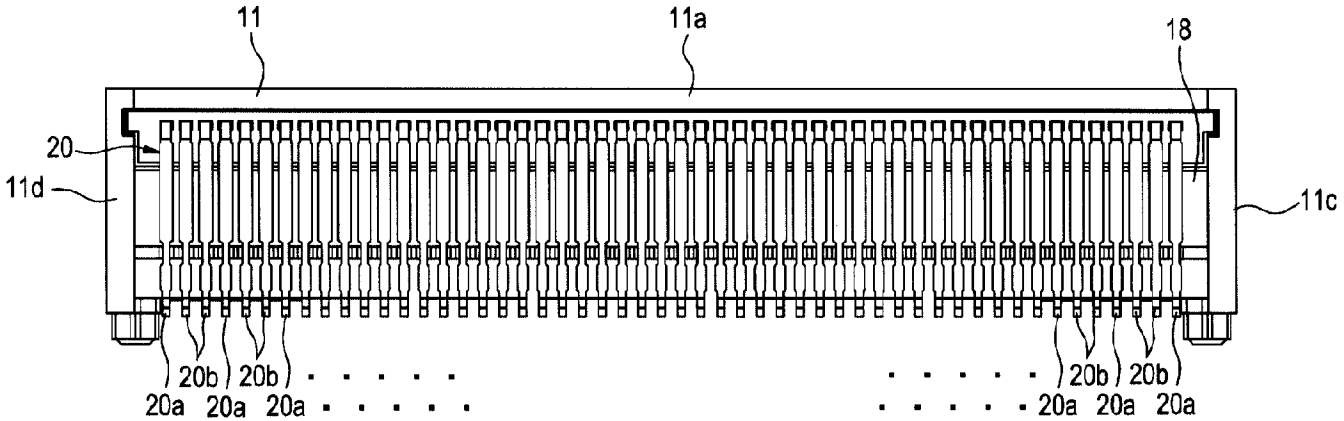
FIG. 2A is a rear view of the receptacle connector shown in FIG. 1.
Figure 2B:
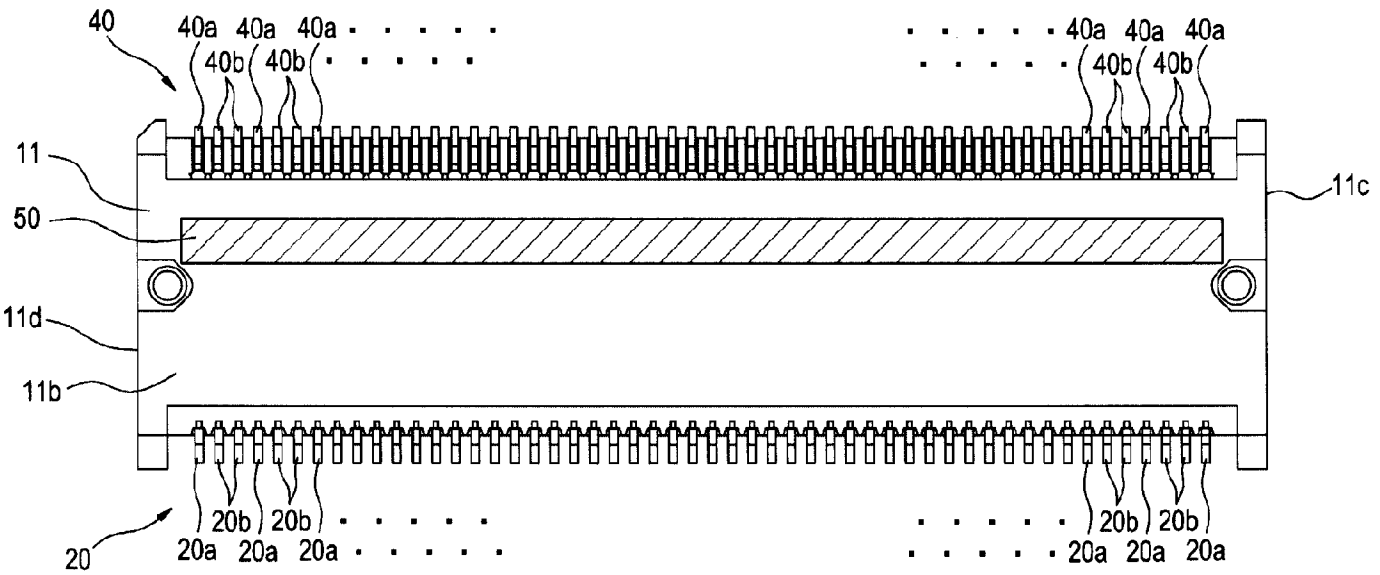
FIG. 2B is a bottom view of the receptacle connector shown in FIG. 1.
Figure 3:
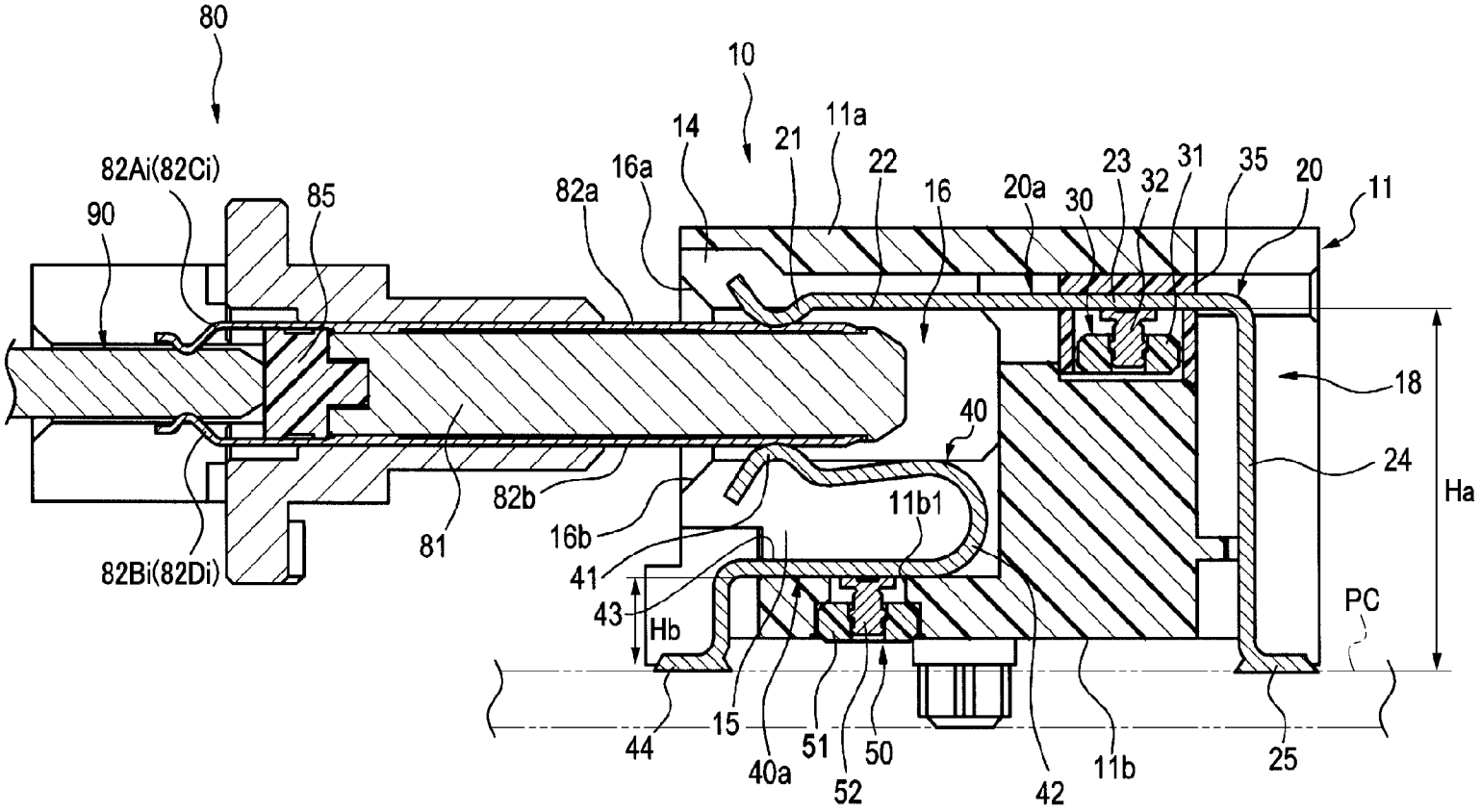
FIG. 3 is a cross-sectional view illustrating a state where the plug connector is inserted to the receptacle connector shown in FIG. 1.

As illustrated in FIG. 2A, FIG. 2B, and FIG. 3, the receptacle connector 10 according to this embodiment is provided with a housing 11, a plurality of contacts 20 on a first row, a plurality of contacts 40 on a second row, a first conductive member 30, and a second conductive member 50.

The housing 11 is formed from an electrically insulative synthetic resin material such as LCP (liquid crystal polymer). A profile of the housing 11 has a substantially rectangular parallelepiped shape, and includes an upper wall 11*a*, a lower wall 11*b*, a left side wall 11*c*, and a right side wall 11*d*.

A plurality of first slits 14 (see FIG. 3) for accommodating part of the plurality of contacts 20 on the first row, respectively, are provided extending from the front side toward the back side of the housing 11. The first slits 14 are formed at given intervals in a right-left direction of the housing 11. Every adjacent pair of the first slits 14 are partitioned by a partition wall. A plurality of second slits 15 for accommodating part of the plurality of contacts 40 on the second row, respectively, and a first accommodating space 16 into which the plug connector 80 is inserted are provided on the front side of the housing 11. The second slits 15 to be formed below the first slits 14 are formed at given intervals in the right-left direction of the housing 11 so as to face the corresponding first slits 14. Every adjacent pair of the second slits 15 are partitioned by a partition wall. A second accommodating space 18, which accommodates the plurality of contacts 20 on the first row and a support portion 35 that fixes and supports the plurality of contacts 20 on the first row, is provided on the back side of the housing 11. A hollow portion 11*b*1, into which the second conductive member 50 to be described later is inserted, is provided in the lower wall 11*b* of the housing 11.

The first accommodating space 16 is configured to be opened forward, to extend horizontally in the right-left direction of the receptacle connector 10 so as to allow insertion of a blade 81 of the plug connector 80. As illustrated in FIG. 3, a vertical sectional shape of the first accommodating space 16 is formed into such a shape that corresponds to a vertical sectional shape of the plug connector 80 so as to allow the insertion of the blade 81. In addition, a front opening 16*a* and a front opening 16*b* of the first accommodating space 16 each preferably open up in a tapered manner in order to guide the insertion of the plug connector 80 smoothly.

The plurality of first slits 14 are located on an upper side of the first accommodating space 16 and extend in a front-back direction of the housing 11, respectively. The front side of each of the plurality of first slits 14 is opened toward the first accommodating space 16, and the back side thereof is opened toward the second accommodating space 18. Accordingly, each of the plurality of first slits 14 is configured to bring the first accommodating space 16 into communication with the second accommodating space 18.

Each of the plurality of second slits 15 provided on the front side of the housing 11 extends in the front-back direction on a lower side of first accommodating space 16, and the front side thereof is opened toward the first accommodating space 16. Each of the plurality of second slits 15 is configured to allow insertion of the corresponding one of the plurality of contacts 40 on the second row from the front side when assembling the receptacle connector 10.

As illustrated in FIG. 3, the second accommodating space 18 provided on the back side of the housing 11 is formed to have a substantially L-shaped vertical cross section in the front-back direction corresponding to the cross-sectional shape of each of the plurality of contacts 20 on the first row. The second accommodating space 18 is opened backward as well as downward, and is also brought into communication with the first accommodating space 16 on the front side via the plurality of first slits 14. In addition, the second accommodating space 18 extends horizontally in the right-left direction of the receptacle connector 10, and is configured so that the plurality of contacts 20 on the first row can be inserted from the back side when assembling the receptacle connector 10.

The plurality of contacts 20 on the first row according to this embodiment include a plurality of ground contacts (G) 20*a* and a plurality of signal line contacts (S) 20*b* arranged adjacent to one another. Two ground contacts (G) 20*a* located away from each other are disposed such that two signal line contacts (S) 20*b* to transmit signals are sandwiched by those ground contacts (G) 20*a*. Namely, the ground contacts (G) 20*a* and the signal line contacts (S) 20*b* are arranged to form. a G-S-S-G-S-S-G pattern. The plurality of contacts 20 on the first row are formed into substantially the same shape. Each contact 20 is formed by punching a thin metal sheet into an elongated plate shape, and then by performing press work to bend the sheet into an L-shape.

Figure 4:
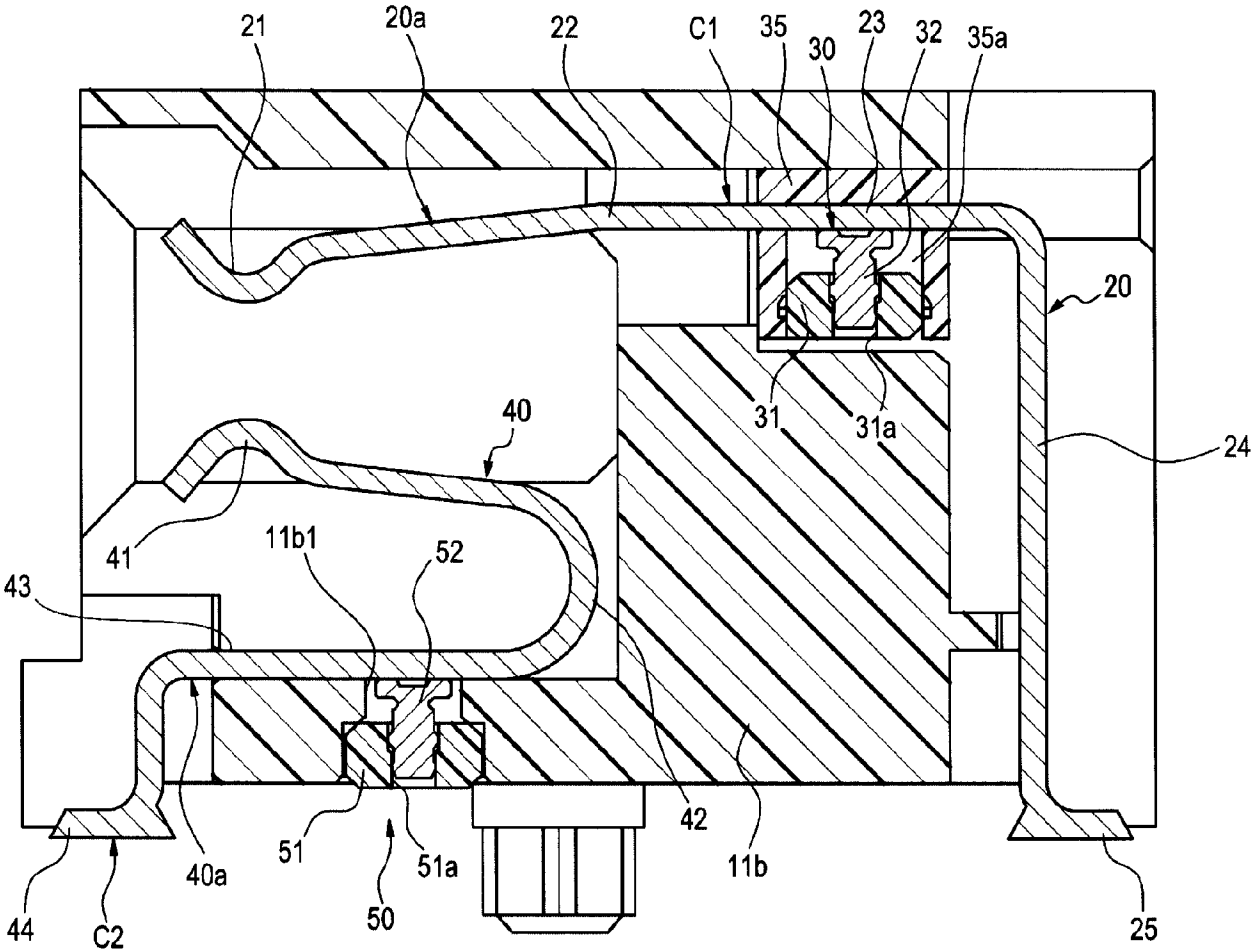
FIG. 4 is a cross-sectional view of the receptacle connector shown in FIG. 1.

As illustrated in FIG. 3 and FIG. 4, each of the multiple contacts 20 on the first row includes a contact portion 21, an elastically deformed portion 22, a fixing portion 23, a vertical portion 24, and a terminal portion 25. When the multiple contacts 20 on the first row are assembled into the housing 11, the contact portion 21, the elastically deformed portion 22, and the fixing portion 23 of each of the contacts 20 are disposed in the corresponding first slit 14 provided in the housing 11. In addition, when the multiple contacts 20 on the first row are assembled into the housing 11, the vertical portion 24 and the terminal portion 25 of each of the contacts 20 are disposed in the second accommodating space 18.

The contact portion 21 of each of the plurality of contacts 20 on the first row has such a shape convexly curved downward, and is formed to protrude downward inside the first accommodating space 16 from the corresponding first slit 14. The contact portion 21 is capable of coming into contact with a first pad 82*a*, which is an external contact point of the plug connector 80 corresponding to contact portion 21, at a given contact pressure.

Each elastically deformed portion 22 is formed to extend substantially horizontally from the fixing portion 23 and to be continued to contact portion 21. This elastically deformed portion 22 is configured to be elastically deformed by the insertion of the plug connector 80, and thus to provide the given contact pressure between the contact portion 21 and the first pad 82*a*.

Each fixing portion 23 is designed to extend continuously in the horizontal direction from the elastically deformed portion 22. The plurality of contacts 20 on the first row are integrated together with the housing 11 by molding the support portion 35 of the housing 11 through the intermediary of the fixing portions 23 by insert-molding. The plurality of contacts 20 on the first row are formed as a first-row contact set C1 (see FIG. 4). This support portion 35 has an opening 35*a* which is opened downward. Among the plurality of contacts 20 on the first row, the plurality of ground contacts 20*a* are electrically connected to the first conductive member 30 to be described later via the fixing portions 23 thereof.

Each vertical portion 24 is a portion to connect the fixing portion 23 to the terminal portion 25. The vertical portion 24 is bent downward substantially at right angle from the horizontal fixing portion 23, then extends downward and is continued to the terminal portion 25.

Each terminal portion 25 is formed at a lower end portion of the vertical portion 24. The terminal portion 25 is bent backward substantially at right angle from the vertical portion 24 and is thus formed to extend backward. This terminal portion 25 can be connected to an external contact point formed on a surface layer part of the circuit board PC. To be more precise, each terminal portion 25 is soldered to the corresponding external contact point of the circuit board PC, whereby the plurality of contacts 20 on the first row are electrically connected to an electrical circuit formed on the circuit board PC via the terminal portions 25 and the external contact points described above.

Next, as with the plurality of contacts 20 on the first row, the plurality of contacts 40 on the second row according to the embodiment include a plurality of ground contacts (G) 40*a* and a plurality of signal line contacts (S) 40*b* arranged adjacent to one another. As with the plurality of contacts 20 on the first row, the plurality of ground contacts (G) 40*a* and the plurality of signal line contacts (S) 40*b* are arranged to form a G-S-S-G-S-S-G pattern. Each of the multiple contacts 40 on the second row is formed by punching a thin metal sheet into an elongated plate shape and then performing press work to bend the plate substantially into a U-shape.

As illustrated in FIG. 3 and FIG. 4, each of the plurality of contacts 40 on the second row includes a contact portion 41, an elastically deformed portion 42, a fixing portion 43, and a terminal portion 44. When the plurality of contacts 40 on the second row are assembled into the housing 11, the contacts 40 are disposed in the respective second slits 15 provided in the housing 11.

The contact portion 41 of each of the plurality of contacts 40 on the second row has such a shape convexly curved upward, and is formed to protrude upward inside the first accommodating space 16 from the corresponding second slit 15. This contact portion 41 is capable of coming into contact with a second pad 82*b*, which is another external contact point of the plug connector 80 corresponding to contact portion 41, at a given contact pressure.

Each elastically deformed portion 42 is formed substantially into the U-shape continuously from the contact portion 41 to the fixing portion 43. The elastically deformed portion 42 is configured to be elastically deformed by the insertion of the plug connector 80, and thus to provide the given contact pressure between the contact portion 41 and the second pad 82*b*. Moreover, among the plurality of contacts 40 on the second row, the plurality of ground contacts 40*a* are electrically connected to the second conductive member 50 to be described later via the respective elastically deformed portions 42 thereof.

Each fixing portion 43 is bent downward substantially at right angle from a lower end of the elastically deformed portion 42, then extends downward and is continuous with the terminal portion 44. The plurality of contacts 40 on the second row are integrated with the housing 11 by insert-molding or press-fitted and fixed thereto through the fixing portions 43. The plurality of contacts 40 on the second row are formed as a second-row contact set C2 (see FIG. 4).

Each terminal portion 44 is formed at a lower end portion of the fixing portion 43. The terminal portion 44 is bent forward substantially at right angle from this fixing portion 43 and is then formed to extend forward. This terminal portion 44 can be connected to an external contact point formed on the surface layer part of the circuit board PC. To be more precise, each terminal portion 44 is soldered to the corresponding external contact point of the circuit board PC, whereby the plurality of contacts 40 on the second row are electrically connected to the electrical circuit formed on the circuit board PC via the external contact points and the terminal portions 44 described above.

Figure 5:
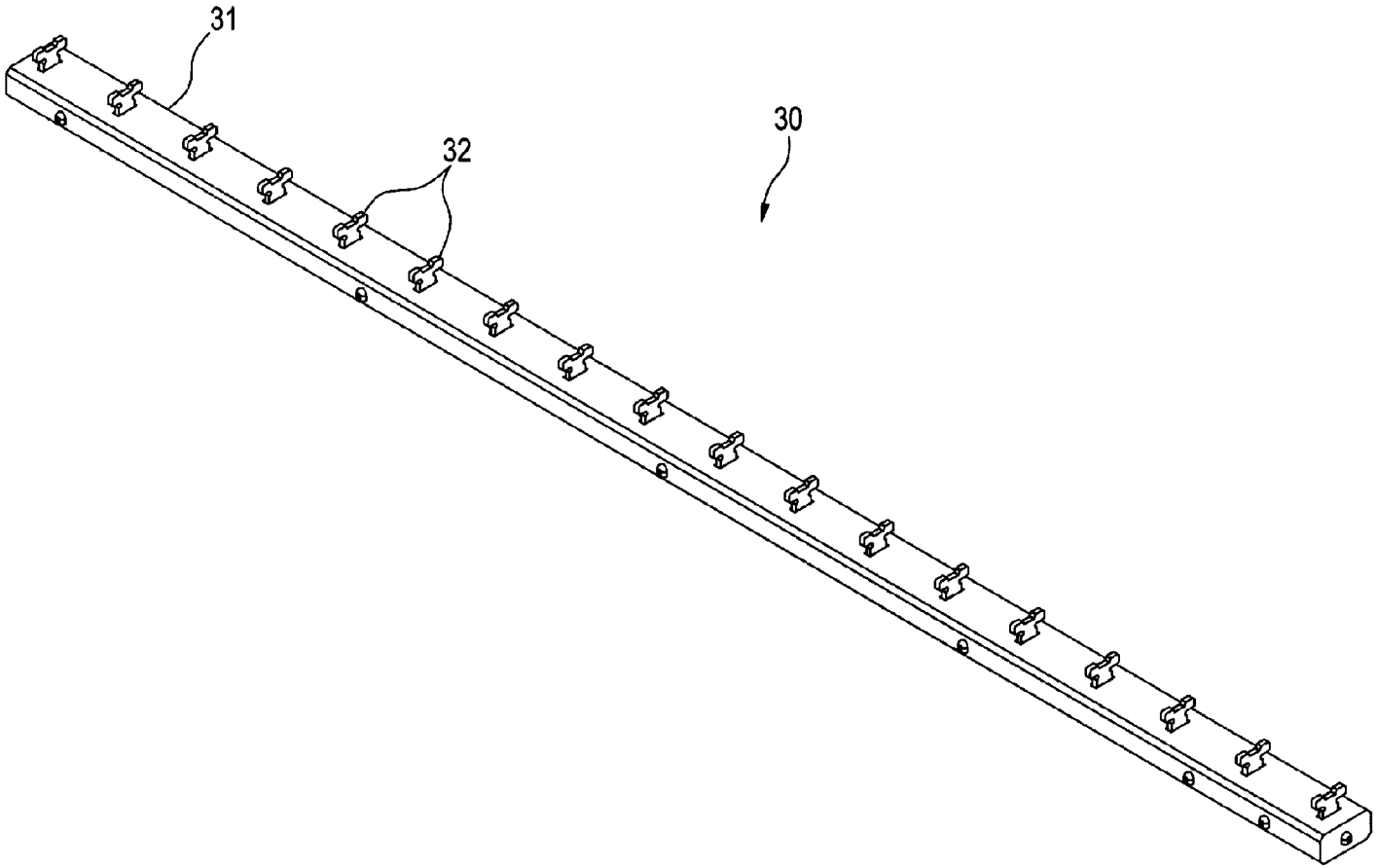
FIG. 5 is a perspective view illustrating a conductive member provided in the receptacle connector shown in FIG. 1.
Figure 6A:
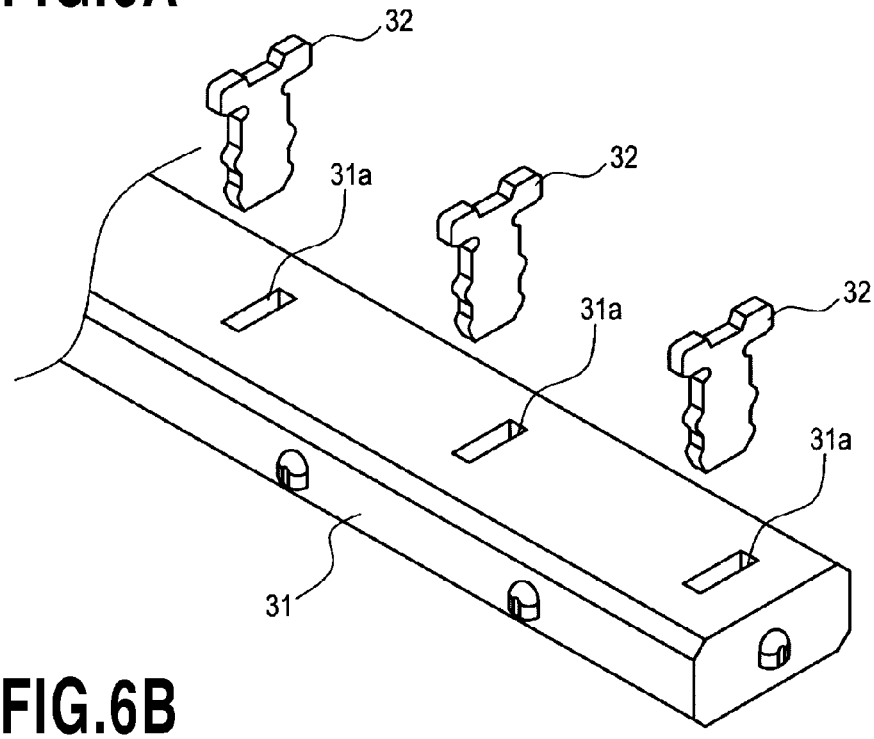
FIG. 6A is a perspective view of the conductive member shown in FIG. 5, which illustrates a state before plurality of connection parts and a conductive resin member are assembled together.
Figure 6B:
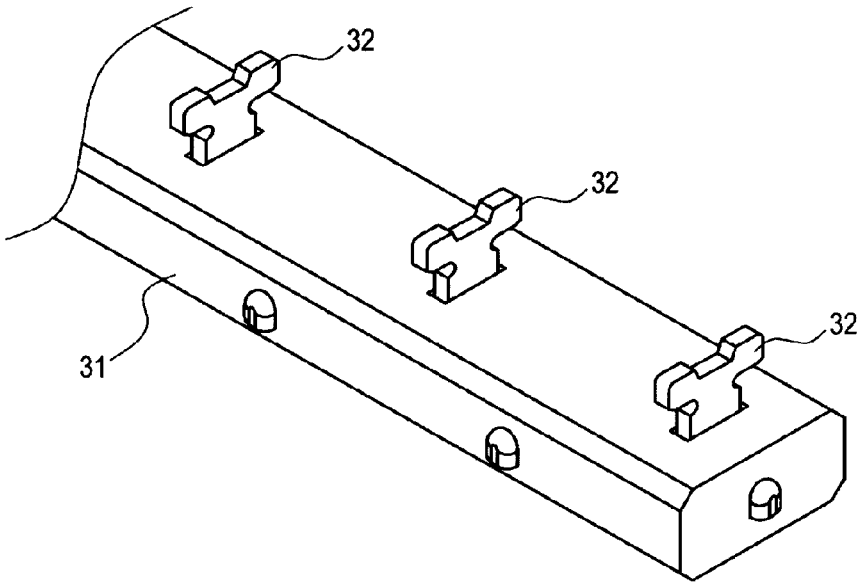
FIG. 6B is a perspective view of the conductive member shown in FIG. 5, which illustrates a state where the plurality of connection parts and the conductive resin member are assembled together.

Next, the first conductive member 30 and the second conductive member 50 constituting part of the receptacle connector 10 according to this embodiment will be described with reference to FIG. 4 to FIG. 6.

Usually, ground wires to be located on the circuit board PC are connected to one another by using a ground common plane or the like inside the circuit board PC, and are configured to have the same electric potential as well. On the other hand, when the respective sets of the plurality of contacts 20 and 40 are connected to the circuit board PC through only two contacts located on both end sides inside the receptacle connector 10, the ground contacts 20*a* and 40*a* are each located at a distance away from the ground common plane provided inside the circuit board PC. For this reason, each ground contact 20*a* and each ground contact 40*a* has electric potential which is different from one another, and the electric potential of each ground contact 20*a* and the electric potential of each ground contact 40*a* are different from the electric potentials of the ground wires on the circuit board PC. Hence, shield effects for the ground contacts 20*a* and 40*a* against high-frequency signals having frequency components of several gigahertz(GHz) are degraded. As a consequence, there is a risk of causing an increase in crosstalk between two signal line contacts 20*b*, 40*b* adjacent to each other, or crosstalk between neighboring two signal line contacts 20*b*, 40*b* close to each other while interposing one ground contact 20*a*, 40*a* in between.

For this reason, in this embodiment, the plurality of ground contacts 20*a* are joined to one another by using the first conductive member 30 in order to equalize the electric potentials of the plurality of ground contacts 20*a* each other among the plurality of contacts 20 on the first row. In addition, the plurality of ground contacts 40*a* are joined to one another by using the second conductive member 50 in order to equalize the electric potentials of the plurality of ground contacts 40*a* each other among the plurality of contacts 40 on the second row.

The first conductive member 30 will be described to begin with. The first conductive member 30 is a member configured to electrically connect the plurality of ground contacts 20*a* in a lump among the plurality of contacts 20 on the first row. The first conductive member 30 includes a conductive resin member 31 and plurality of connection parts 32 (an example of first connection parts) each made of a thin metal sheet material. As illustrated in FIG. 4, the first conductive member 30 is inserted from below and fixed into the opening 35*a* that is provided within the support portion 35 in order to integrate the plurality of contacts 20 on the first row.

The conductive resin member 31 is formed by injection molding a conductive resin material. The conductive resin material is a conductive resin material prepared, for example, by blending fine particles or fibers of a conductive material such as carbon or nickel with a synthetic resin material such as LCP (liquid crystal polymer) or PPS (polyphenylene sulfide). As illustrated in FIG. 5, the conductive resin member 31 is flattened as well as elongated, and extends in the right-left direction.

As illustrated in FIG. 4, rectangular openings 31*a* are provided in the conductive resin member 31 respectively at positions corresponding to the fixing portions 23 of the plurality of ground contacts 20*a*. The connection parts 32 are respectively inserted into the plurality of openings 31*a*. Each connection part 32 is made of a thin metal sheet material and is electrically connected to the corresponding ground contact 20*a*. As illustrated in FIG. 6A, in each connection part 32, side surfaces of portions to be inserted into the opening 31*a* have inequality shapes. Such inequality shapes come into physical contact with an inner peripheral surface of the corresponding opening 31*a* of the conductive resin member 31, and thus the connection part 32 is fixed to a prescribed position.

As illustrated in FIG. 4, each opening 31*a* vertically penetrates the conductive resin member 31. Each connection part 32 is inserted into the corresponding opening 31*a* in such a way that a clearance is provided between a lower end portion of the connection part 32 and a lower end surface of the opening 31*a*. Hereby, when an upper end portion of each connection part 32 comes into contact with a lower surface of the corresponding ground contact 20*a*, the connection part 32 is moved downward inside the opening 31*a* by being pressed by a lower surface of the fixing portion 23 of the ground contact 20*a*. Hence, this makes it possible to adjust a height position of each connection part 32 in accordance with a height of each ground contact 20*a*.

Since the first conductive member 30 is formed as described above, the plurality of ground contacts 20*a* among the plurality of contacts 20 on the first row are electrically connected to one another. Hereby, the first conductive member 30 can keep all the plurality of ground contacts 20*a* at the same electric potential.

Next, the second conductive member 50 will be described. The second conductive member 50 is a member configured to electrically connect the plurality of ground contacts 40*a* in a lump among the plurality of contacts 40 on the second row. The second conductive member 50 includes a conductive resin member 51 and a plurality of connection parts 52 (another example of the first connection parts) each made of a thin metal sheet material.

As with the conductive resin member 31 of the first conductive member 30, the conductive resin member 51 is made of a conductive resin material. The conductive resin material is a conductive resin material prepared, for example, by blending fine particles or fibers of a conductive material such as carbon or nickel with a synthetic resin material such as LCP (liquid crystal polymer) or PPS (polyphenylene sulfide).

As illustrated in FIG. 4, openings 51*a* are provided in the conductive resin member 51 respectively at positions corresponding to the elastically deformed portions 42 of the plurality of ground contacts 40*a*. The connection parts 52 made of a metal material and designed to be electrically connected to the plurality of ground contacts 40*a* are respectively inserted into these plurality of openings 51*a*. As with the plurality of connection parts 32, in each connection part 52, side surfaces of portions to be inserted into the opening 51*a* have inequality shapes. Such inequality shapes come into physical contact with an inner peripheral surface of the corresponding opening 51*a* of the conductive resin member 51, and thus the connection part 52 is fixed to a prescribed position.

As illustrated in FIG. 4, each opening 51*a* vertically penetrates the conductive resin member 51. Each connection part 52 is inserted into the corresponding opening 51*a* in such a way that a clearance is provided between a lower end portion of the connection part 52 and a lower end surface of the opening 51*a*. Hereby, when an upper end portion of each connection part 52 comes into contact with a lower surface of the corresponding elastically deformed portion 42 of the ground contact 40*a*, the connection part 52 is moved downward inside the opening 51*a* by being pressed by the lower surface of the elastically deformed portion 42 of the ground contact 40*a*. Hence, this makes it possible to adjust a height position of each connection part 52 in accordance with a height of each ground contact 40*a*.

Since the second conductive member 50 is formed as described above, the plurality of ground contacts 40*a* among the plurality of contacts 40 on the second row are electrically connected to one another. Hereby, the second conductive member 50 can keep all the plurality of ground contacts 40*a* at the same electric potential.

Next, the plug connector 80 of the first embodiment will be described with reference to FIG. 3.

The first pads 82*a* of a plurality of contacts 82Ai and 82Ci as well as the second pads 82*b* of a plurality of contacts 82Bi and 82Di each made of a conductive thin metal sheet are respectively disposed on upper and lower surfaces of the blade 81 of the plug connector 80. When the blade 81 is inserted into the first accommodating space 16 of the receptacle connector 10, these plurality of first pads 82*a* and these plurality of second pads 82*b* serving as the external contact points respectively come into contact with the plurality of contacts 20 of the first-row contact set C1 and the plurality of contacts 40 of the second-row contact set C2 which are arranged on upper and lower parts of the receptacle connector 10. The plurality of contacts 82Bi and 82Di are formed to face the contacts 82Ai and 82Ci, respectively.

The plurality of first pads 82*a* and the plurality of second pads 82*b* of the plug connector 80 respectively include a plurality of signal line external contact points (S) and a plurality of ground external contact points (G). These plurality of signal line external contact points (S) and these plurality of ground external contact points (G) are arranged to form a G-S-S-G-S-S-G pattern so as to correspond to the plurality of contacts 20 and 40 of the receptacle connector 10. Accordingly, when the blade 81 is inserted into the first accommodating space 16 of the receptacle connector 10, the circuit board PC to which the receptacle connector 10 is attached and the printed wiring board 90 attached to the plug connector 80 via the plurality of contacts 82Ai to 82Di are electrically connected to each other. Hereby, this enables bidirectional signal transmission by means of high-speed transmission between the circuit board PC and the printed wiring board 90.

As illustrated in FIG. 3, a plug-side conductive member 85 is provided between the contacts 82Ai of the first pads 82*a* having the ground external contact points (G) and the contacts 82Bi of the second pads 82*b* having the ground external contact points (G). The plug-side conductive member 85 is comprised of a conductive resin material and is provided at positions corresponding to the plurality of ground external contact points (G). For this reason, the plug-side conductive member 85 is capable of electrically connecting all the ground external contact points (G) of the plurality of contacts 82Ai and 82Bi respectively provided on the upper and lower surfaces of the blade 81 to one another, and thereby keeping all the ground external contact points (G) of the plurality of contacts 82Ai and 82Bi at the same electric potential.

Next, assembly of the first-row contact set C1 and the second-row contact set C2 into the receptacle connector 10 in the first embodiment will be briefly described.

To begin with, the first-row contact set C1 is formed by integrating the plurality of contacts 20 on the first row with the support portion 35 by insert molding. Next, the first conductive member 30 is inserted from below into the opening 35*a* provided inside the support portion 35. Hereby, the upper end portions of the connection parts 32 of the inserted first conductive member 30 respectively come into physical contact with the fixing portions 23 of the corresponding ground contacts 20*a*. At this time, the upper end portion of each connection part 32 is pressed by the fixing portion 23 of the corresponding ground contact 20*a*. Thus, each connection part 32 is moved downward inside the opening 31*a* of the conductive resin member 31. Herewith, the height position of the connection part 32 is adjusted.

Subsequently, the first-row contact set C1 into which the first conductive member 30 is assembled is inserted from the back side into the second accommodating space 18 of the housing 11. At this time, the contact portions 21 and the elastically deformed portions 22 of the plurality of contacts 20 on the first row are located in the corresponding first slits 14. Hereby, the support portion 35 is located at a prescribed position inside the second accommodating space 18. In this way, the first-row contact set C1 is supported by and fixed to the receptacle connector 10.

Next, the second-row contact set C2 is inserted from the front side into the first accommodating space 16. At this time, the plurality of contacts 40 of the second-row contact set C2 are located in the corresponding second slits 15. Hereby, the second-row contact set C2 is supported by and fixed to the receptacle connector 10.

Thereafter, the second conductive member 50 is press-fitted from below into the hollow portion 11*b*1 formed in the lower wall 11*b* of the housing 11. The upper end portions of the plurality of connection parts 52 of the press-fitted second conductive member 50 respectively come into physical contact with the elastically deformed portions 42 of the corresponding ground contacts 40*a*. At this time, the upper end portion of each connection part 52 is pressed by the elastically deformed portion 42 of the corresponding ground contact 40*a*. Thus, each connection part 52 is moved downward inside the opening 51*a* of the conductive resin member 51, and the height position of the connection part 32 is adjusted.

In this way, the assembly of the receptacle connector 10 of the first embodiment is completed.

As described above, according to the receptacle connector 10 of the first embodiment, the receptacle connector 10 is provided with the first and second conductive members 30 and 50 comprised of the connection parts 32 and 52 each made of a metal material, and the conductive resin members 31 and 51 to be electrically connected to the connection parts 32 and 52, respectively. In addition, the metallic connection parts 32 and 52 are electrically connected to the plurality of ground contacts 20*a* and 40*a*. For this reason, even when the plurality of contacts 20 and 40 are arranged at a narrow pitch, the metallic connection parts 32 and 52 can easily be disposed at the narrow pitch corresponding to the plurality of ground contacts 20*a* and 40*a* since the metallic connection parts 32 and 52 can be formed easily. Thus, it is possible to increase the freedom of array of the plurality of ground contacts 20*a* and 40*a* as well as the freedom of array of the plurality of signal line contacts 20*b* and 40*b*, and to achieve reduction in size of the electrical connector comprised of the receptacle connector 10 and the plug connector 80. Furthermore, the receptacle connector 10 of the first embodiment has a simple structure and can therefore be manufactured easily.

Incidentally, in the receptacle connector as described in Patent Document 1, there may be a case where height positions of the plurality of ground contacts, which come into contact with the minute contact projections formed to project from the surface of the conductive resin member of the common contact, vary slightly depending on contact positions thereof. In this case, if the contact projections are formed integrally with the conductive resin member by using the resin material as in the related art, then there is a risk that some of the ground contacts among the plurality of ground contacts cannot secure the physical contact with the corresponding contact projections.

On the other hand, according to the receptacle connector 10 of the first embodiment, the upper end portions of the connection parts 32 and 52 of the first and second conductive members 30 and 50 come into contact with and get pressed by the fixing portions 23 of the ground contacts 20*a* and the elastically deformed portions 42 of the ground contacts 40*a*, respectively. Thus, the ground contacts 20*a* and 40*a* are adapted to be able to adjust the height positions. For this reason, even when there are variations in height (Ha) of the ground contacts 20*a* and in height (Hb) of the ground contacts 40*a* (see FIG. 3), it is possible to secure the physical contact of the connection parts 32 and 52 with the corresponding ground contacts 20*a* and 40*a*. Hereby, the first and second conductive members 30 and 50 can always keep the electric potentials of the respective ground contacts 20*a* and 40*b* at the same electric potential. As a consequence, it is possible to reduce crosstalk between the signal lines and to prevent radiation of noise. In addition, such radiation is absorbed by the conductive resin members 31 and 51.

First Variant Example

Figure 7:
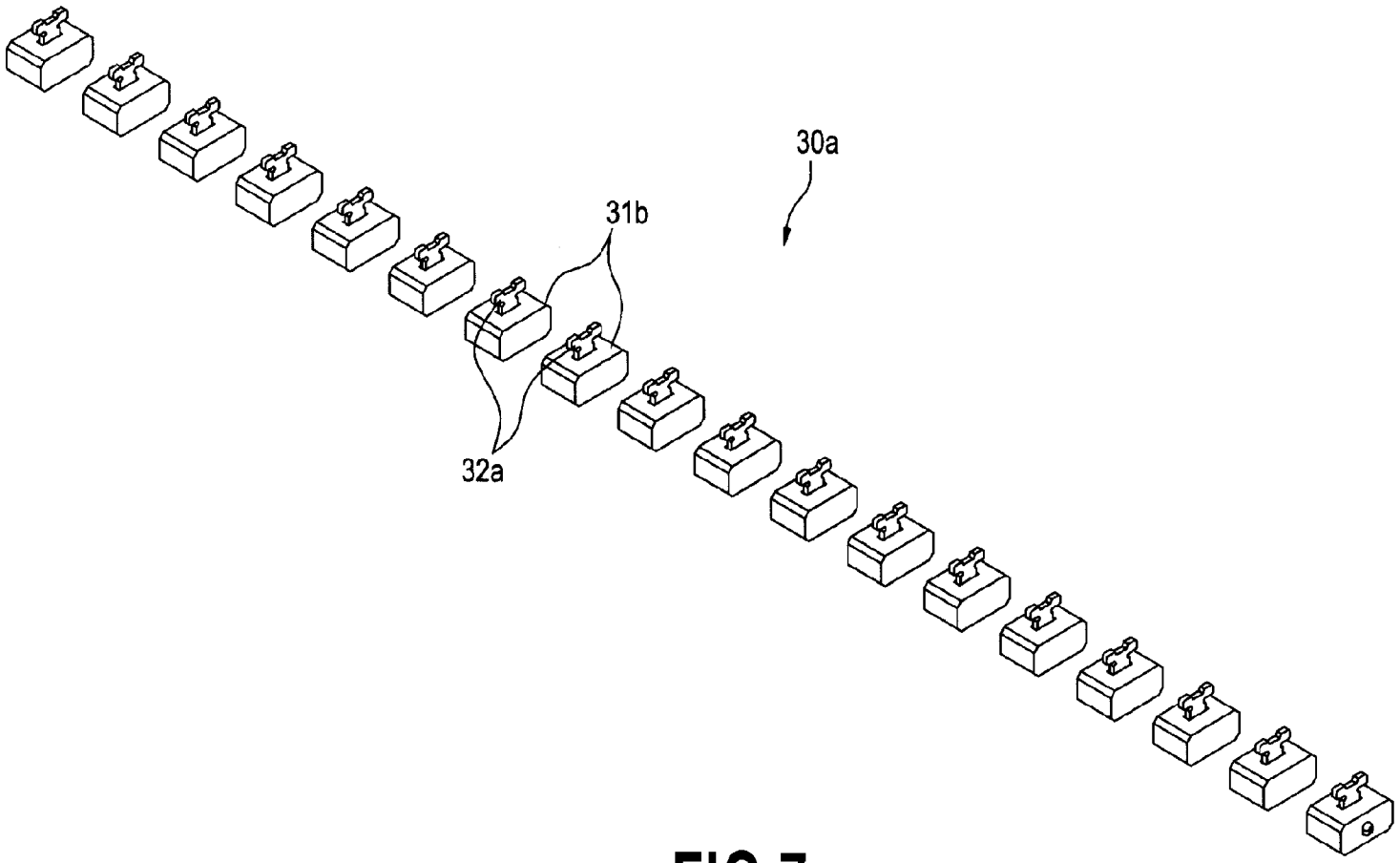
FIG. 7 is a perspective view illustrating a variant example of the conductive member shown in FIG. 5.

FIG. 7 illustrates a first variant example of the above-described first embodiment.

As illustrated in FIG. 7, instead of the above-described first conductive member 30, a first conductive member 30*a* of the first variant example may adopt a configuration in which conductive resin member 31*b* is split into a plurality of segments in accordance with the number of the plurality of ground contacts 20*a*. According to this configuration, the conductive resin member 31*b* split into the multiple segments can be independently disposed in accordance with the array and dimensions of the plurality of ground contacts 20*a*. Thus, it is possible to increase the freedom of design of the receptacle connector 10.

Likewise, regarding the conductive resin member 51 of the second conductive member 50 described above, a different conductive resin member may be provided instead of the conductive resin member 51, and adopt a configuration to be split into a plurality of segments in accordance with the number of the plurality of ground contacts 40*a*.

Second Embodiment

Next, a second embodiment of the receptacle connector constituting part of the electrical connector according to the present invention will be described with reference to FIG. 8 to FIG. 11. Note that constituents in FIG. 8 to FIG. 11 which are the same as those in the example illustrated in FIG. 3 will be denoted by the same reference signs and overlapping descriptions thereof will be omitted.

Figure 8:
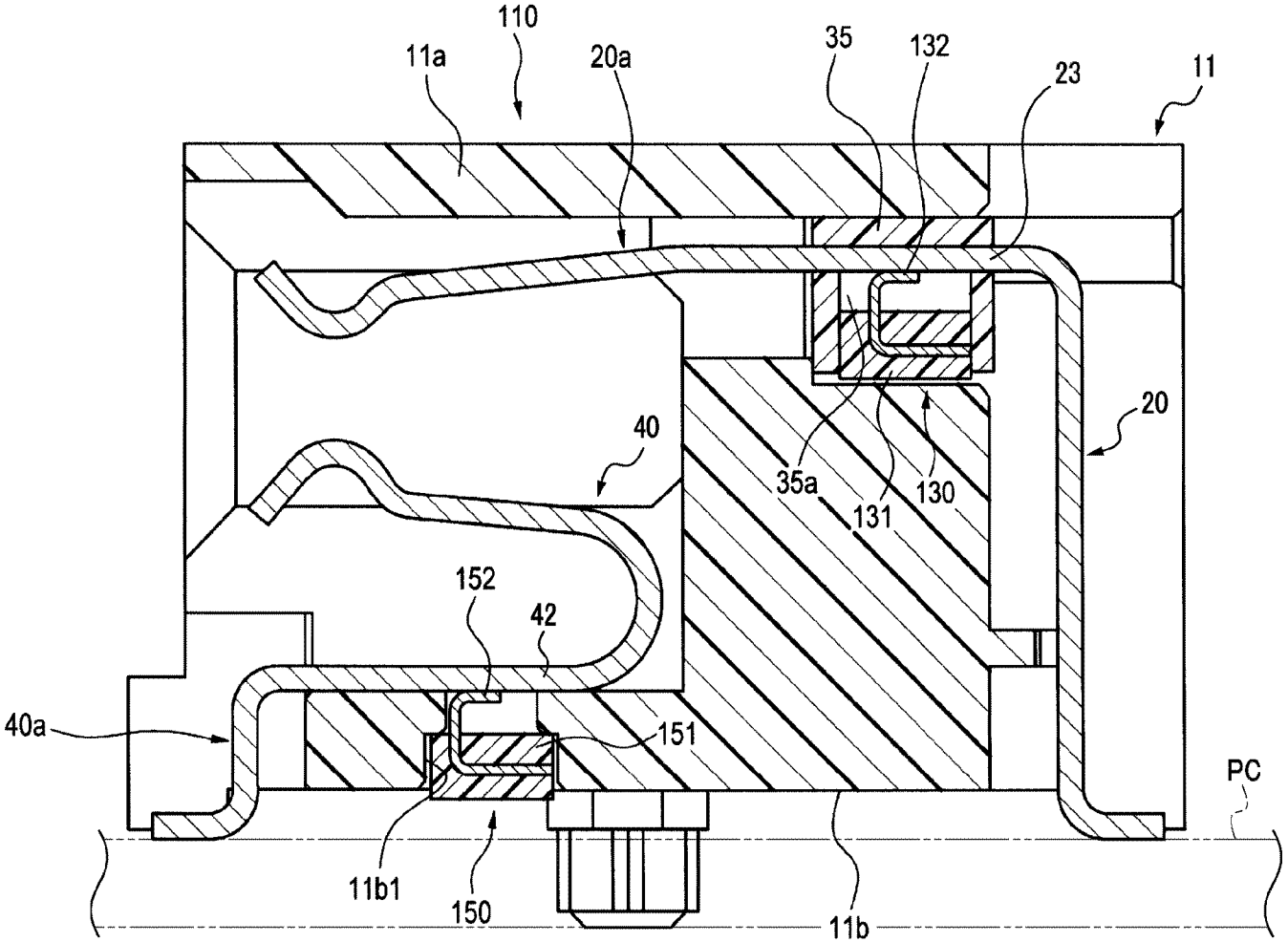
FIG. 8 is a cross-sectional view of a receptacle connector according to a second embodiment of the present invention.
Figure 9:
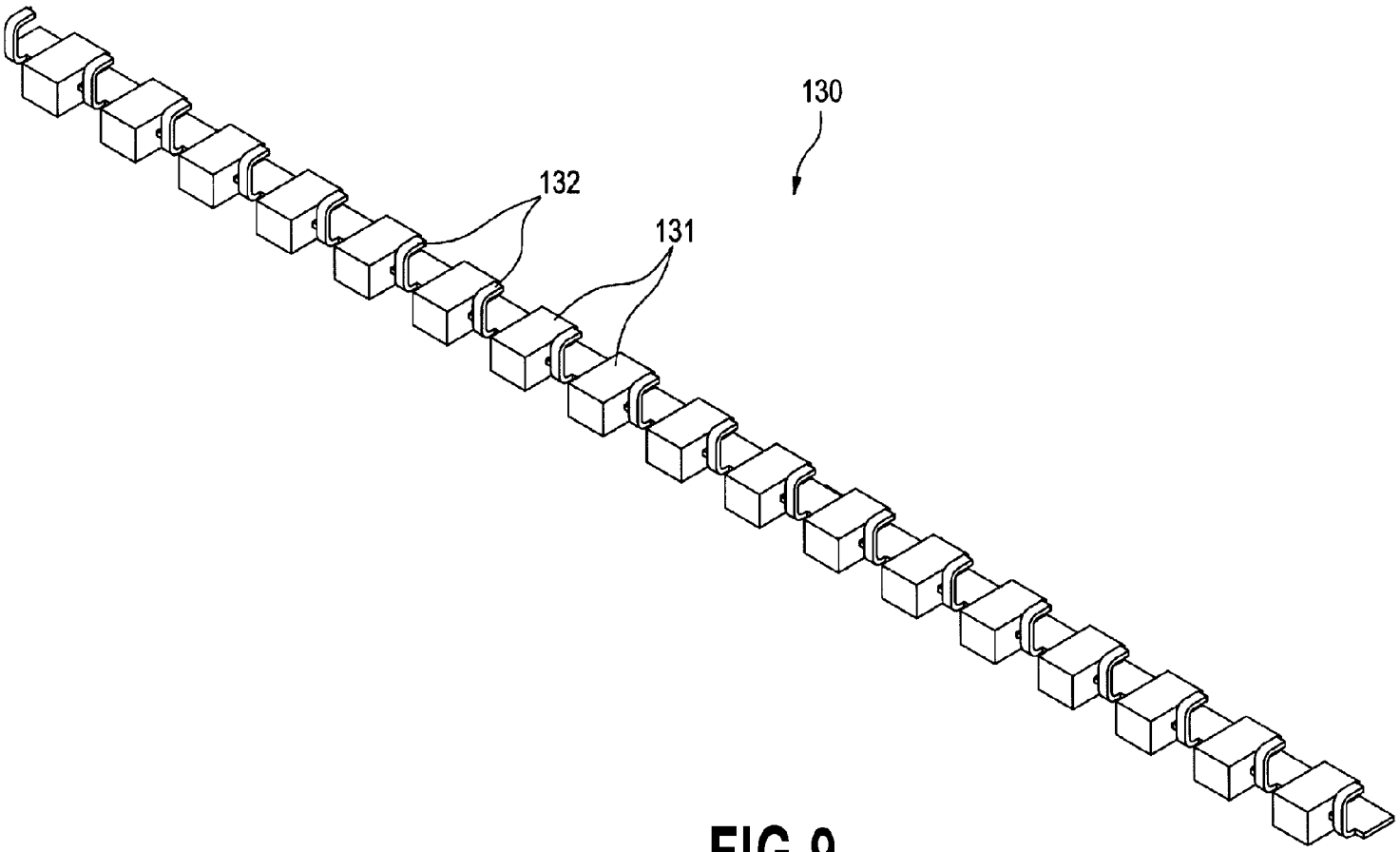
FIG. 9 is a perspective view illustrating a conductive member provided in the receptacle connector shown in FIG. 8.
Figure 10A:
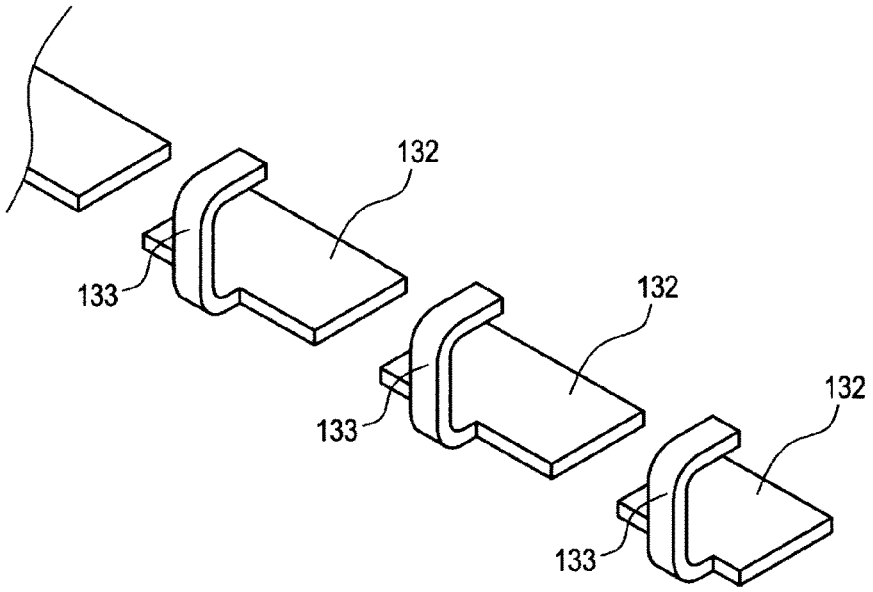
FIG. 10A is a perspective view showing a plurality of connection parts which is provided in the conductive member shown in FIG. 9.
Figure 10B:
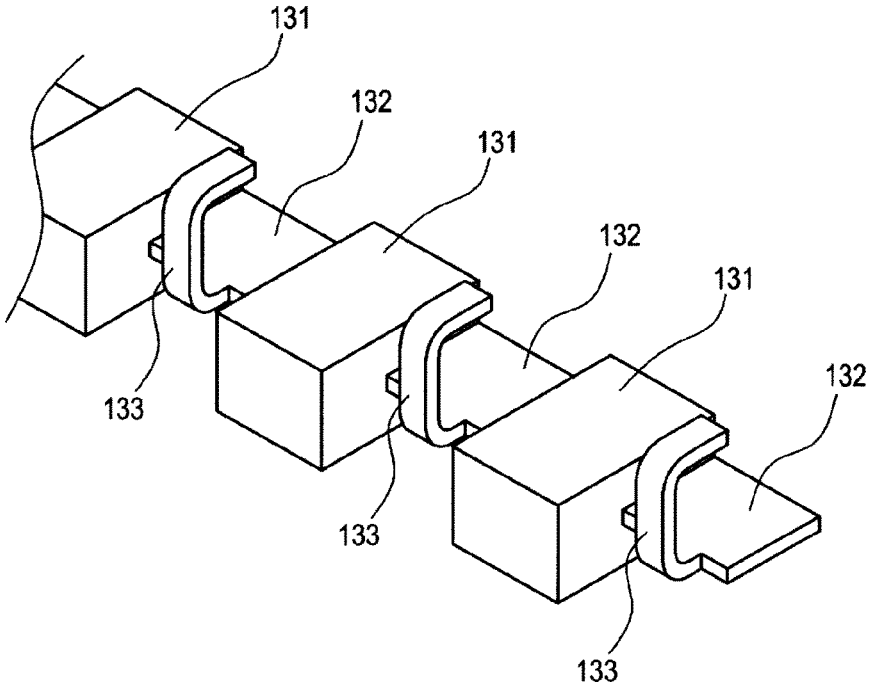
FIG. 10B is a perspective view showing a state where the plurality of connection parts are integrated together by using a plurality of conductive resin members shown in FIG. 9.

As illustrated in FIG. 8 and FIG. 9, in the second embodiment, a first conductive member 130 of a receptacle connector 110 constituting part of the electrical connector includes a plurality of conductive resin members 131 each made of a conductive resin material, and a plurality of connection parts 132 each made of a thin metal sheet material. As illustrated in FIGS. 10A and 10B, the first conductive member 130 is formed by joining the plurality of connection parts 132 together by using the plurality of conductive resin members 131. Specifically, two adjacent connection parts 132 are joined together through the intermediary of one conductive resin member 131. A curved portion 133 having a substantially C-shaped cross section to come into contact with the fixing portion 23 of the corresponding ground contact 20*a* described above is formed integrally with a flat plate part of each connection part 132. A tip end portion of this curved portion 133 is designed to be elastically deformable.

Likewise, a second conductive member 150 includes a plurality of conductive resin members 151 each made of a conductive resin material, and a plurality of elastically deformable connection parts 152 each made of a thin metal sheet material. Two adjacent connection parts 152 are joined together through the intermediary of one conductive resin member 151. The shape of each connection part 152 and the shape of each conductive resin member 151 are the same as those of the connection part 132 and the conductive resin member 131, respectively.

According to this configuration, a variation in height of the ground contacts 20*a* on the first row is absorbed by the elastically deformable curved portions 133. As a consequence, the physical contact between the fixing portion 23 of each ground contact 20*a* and a tip end portion of each corresponding connection part 132 of the first conductive member 130 can always be secured. Likewise, the physical contact between the elastically deformed portion 42 of each ground contact 40*a* on the second row and a tip end portion of each corresponding connection part 152 of the second conductive member 150 can always be secured.

Moreover, as compared to the above-described first embodiment, it is possible to reduce the use of the expensive conductive resin material and thereby to achieve cost reduction. Furthermore, since the plurality of connection parts 132 and 152 are electrically connected to one another by using the conductive resin members 131 and 151 which are split into the multiple segments, it is possible to achieve the effect of preventing the deterioration in shield effect and to achieve the effect to suppress the amount of crosstalk as with the above-described first embodiment.

Figure 11A:
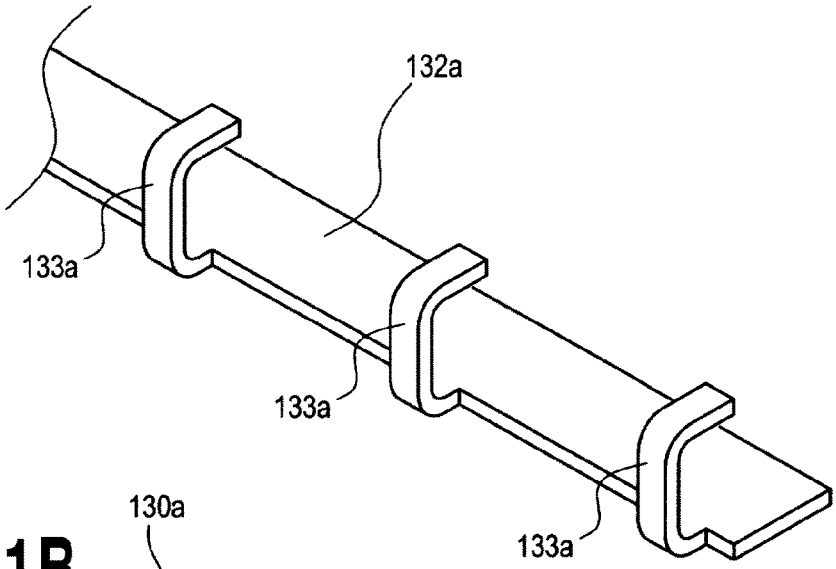
FIG. 11A is a perspective view of a variant example of the conductive member shown in FIG. 5, which illustrates a connection part provided in the conductive member.
Figure 11B:
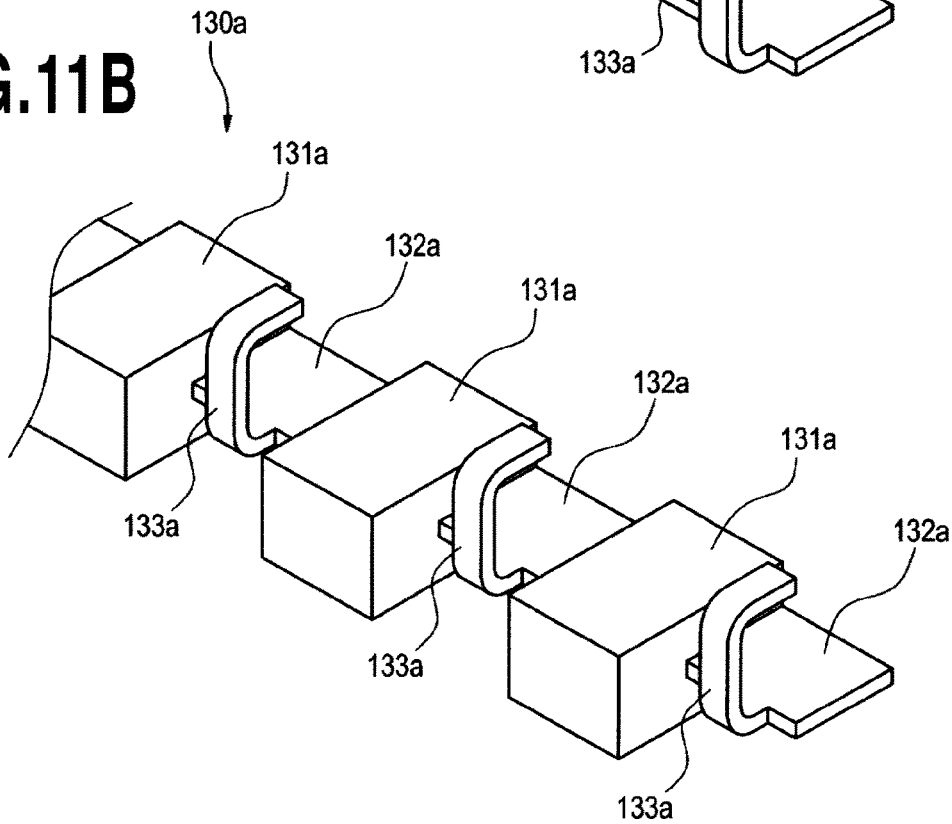
FIG. 11B is a perspective view of the variant example of the conductive member shown in FIG. 5, which illustrates a state where the connection part is covered with a plurality of conductive resin members.

Here, in a first conductive member 130*a* as illustrated in FIG. 11A and FIG. 11B, a plurality of conductive resin members 131*a* may be formed at given intervals by covering spaces between a plurality of curved portions 133*a* provided at given intervals on a single connection part 132*a* made of a metal material respectively with conductive resin materials. This configuration enables the integration of the conductive resin members 131*a* with the connection part 132*a* by a simpler method.

Third Embodiment

Next, a third embodiment of the receptacle connector constituting part of the electrical connector according to the present invention will be described with reference to FIG. 12 and FIG. 13. In FIG. 13, constituents which are the same as those in the example illustrated in FIG. 3 will be denoted by the same reference signs and overlapping descriptions thereof will be omitted. In the meantime, FIG. 13 illustrates one ground contact 20*a* to represent the plurality of contacts 20 on the first row, and one ground contact 40*a* to represent the plurality of contacts 40 on the second row.

Figure 12:
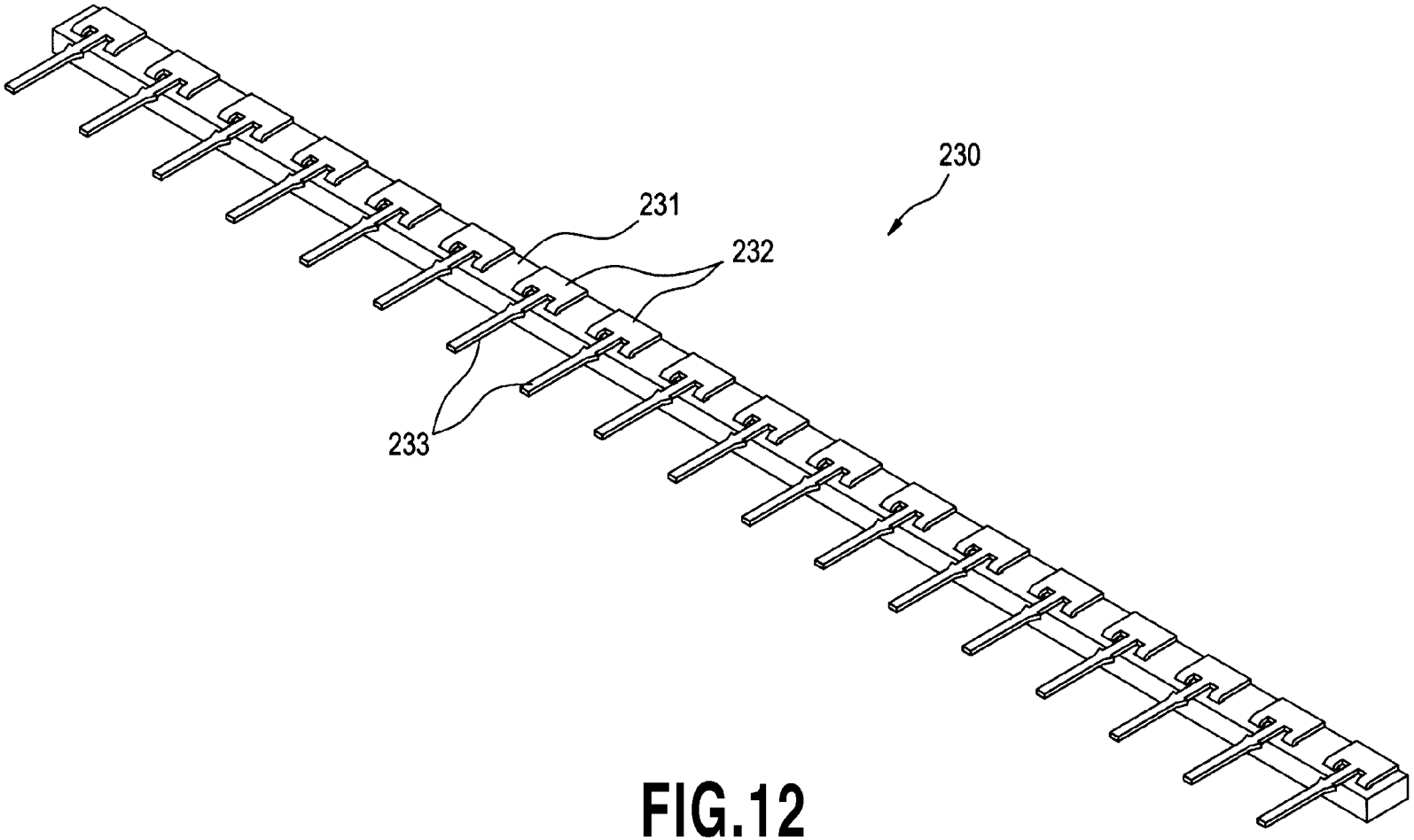
FIG. 12 is a perspective view illustrating a conductive member provided in a receptacle connector according to a third embodiment of the present invention.
Figure 13:
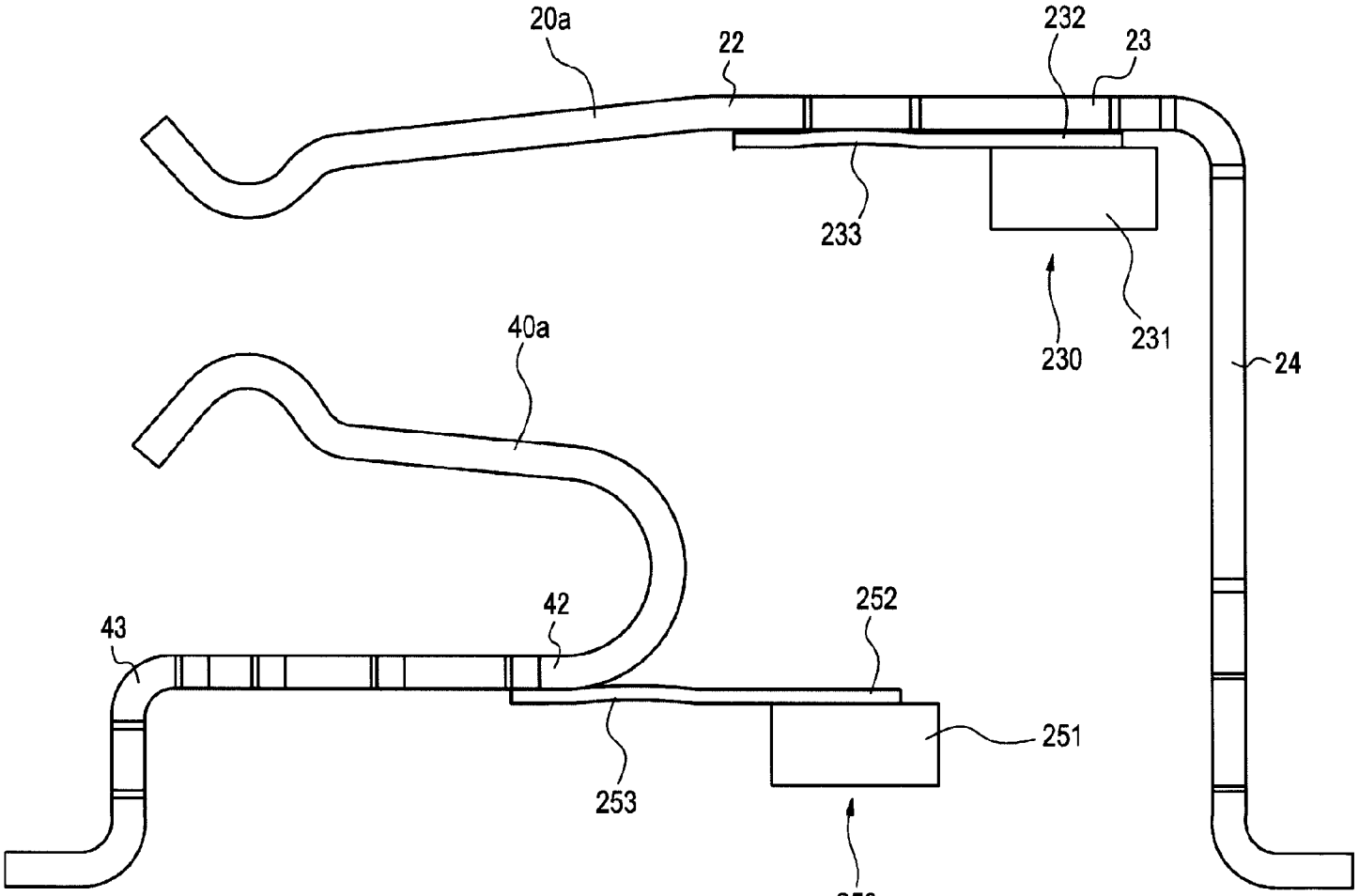
FIG. 13 is a side view illustrating a state where the conductive member shown in FIG. 12 is in physical contact with a ground contact.

As illustrated in FIG. 12 and FIG. 13, in the third embodiment, a first conductive member 230 of the receptacle connector 10 includes a conductive resin member 231 made of a conductive resin material, and a plurality of connection parts 232 each made of a thin metal sheet material. The plurality of connection parts 232 are attached at given intervals to an upper surface of the conductive resin member 231 at positions corresponding to the ground contacts 20*a* among the plurality of contacts 20 on the first row.

Each of the connection parts 232 includes a small-width protrusion 233 which protrudes forward. As illustrated in FIG. 13, the protrusion 233 has a very gently convex shape in a side view. A tip end portion of each protrusion 233 comes into physical contact with the fixing portion 23 of the corresponding ground contact 20*a* on the first row, and is thus made elastically deformable.

Likewise, a second conductive member 250 includes a conductive resin member 251 made of a conductive resin material, and a plurality of connection parts 252 each made of a thin metal sheet material. Each of the connection parts 252 includes a small-width protrusion 253 which protrudes forward. The protrusion 253 has a very gently convex shape in a side view. A tip end portion of each protrusion 253 comes into physical contact with the elastically deformed portion 42 of the corresponding ground contact 40*a* on the second row, and is thus made elastically deformable.

According to this configuration, the variations in height (Ha) of the ground contacts 20*a* and in height (Hb) of the ground contacts 40*a* are absorbed by the elastically deformable protrusions 233 and 253 (see FIG. 3). For this reason, as with the first and second embodiments described above, the physical contact between the fixing portion 23 of each ground contact 20*a* and the protrusion 233 of each corresponding connection part 232 or between the elastically deformed portion 42 of each ground contact 40*a* and the protrusion 253 of each corresponding connection part 252 can always be secured.

Fourth Embodiment

Figure 14A:
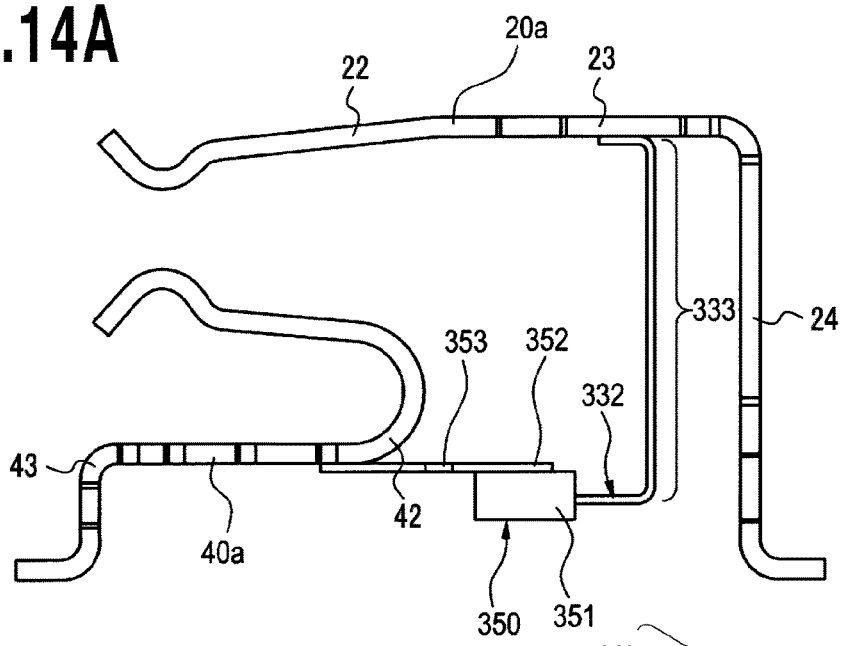
FIG. 14A is a side view of a receptacle connector according to a fourth embodiment of the present invention, which illustrates a state where a conductive member is in physical contact with ground contacts.
Figure 14B:
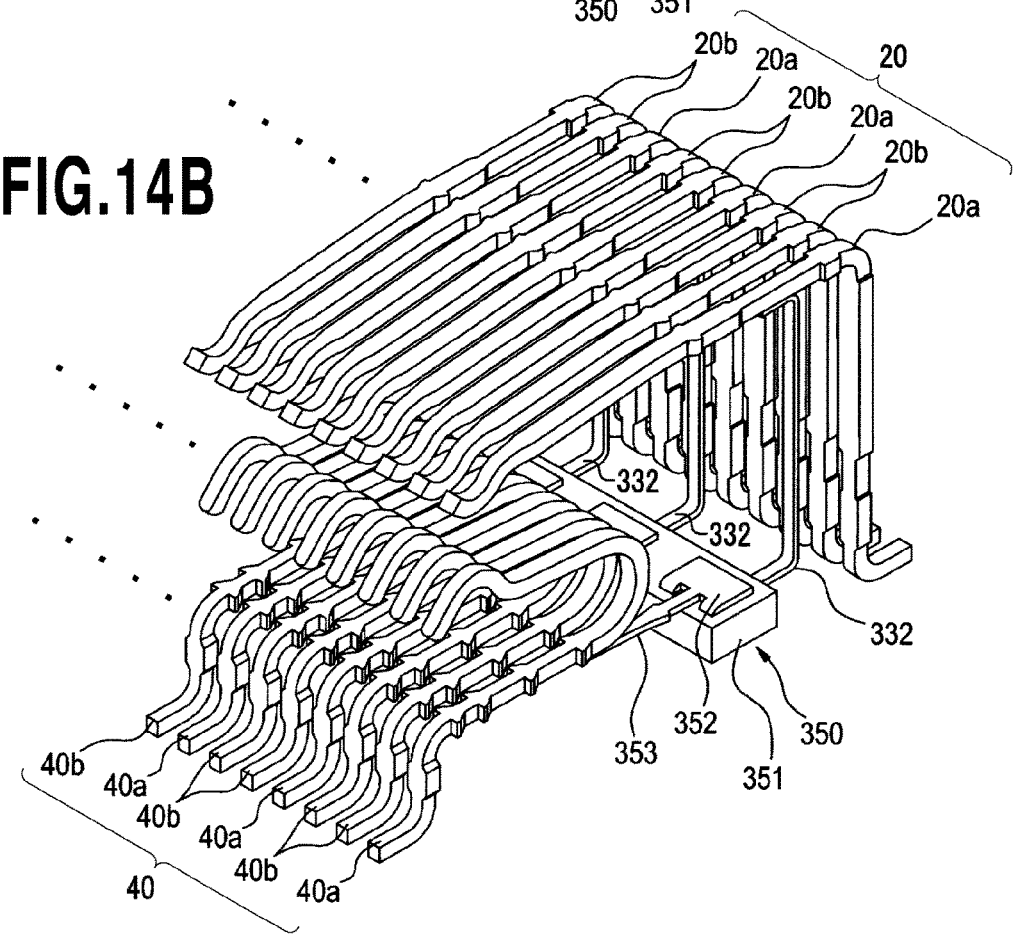
FIG. 14B is a perspective view of the receptacle connector in FIG. 14A.

Next, a fourth embodiment of the receptacle connector constituting part of the electrical connector according to the present invention will be described with reference to FIG. 14A and FIG. 14B. In FIG. 14A and FIG. 14B, constituents which are the same as those in the example illustrated in FIG. 3 will be denoted by the same reference signs and overlapping descriptions thereof will be omitted. In the meantime, FIG. 14A and FIG. 14B illustrate the plurality of contacts 20 on the first row and the plurality of contacts 40 on the second row in the receptacle connector 10.

As illustrated in FIG. 14A and FIG. 14B, in the fourth embodiment, a second conductive member 350 of the receptacle connector 10 includes a conductive resin member 351 made of a conductive resin material, and a plurality of connection parts 332 on a first row and a plurality of connection parts 352 on a second row each made of a metal material.

The plurality of connection parts 332 on the first row project backward from a back side surface of the conductive resin member 351 at positions corresponding to the ground contacts 20*a* among the plurality of contacts 20 on the first row. Each of the connection parts 332 on the first row includes a curved portion 333. The curved portion 333 is formed in such a way that one end fixed to the side surface is bent upward substantially at right angle toward the fixing portion 23 of the ground contact 20*a*, and after the curved portion 333 reaches the neighborhood of the fixing portion 23, the other end thereof is further bent forward substantially at right angle. The other end portion of each curved portion 333 comes into contact with the fixing portion 23 of the corresponding ground contact 20*a* on the first row at the time of assembly.

The plurality of connection parts 352 on the second row (an example of second connection parts) are attached to an upper surface of the conductive resin member 351 at positions corresponding to the plurality of ground contacts 40*a* on the second row. Each of the connection parts 352 on the second row includes a small-width protrusion 353 which protrudes forward and has a gently curved shape. A base end of the protrusion 353 is formed integrally with one end of the corresponding connection part 352 on the second row. Tip end portions of the protrusions 353 respectively come into contact with the plurality of ground contacts 40*a* on the second row at the time of assembly.

According to the above-described configuration, the single conductive resin member 351 is provided with the plurality of connection parts 332 on the first row and the plurality of connection parts 352 on the second row. In this way, the plurality of connection parts 352 on the second row can establish electrical connection to the plurality of ground contacts 40*a* on the second row which are different from the plurality of ground contacts 20*a* on the first row. Thus, the use of the expensive conductive resin material can be reduced while securing the effect to reduce crosstalk between signal lines. As a consequence, it is possible to achieve cost reduction of the receptacle connector.

Here, at least any of the plurality of connection parts 332 on the first row and the plurality of connection parts 352 on the second row may be formed from projections, which are made of a conductive resin material and formed integrally with the conductive resin member 351.

Fifth Embodiment

Next, a fifth embodiment of the receptacle connector constituting part of the electrical connector according to the present invention will be described with reference to FIG. 15 and FIG. 16.

Figure 15:
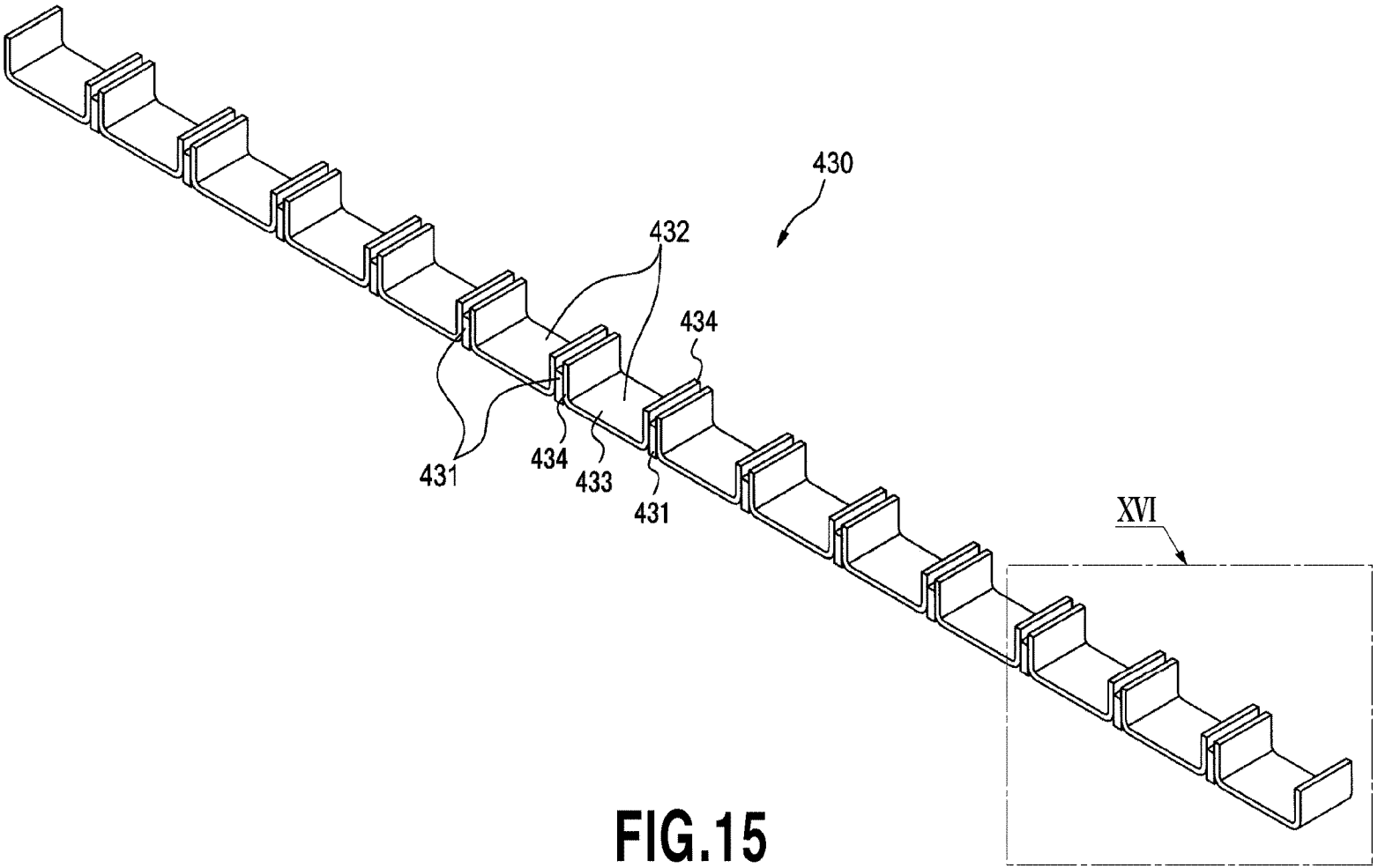
FIG. 15 is a perspective view illustrating a conductive member provided in a receptacle connector according to a fifth embodiment of the present invention.
Figure 16:
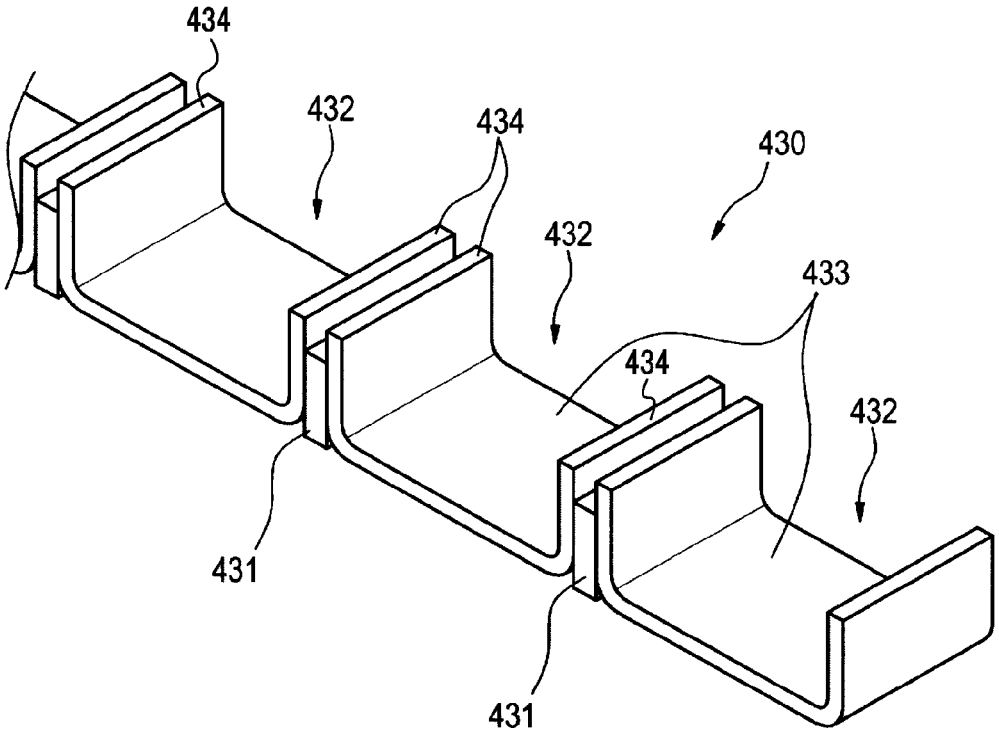
FIG. 16 is an enlarged perspective view illustrating a portion XVI of the conductive member shown in FIG. 15.

As illustrated in FIG. 15 and FIG. 16, in the fifth embodiment, a first conductive member 430 of the receptacle connector 10 includes a plurality of intervening members 431 each made of a conductive resin material, and a plurality of connection parts 432 each made of a metal material.

Each of the plurality of intervening members 431 is provided between every adjacent connection parts 432. Each connection part 432 having a gantry-shaped cross section includes a bottom plate part 433, and a pair of erected parts 434 which are erected upward substantially at right angle from two end portions of the 6 bottom plate part 433. One erected part 434 out of the pair of the erected parts 434 is configured to come into contact with the corresponding one of the plurality of ground contacts 20*a* on the first row, in tandem with one elected part 434 on a closer side out of a pair of erected parts 434 of another connection part 432 that is adjacent via the intervening member 431.

According to the above-described configuration, all the plurality of ground contacts 20*a* can be electrically connected to one another by interposing the small intervening members 431 between the pairs of connection parts 432. Thus, the use of the expensive conductive resin material can be reduced to the minimum while securing the effect to reduce crosstalk between signal lines. As a consequence, it is possible to achieve further cost reduction of the receptacle connector.

Here, the second conductive member corresponding to the plurality of ground contacts 40*a* on the second row may also have the same configuration as the first conductive member 430 of the fifth embodiment.

Sixth Embodiment

Next, a sixth embodiment of the receptacle connector constituting part of the electrical connector according to the present invention will be described with reference to FIG. 17.

Figure 17:
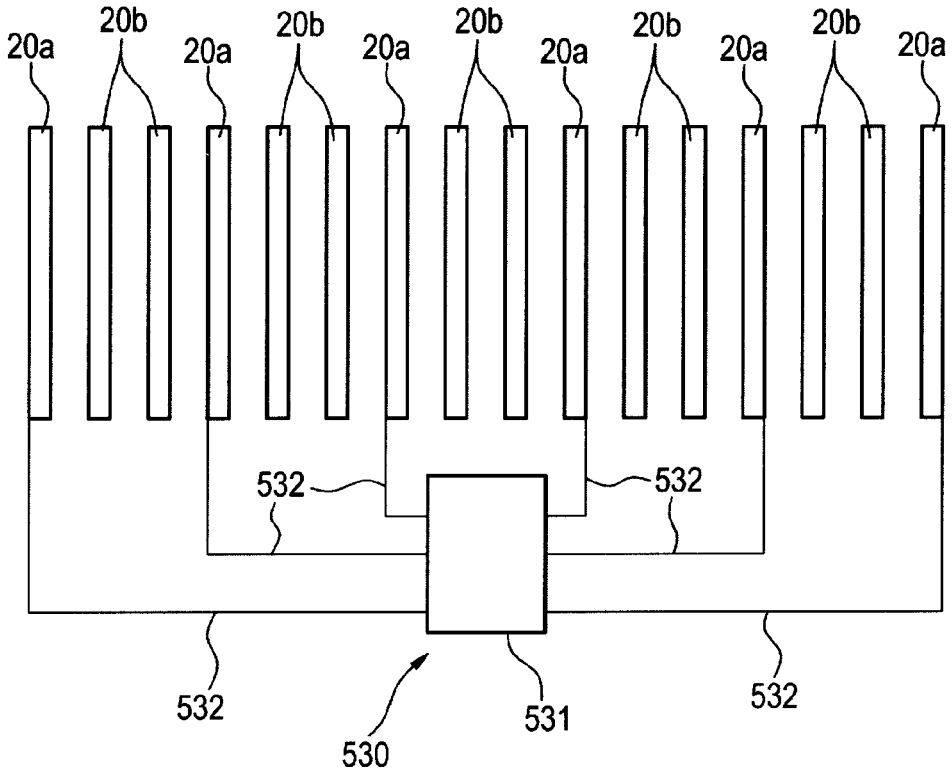
FIG. 17 is a schematic diagram illustrating a state where a conductive member provided in a receptacle connector according to a sixth embodiment of the present invention is in physical contact with ground contacts.

As illustrated in FIG. 17, in the sixth embodiment, a first conductive member 530 of the receptacle connector 10 includes a conductive resin member 531 made of a conductive resin material, and a plurality of connection parts 532 each made of a metal material. Each of the plurality of connection parts 532 is configured such that one end thereof is connected to the single conductive resin member 531 while the other end thereof comes into contact with the corresponding one of the plurality of ground contacts 20*a* on the first row.

According to the above-described configuration, all the plurality of ground contacts 20*a* can be electrically connected to one another by using the single conductive resin member 531. Thus, the use of the expensive conductive resin material can be reduced while securing the effect to reduce crosstalk between signal lines. As a consequence, it is possible to achieve cost reduction of the receptacle connector.

Here, the second conductive member corresponding to the plurality of ground contacts 40*a* on the second row may also have the same configuration as the first conductive member 530 of the sixth embodiment.

Although the present invention has been described above in detail and with reference to specific embodiments, it is obvious to a person skilled in the art that various changes and modifications can be added thereto without departing from the spirit and scope of the present invention. It is to be also understood that the numbers, positions, shapes, and other features of the above-described constituent members are not limited to those described in the embodiments, and can be changed to any other numbers, positions, shapes, and the like which are suitable for embodying the present invention.

For example, the first embodiment to the sixth embodiment described above adopt the configuration in which the plurality of connection parts 32, 132, 232, 332, 432, and 532 are brought into physical contact with the corresponding ground contacts 20*a*. However, the present invention is not limited to these examples. For instance, the plurality of connection parts 32, 132, 232, 332, 432, and 532 may be disposed at such positions with given clearances away from the corresponding ground contacts 20*a*. If the plurality of connection parts 32, 132, 232, 332, 432, and 532 are in physical contact with the ground contacts 20*a*, the ground contacts 20*a* are connected to one another by way of a direct current. In this case, there is a risk of causing a problem of electrical interference among the ground contacts 20*a* due to low direct-current resistance. However, the direct current is cut off by providing the given clearances between each of the plurality of connection parts 32, 132, 232, 332, 432, and 532 and the corresponding ground contact 20*a*, so that the ground contacts 20 can be electrically connected to one another only in a high-frequency region.

As described above, the plurality of ground contacts 20*a* among the plurality of contacts 20 on the first row may be electrically connected to one another in the high-frequency region. As a consequence, it is possible to equalize the electric potentials of the plurality of ground contacts 20*a*, and to further reduce the amount of crosstalk while avoiding interference between the contacts in the high-frequency region.

Here, the plurality of connection parts 52, 252, and 352 corresponding to the plurality of ground contacts 40*a* among the plurality of contacts 40 on the second row may also be provided at positions with given clearances away from the plurality of ground contacts 40*a*.

Figure 18:
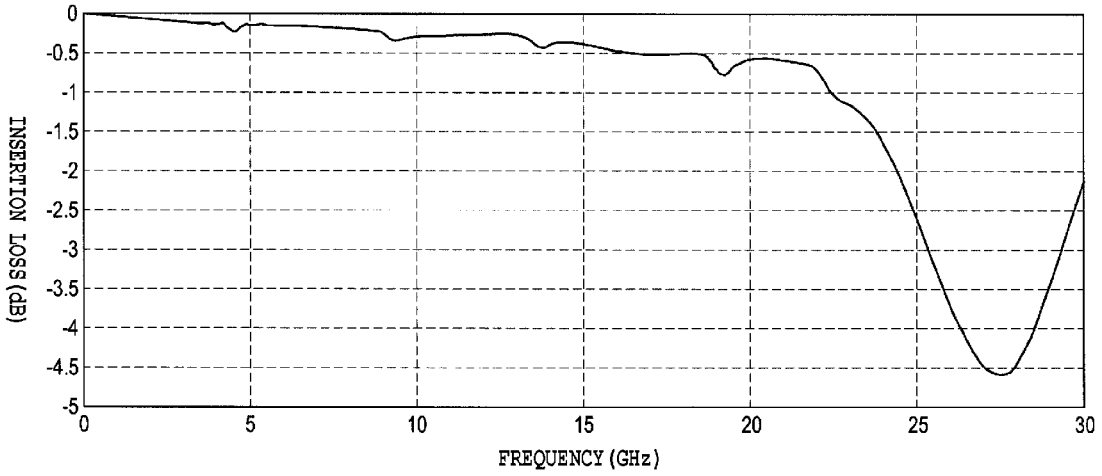
FIG. 18 is a graph illustrating an effect of crosstalk reduction by a conductive resin of an electrical connector according to the present invention.

FIG. 18 illustrates an example of the amount of crosstalk when a signal is transmitted at a high speed in the configuration in which the plurality of connection parts 32 are disposed at the given clearances away from the corresponding ground contacts 20*a* as described above. In a graph of FIG. 18, the horizontal axis indicates the frequency (GHz) while the vertical axis indicates insertion loss (dB). The clearance between each of the plurality of connection parts 32 and the corresponding ground contact 20*a* is about 0.1 mm in this case.

As illustrated in FIG. 18, in the first embodiment to the sixth embodiment described above, the connection parts 32, 132, 232, 332, 432, and 532 of the first conductive members 30, 130, 230, 330, 430, and 530 are each made of a metal material. Accordingly, each ground contact 20*a* and the corresponding one of the connection parts 32, 132, 232, 332, 432, and 532 have strong electrical coupling even when the given clearance is provided therebetween. This makes it possible to reduce ripples to the extent that does not cause any problem from a practical point of view.

In addition, the plug-side conductive member 85 provided to the plug connector 80 may also have the same configuration as any of the first conductive members 30, 130, 230, 330, 430, and 530 of the receptacle connectors described above in the first to sixth embodiments. For example, as with the first conductive member 30 of the receptacle connector 10 described above in the first embodiment, the plug-side conductive member 85 may include a plurality of conductive resin members each made of a conductive resin material, and a plurality of plug-side connection parts each made of a metal material and designed to be inserted respectively into the plurality of openings provided in the plug-side conductive resin members. In this configuration, each plug-side connection part may be configured to come into physical contact with the corresponding ground external contact point when the plug-side conductive member and the plug connector 80 are assembled together, so that a height position of the plug-side connection part can be adjusted.

This configuration makes it possible to prevent the reduction in shield effect attributed to ground conductive wires in the two connector regions of the receptacle connector 10 and the plug connector 80. Accordingly, the configuration can further suppress the amount of crosstalk.

In addition, the above-described embodiments have the configuration in which the first-row contact set C1 is formed by integrating the plurality of contacts 20 on the first row with the support portion 35 by the insert-molding, and then the first-row contact set C1 thus formed is inserted into the second accommodating space 18 of the housing 11. However, the present invention is not limited to this example. For instance, another configuration may be adopted in which: each of the first slits 14 into which to locate each of the plurality of contacts 20 on the first row is provided with a press-fitting portion; and the plurality of contacts 20 are fixed by holding the plurality of contacts 20 with inner wall surfaces of the press-fitting portions.

Furthermore, in the above-described embodiments, the first-row contact set C1 and the second-row contact set C2 are formed as different assemblies. However, for instance, these assemblies may be formed as a single assembly without limitation to this example. For instance, the first contact set C1 and the second-row contact set C2 may be integrated together by vertical attachment using an adhesive or the like. Alternatively, the plurality of contacts 20 on the first row and the plurality of contacts 40 on the second row may be formed integrally by forming the plurality of contacts 20 on the first row and the plurality of contacts 40 on the second row by the insert-molding in such away that a hollow portion corresponding to the shape of one conductive member is formed in advance. This configuration further integrates the first-row contact set C1 with the second-row contact set C2. Thus, it is possible to facilitate and ensure the assembly work, and to reduce manufacturing (assembling) steps of the receptacle connector at the same time.

Seventh Embodiment

Figure 19:
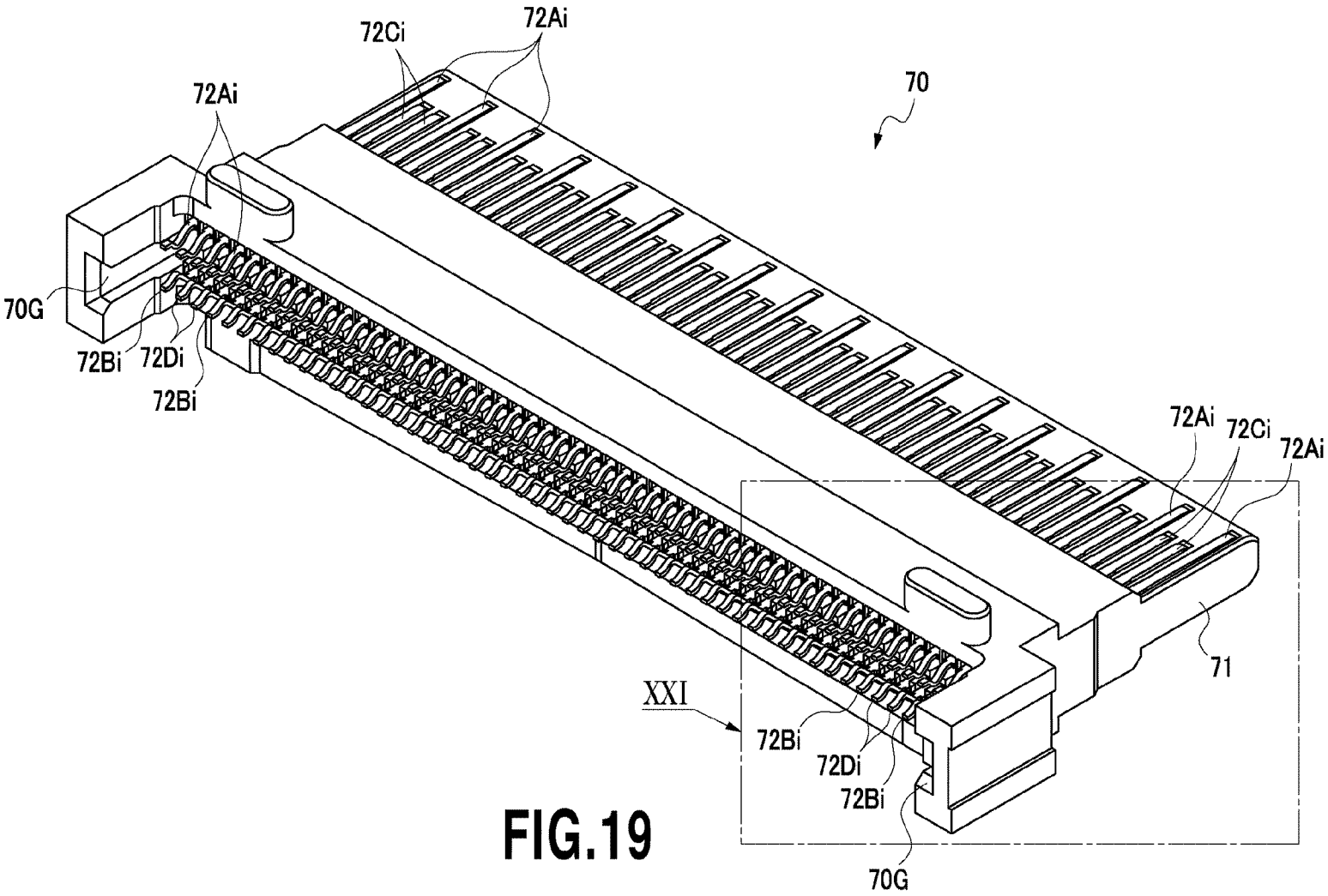
FIG. 19 is a perspective view illustrating external appearance of a plug connector used in a seventh embodiment of the receptacle connector constituting part of the electrical connector according to the present invention.
Figure 20:
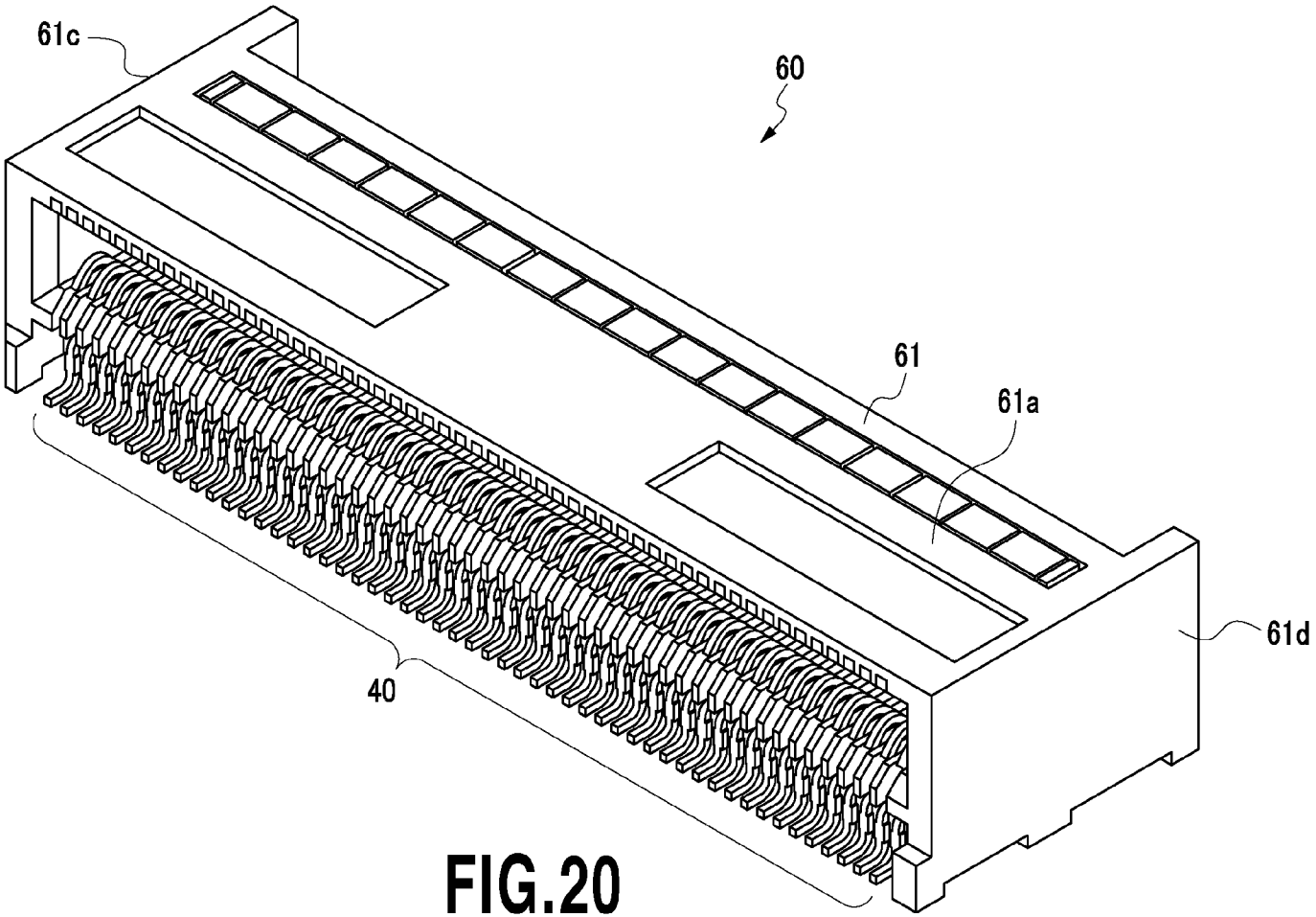
FIG. 20 is a perspective view illustrating the seventh embodiment of the receptacle connector constituting part of the electrical connector according to the present invention.

FIG. 19 illustrates external appearance of another example of the plug connector constituting part of the electrical connector according to the present invention. In addition, FIG. 20 illustrates external appearance of a seventh embodiment of the receptacle connector constituting part of the electrical connector according to the present invention.

Figure 21:
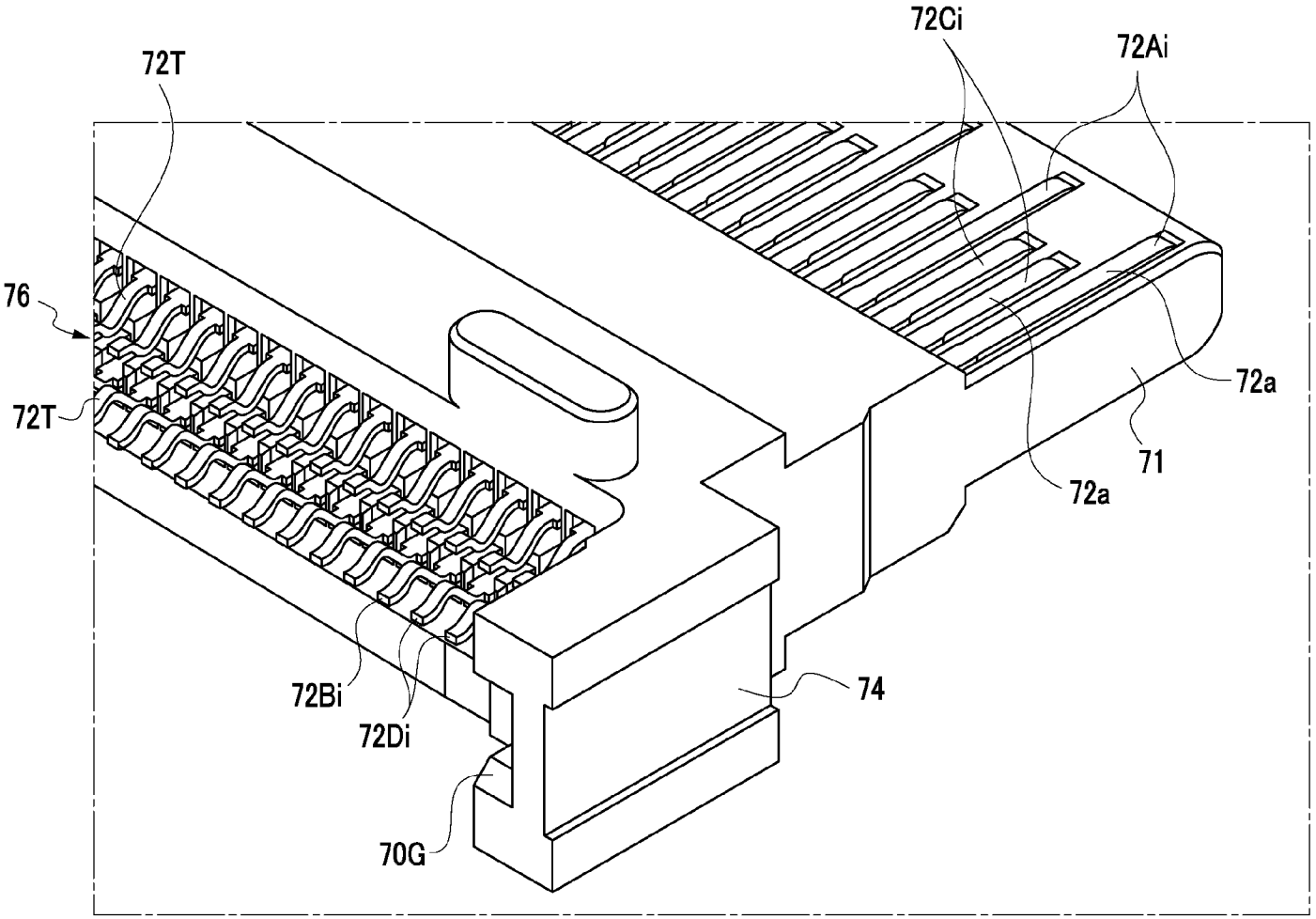
FIG. 21 is an enlarged perspective view illustrating a portion XXI of the plug connector shown in FIG. 19.

In FIG. 19, a plug connector 70 includes a blade 71, and a connection terminal support portion 74 to which one end of the printed wiring board 90 is connected. The blade 71 and the connection terminal support portion 74 are integrally formed by using a resin material. As illustrated in a partially enlarged manner in FIG. 21, upper and lower surfaces of the blade 71 are respectively provided with a plurality of contacts 72Ai and 72Ci as well as a plurality of contacts 72Bi and 72Di (i=1 to 18), each of which is made of a conductive metal thin plate. The contacts 72Ai and the contacts 72Bi provided at given intervals in the right-left direction are provided to face one another. In the meantime, the contacts 72Ci and the contacts 72Di provided at given intervals in the right-left direction are provided to face one another. Two contacts 72Ci are provided between two contacts 72Ai. In addition, two contacts 72Di are provided between two contacts 72Bi. The contacts 72Ai and the contacts 72Bi (i=1 to 18) are respectively connected to ground lines while the contacts 72Ci and the contacts 72Di (i=1 to 34) are respectively connected to signal lines. Moreover, one end portion of each of the contacts 72Ai and the contacts 72Bi is provided with a contact pad, which is to be connected to a contact portion of the corresponding one of the ground contacts 20*a* and 40*a* (see FIG. 30) of a receptacle connector 60 to be described later. Furthermore, one end portion of each of the contacts 72Ci and the contacts 72Di is provided with a contact pad, which is to be connected to a contact portion of the corresponding one of the signal line contacts 20*b* and 40*b* thereof.

Other end portions of the contacts 72Ai and the contacts 72Bi are respectively provided with curved pieces, which have elasticity for jointly sandwiching ground contact pads to be formed on upper and lower surfaces of a connection terminal portion of the above-mentioned printed wiring board 90. In addition, other end portions of the contacts 72Ci and the contacts 72Di are respectively provided with curved pieces 72T, which have elasticity for jointly sandwiching signal line contact pads to be formed on the upper and lower surfaces of the connection terminal portion of the above-mentioned printed wiring board 90 (see FIG. 21 and FIG. 26). Accordingly, it is possible to perform bidirectional signal transmission by means of high-speed transmission between the above-described circuit board PC and the printed wiring board 90.

In this way, if the signal line external contact points and the ground external contact points are denoted by (S) and (G), respectively, then the contact pads of the contacts 72Ai and 72Ci as well as the contact pads of the contacts 72Bi and 72Di are arranged in a G-S-S-G-S-S-G pattern in conformity to the plurality of contacts 20 and 40 of the receptacle connector 60.

Figure 22A:
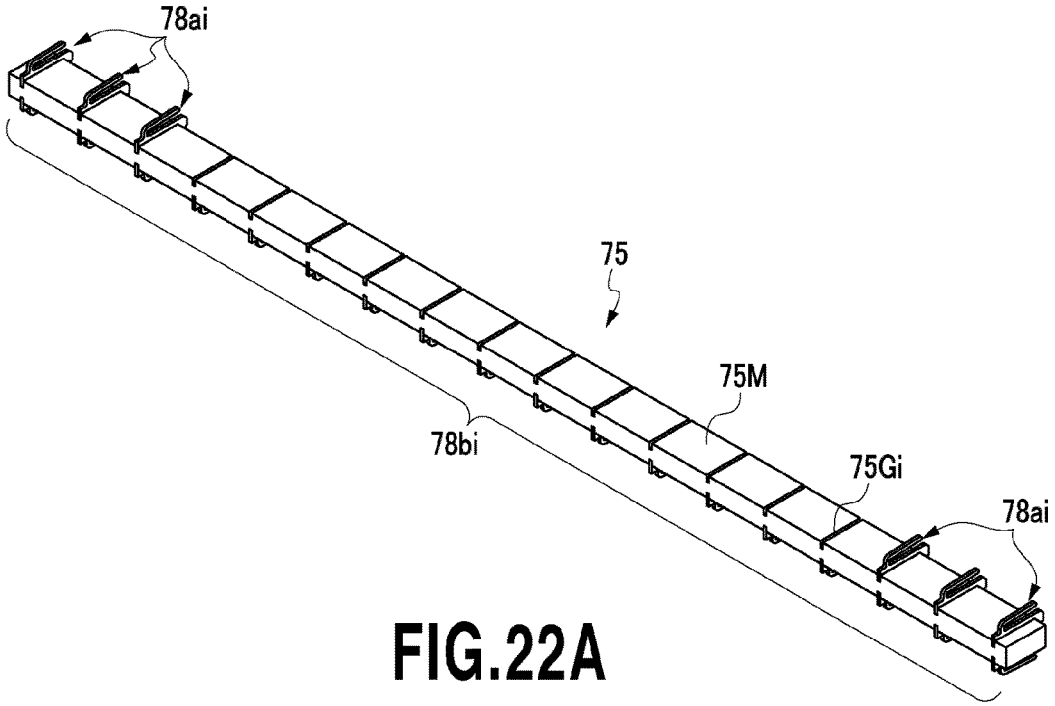
FIG. 22A is a perspective view illustrating a plug-side conductive member used in the example shown in FIG. 19.

A plug-side conductive member 75 of an integrated type as illustrated in FIG. 22A is inserted into a connection terminal accommodating portion 76 of the plug connector 70 designed to receive the connection terminal portion of the printed wiring board 90.

The plug-side conductive member 75 is configured to electrically connect the adjacent pairs of contacts 72Ai and 72Ci to each other so as to equalize the electric potentials of the adjacent pairs of contacts 72Ai and 72Ci. The plug-side conductive member 75 includes a conductive resin member 75M, and contact terminals 78*ai* and 78*bi* (i=1 to 18).

The conductive resin member 75M is made of a conductive resin material having low conductivity that is as low as being adequate for preventing static charges, or in other words, with volume resistivity in a range from about 1 to 10 ohms/cm, for example. The conductive resin member 75M is formed by injection molding into a flat and elongated shape in such away as to extend in the right-left direction. The conductive resin material is a conductive resin material prepared, for example, by blending fine particles or fibers of a conductive material such as carbon or nickel with a synthetic resin material such as LCP (liquid crystal polymer) or PPS (polyphenylene sulfide). Moreover, the conductive resin member 75M. having a rectangular cross section includes grooves 75Gi (i=1 to 18) which are provided on its top surface and bottom surface, respectively, at given intervals corresponding to the intervals of the ground contacts along the direction of arrangement of the contacts 72Ai and the contacts 72Bi. Contact terminals 78*ai* and 78*bi* (i=1 to 18) are respectively inserted into the grooves 75Gi in the top surface and the bottom surface.

Each contact terminal 78*ai* is made of a thin metal sheet material and is formed by press working, for example. The contact terminal 78*ai* includes a fixing portion 77*b* to be inserted into one of the grooves 75Gi, and an elastically deformable movable contact portion 77*a* whose one end is connected to the fixing portion 77*b*. The other end of the movable contact portion 77*a* to come into contact with a fixing portion 72F of the contact 72Ai extends obliquely backward. The fixing portion 77*b* includes a catch part 77*c* which is to be press-fitted into a hole inside the groove 75Gi.

Each contact terminal 78*bi* is made of a thin metal sheet material and is formed by press working, for example. The contact terminal 78*bi* includes a fixing portion 79*b* to be inserted into one of the grooves 75Gi, and an elastically deformable movable contact portion 79*a* whose one end is connected to the fixing portion 79*b*. The other end of the movable contact portion 79*a* to come into contact with a fixing portion 72F of the contact 72Bi extends obliquely in the same direction as the other end of the movable contact portion 77*a*. The fixing portion 79*b* includes a pair of catch parts 79*c* which are provided at a given interval and are to be press-fitted into two holes inside the groove 75Gi. Thus, the plug-side conductive member 75 keeps all the ground contact pads of the plurality of contacts 72Ai and 72Bi at the same electric potential.

Here, the vertically arranged contact terminals 78*ai* and 78*bi* may be or may not be in contact with each other. The inventor has confirmed that there is no difference in transmission characteristic in any of these cases.

Figure 22B:
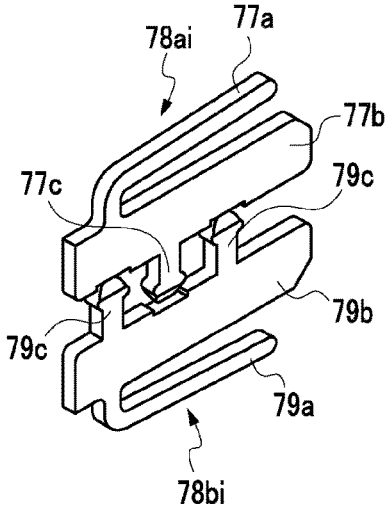
FIG. 22B is a perspective view illustrating a contact terminal used in the plug-side conductive member shown in FIG. 22A.
Figure 23:
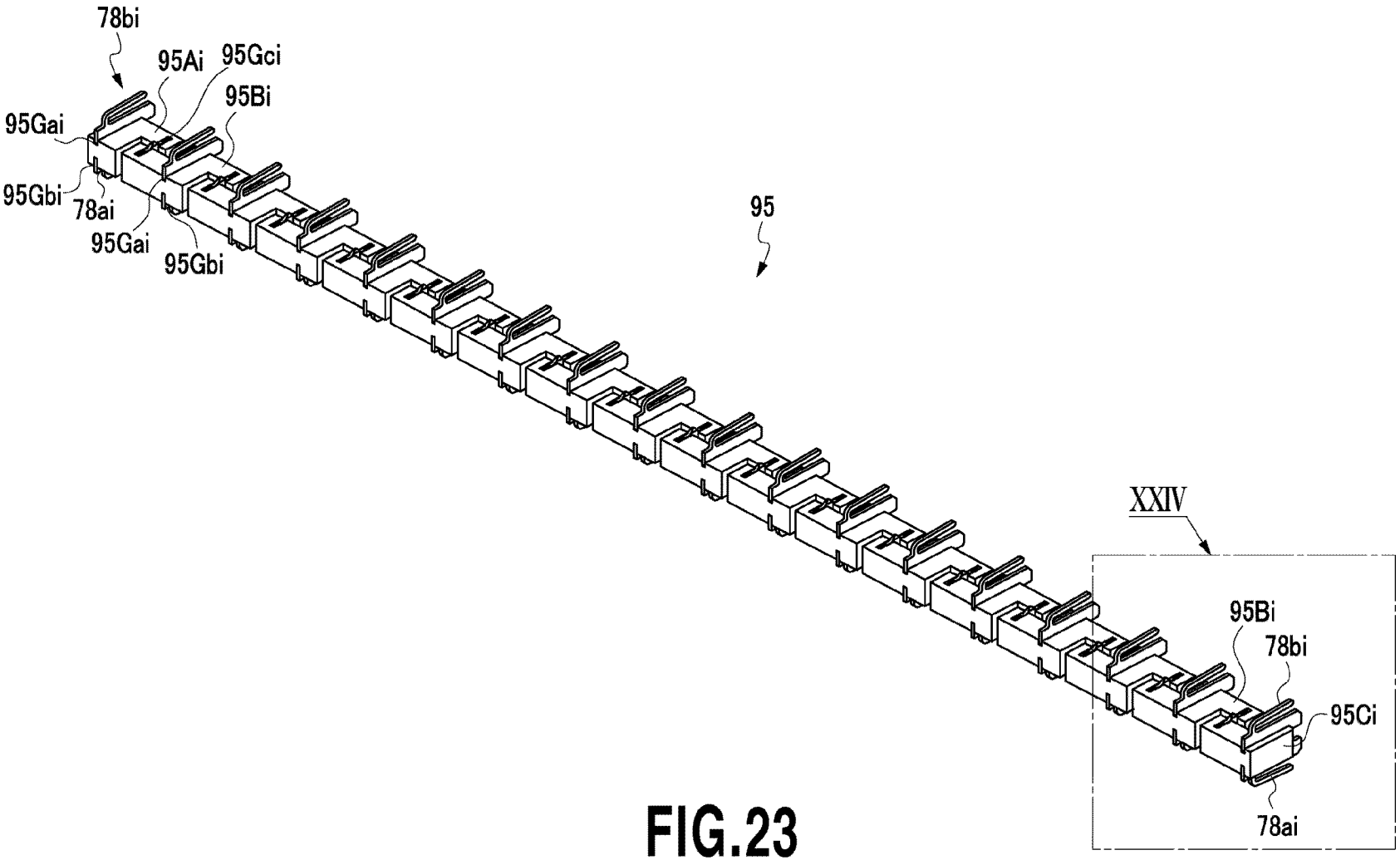
FIG. 23 is a perspective view showing another example of the plug-side conductive member used in the example shown in FIG. 19.

FIG. 23 illustrates another example of the plug-side conductive member used in the plug connector 70. Note that in FIG. 23 as well as FIG. 24 to FIG. 28 to be described later, constituents which are the same as those in FIG. 22A and FIG. 22B will be denoted by the same reference signs and overlapping descriptions thereof will be omitted.

The plug-side conductive member 75 illustrated in FIG. 22A is formed as an integrated type. In contrast, in the example illustrated in FIG. 23, the plug-side conductive member is replaced by a plug-side conductive block unit 95. The plug-side conductive block unit 95 is formed as a separated type, which includes blocks 95Ai and 95Ci constituting two ends, and a plurality of blocks 95Bi having the same shape and designed to join the block 95Ai to the block 95Ci.

Figure 26:
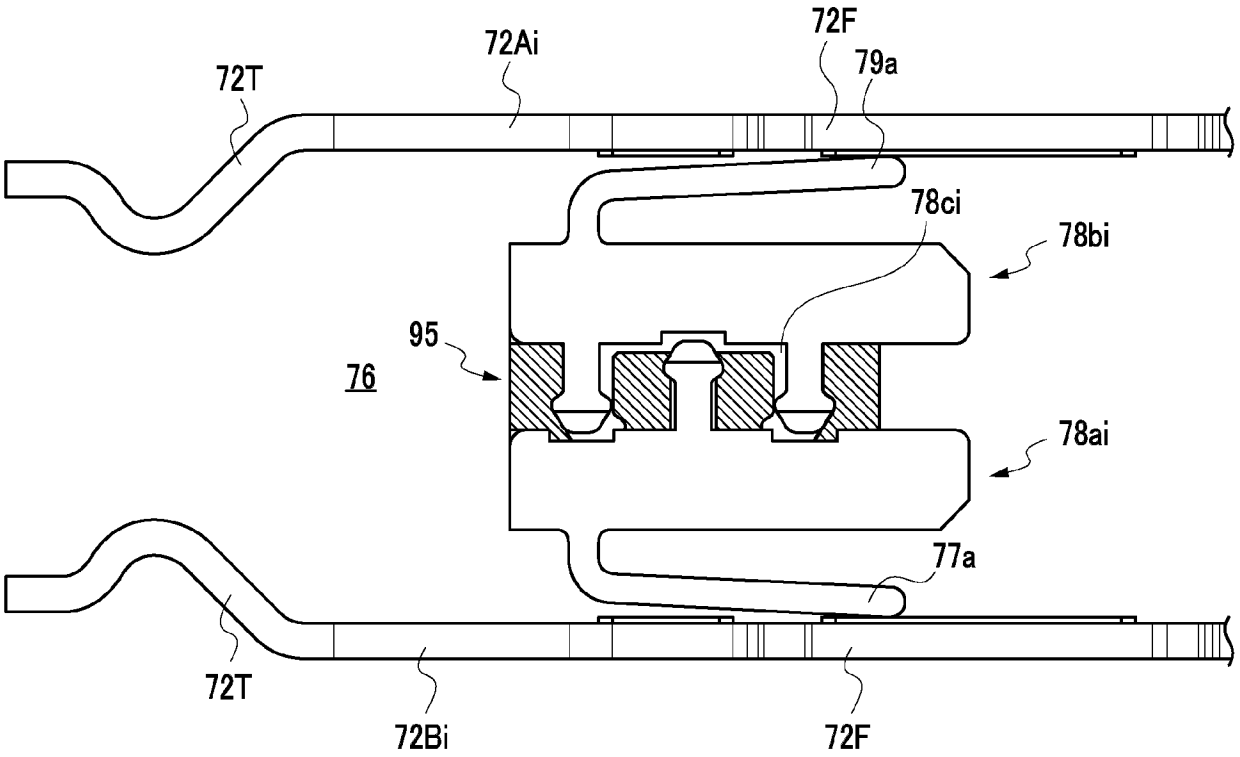
FIG. 26 is a diagram schematically illustrating a state where the plug-side conductive member shown in FIG. 23 is disposed between two contacts.

As illustrated in FIG. 26, the plug-side conductive block unit 95 is located between the plurality of contacts 72Ai and 72Bi inside the connection terminal accommodating portion 76.

In FIG. 23, the block 95Ai constituting the left end of the plug-side conductive block unit 95 is made of the aforementioned conductive resin material and formed into an angular shape having an angle at an upper left corner. The block 95Ai is also provided with grooves 95Gai and 95Gbi respectively in surfaces opposite from each other. Moreover, a groove 95Gci into which one end of a joining piece 78*ci* to be described later is inserted is formed in one side of the block 95Ai.

The block 95Ci constituting the right end of the plug-side conductive block unit 95 is made of the aforementioned conductive resin material and formed into an angular shape having an angle at a lower right corner. The block 95Ci is also provided with grooves 95Gai and 95Gbi respectively in surfaces opposite from each other. Moreover, a groove 95Gci into which one end of the joining piece 78*ci* to be described later is inserted is formed in one side of the block 95Ci.

Figure 24:
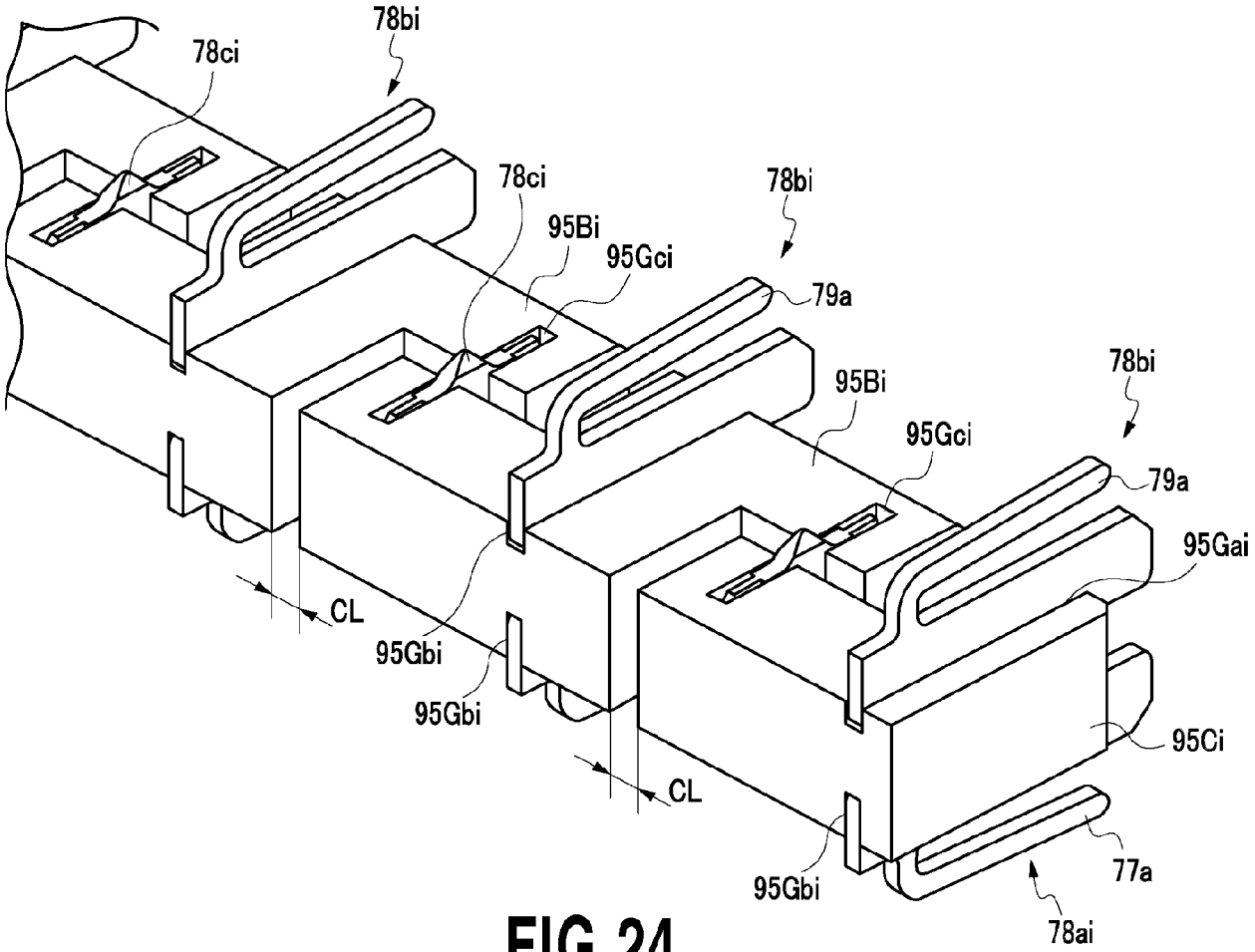
FIG. 24 is an enlarged perspective view illustrating a portion XXIV in the example shown in FIG. 23.
Figure 25:
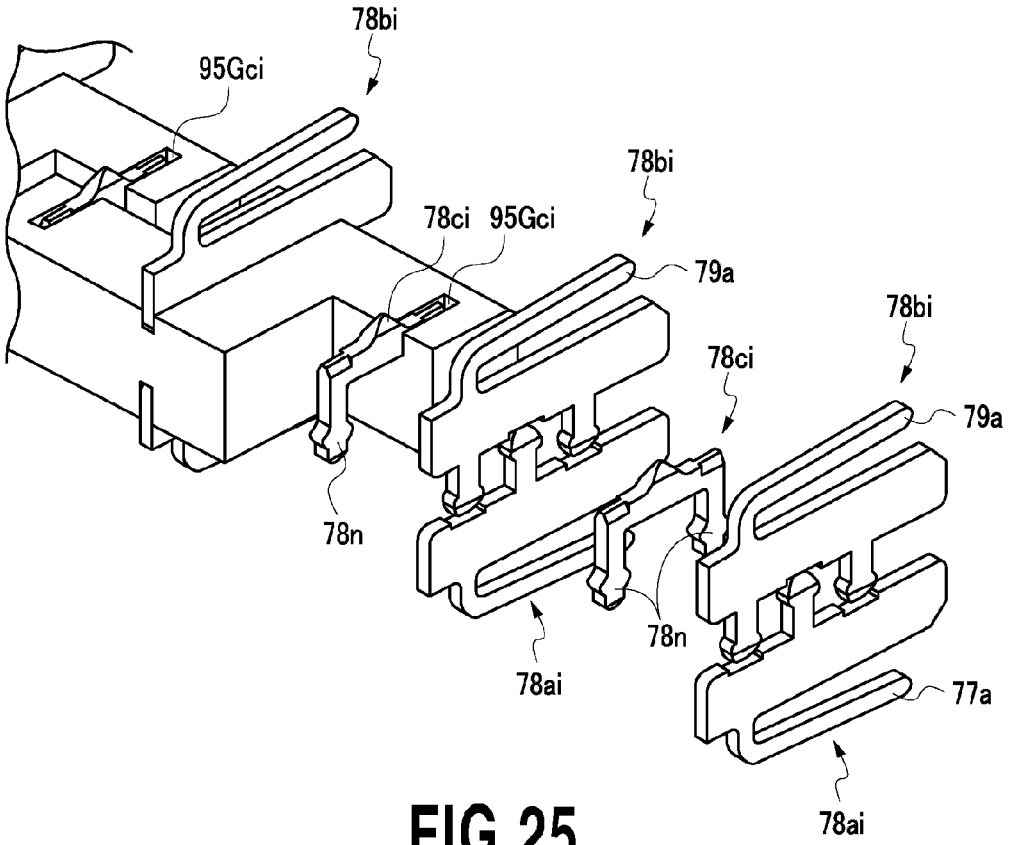
FIG. 25 is an enlarged and exploded perspective view illustrating part in the example shown in FIG. 23.

As illustrated in an enlarged manner in FIG. 24, each block 95Bi is made of the aforementioned conductive resin material and formed into a crank shape having a first side and a second side. The block 95Bi is also provided with grooves 95Gai and 95Gbi respectively at central parts in surfaces in the vertical direction opposite from each other. Moreover, a groove 95Gci into which one end of the metallic joining piece 78*ci* to be described later is inserted is formed in each of the first side and the second side of each block 95Bi.

Each of the blocks 95Ai, 95Bi, and 95Ci having the same width and the same thickness is provided with one contact terminal 78*ai* and one contact terminal 78*bi*. As illustrated in an enlarged manner in FIG. 24, the contact terminal 78*ai* is inserted into the groove 95Gai formed in one surface while the contact terminal 78*bi* is inserted into the groove 95Gbi formed in the other surface.

The block 95Ci is placed such that one of its sides is opposed to the first side of the block 95Bi with a predetermined clearance CL in between. The one side of the block 95Ci and the first side of the block 95Bi are joined to each other by using one of the joining pieces 78*ci*. As illustrated in an enlarged manner in FIG. 25, the joining piece 78*ci* is formed into a staple shape and is provided with a pair of catch parts 78*n*.

The block 95Ai is placed such that one of its sides is opposed to the second side of the block 95Bi with a predetermined clearance CL in between. The one side of the block 95Ai and the second side of the block 95Bi are joined to each other by using another one of the joining pieces 78*ci*.

Between every two adjacent blocks 95Bi, one of the blocks 95Bi is placed such that its first side is opposed to the second side of the other block 95Bi with a predetermined clearance CL in between. The first side of the one block 95Bi and the second side of the other block 95Bi are joined to each other by using another one of the joining pieces 78*ci*.

Thus, the blocks 95Ai, 95Bi, and 95Ci are linearly and continuously joined to one another, thereby forming the plug-side conductive block unit 95 serving as the plug-side conductive member.

Figure 27:
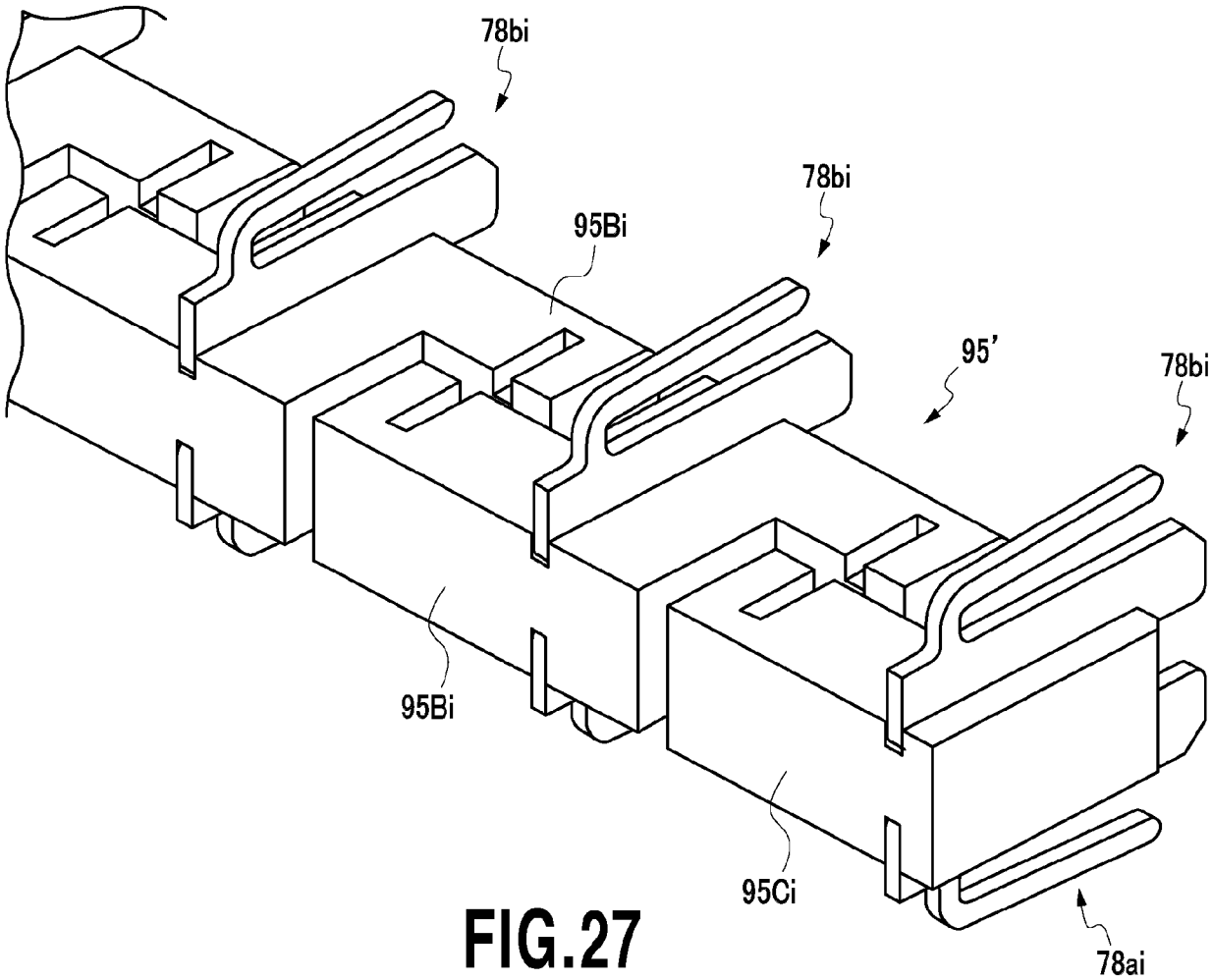
FIG. 27 is an enlarged perspective view illustrating part of a variant example of the example shown in FIG. 23.
Figure 28:
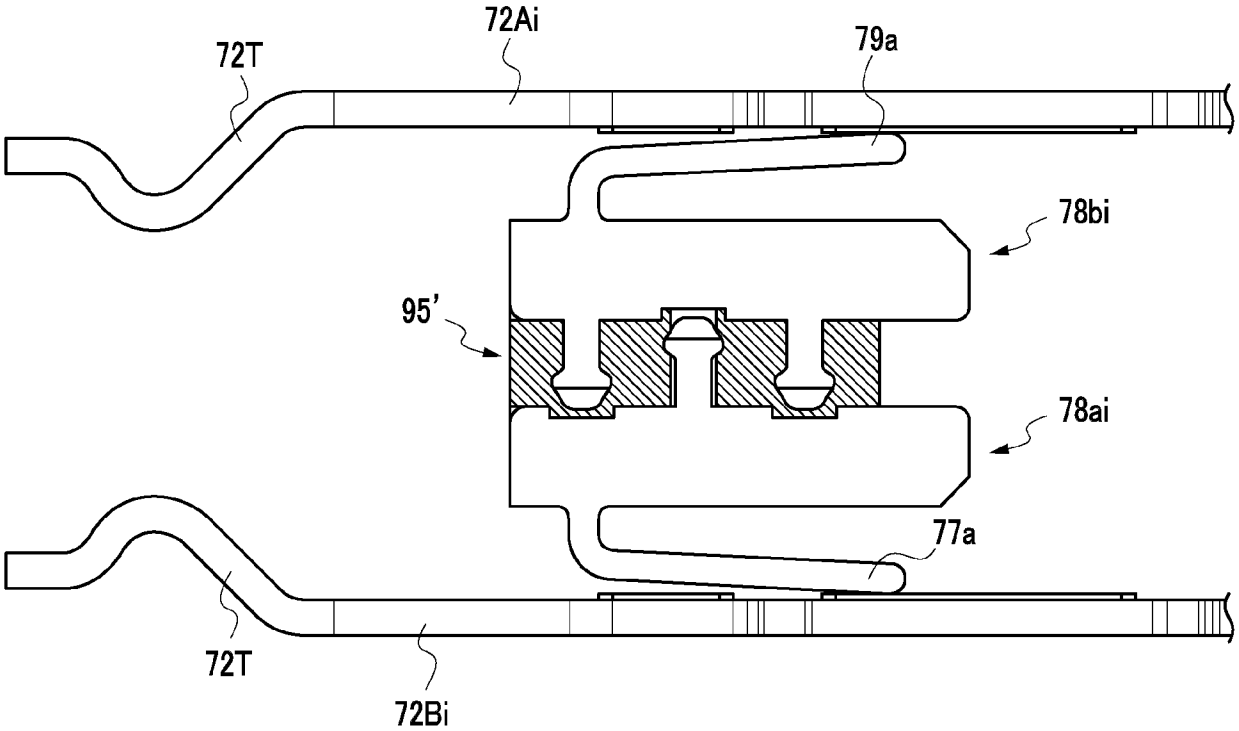
FIG. 28 is a diagram schematically illustrating a state where the example shown in FIG. 27 is disposed between two contacts.

FIG. 27 and FIG. 28 illustrate a variant example of the above-described plug-side conductive block unit 95. In the example illustrated in FIG. 23, the blocks 95Ai, 95Bi, and 95Ci are joined to one another by using the joining pieces 78*ci*. In contrast, in a plug-side conductive block unit 95' illustrated in FIG. 27 and FIG. 28, the blocks 95Ai, 95Bi, and 95Ci constituting the plug-side conductive block unit 95 are disposed with the same layout at the predetermined clearances CL while not being joined to one another by using the joining pieces 78*ci*.

As illustrated in FIG. 28, the plug-side conductive block unit 95' is located between the plurality of contacts 72Ai and 72Bi inside the connection terminal accommodating portion 76.

The inventor of the present application has verified that, even when the plug-side conductive block unit 95' not being joined together by using the joining pieces 78*ci* as in the example of FIG. 27 and FIG. 28 is assembled into the plug connector 70, there seems to be no difference between the transmission characteristic of this plug connector 70 and the transmission characteristic of the plug connector 70 into which the plug-side conductive block unit 95 illustrated in FIG. 23 is assembled.

Figure 29:
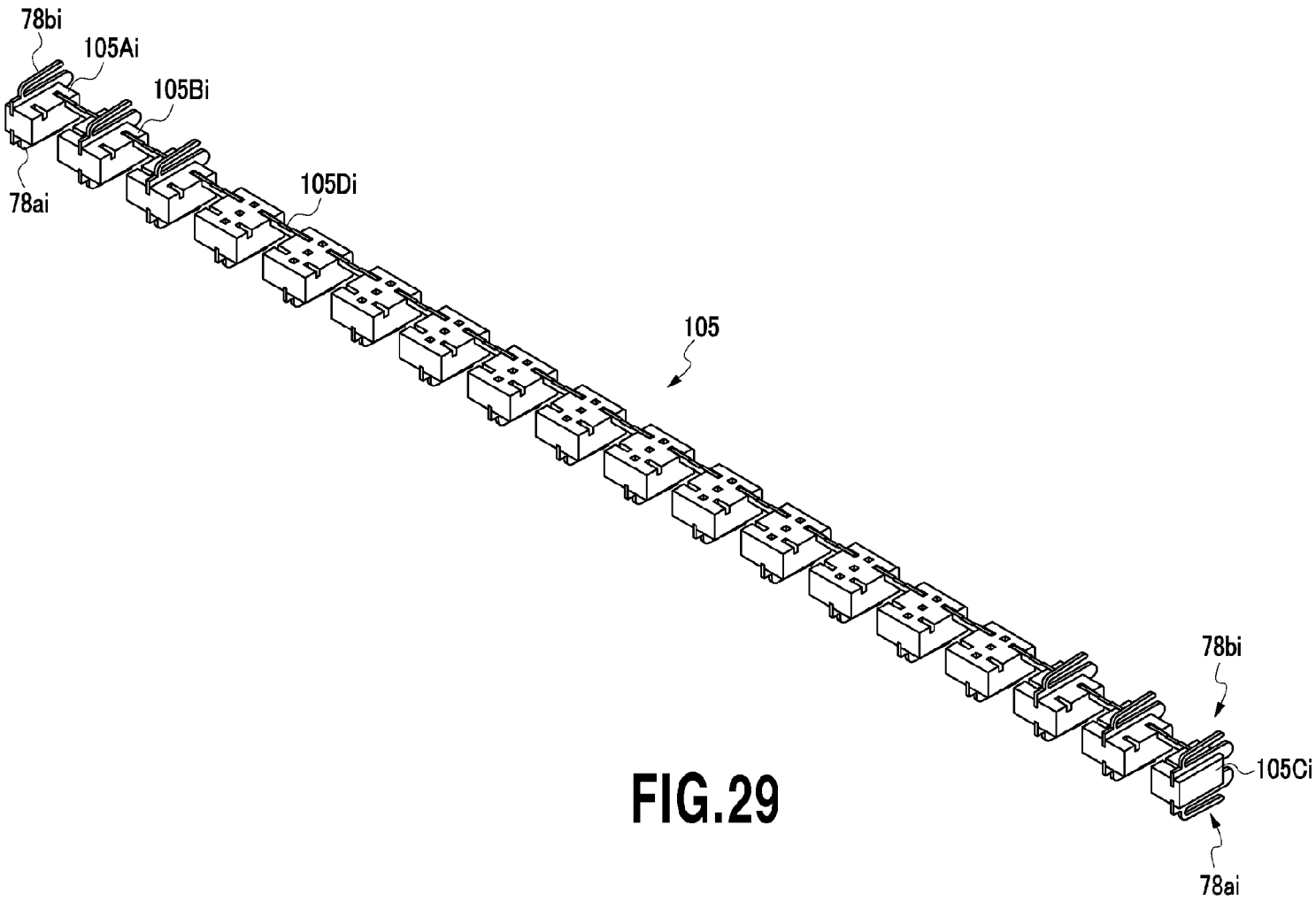
FIG. 29 is a perspective view showing another example of the plug-side conductive member used in the example shown in FIG. 19.

FIG. 29 illustrates another example of the plug-side conductive block unit.

Note that constituents in FIG. 29 which are the same as those in FIG. 23 will be denoted by the same reference signs and overlapping descriptions thereof will be omitted.

A plug-side conductive block unit 105 is formed as a separated type, which includes blocks 105Ai and 105Ci constituting two ends, and a plurality of blocks 105Bi having the same shape and designed to join the block 105Ai to the block 105Ci.

The block 105Ai constituting the left end of the plug-side conductive block unit 105 is made of the aforementioned conductive resin material and formed into a rectangular parallelepiped shape. The block 105Ai is provided with grooves respectively in surfaces opposite from each other, into which one contact terminal 78*ai* and one contact terminal 78*bi* are inserted, respectively. Moreover, the block 105Ai also includes a pair of grooves provided in such a way as to intersect with the aforementioned grooves, into which an end of a joining piece 105Di to be described later is inserted.

The block 105Ci constituting the right end of the plug-side conductive block unit 105 is made of the aforementioned conductive resin material and formed into a rectangular parallelepiped shape. The block 105Ci is provided with grooves respectively in surfaces opposite from each other, into which one contact terminal 78*ai* and one contact terminal 78*bi* are inserted, respectively. Moreover, the block 105Ci also includes a pair of grooves provided in such a way as to intersect with the aforementioned grooves, into which an end of another joining piece 105Di to be described later is inserted.

Each block 105Bi is made of the aforementioned conductive resin material and formed into a rectangular parallelepiped shape. The block 105Bi is provided with grooves respectively at central parts in surfaces opposite from each other, into which one contact terminal 78*ai* and one contact terminal 78*bi* are inserted, respectively. Moreover, the block 105Bi also includes two pairs of grooves provided in such away as to intersect with the aforementioned grooves, into which ends of joining pieces 105Di to be described later are inserted.

Each of the blocks 105Ai, 105Bi, and 105Ci having the same width and the same thickness is provided with one contact terminal 78*ai* and one contact terminal 78*bi*. The contact terminal 78*ai* is inserted into the groove formed in one surface while the contact terminal 78*bi* is inserted into the groove formed in the other surface.

The block 105Ci is placed opposite to the block 105Bi with a predetermined clearance in between. The block 105Ci and its adjacent block 105Bi are joined to each other by using one of the joining pieces 105Di.

The block 105Ai is placed opposite to the block 105Bi with a predetermined clearance in between. The block 105Ai and its adjacent block 105Bi are joined to each other by using another one of the joining pieces 105Di.

Between every two adjacent blocks 105Bi, one of the blocks 105Bi is placed opposite to the other block 105Bi with a predetermined clearance in between. The one block 105Bi and the other block 105Bi are joined to each other by using another one of the joining pieces 105Di.

Thus, the blocks 105Ai, 105Bi, and 105Ci are linearly and continuously joined to one another, thereby forming the plug-side conductive block unit 105 serving as the plug-side conductive member.

Figure 30:
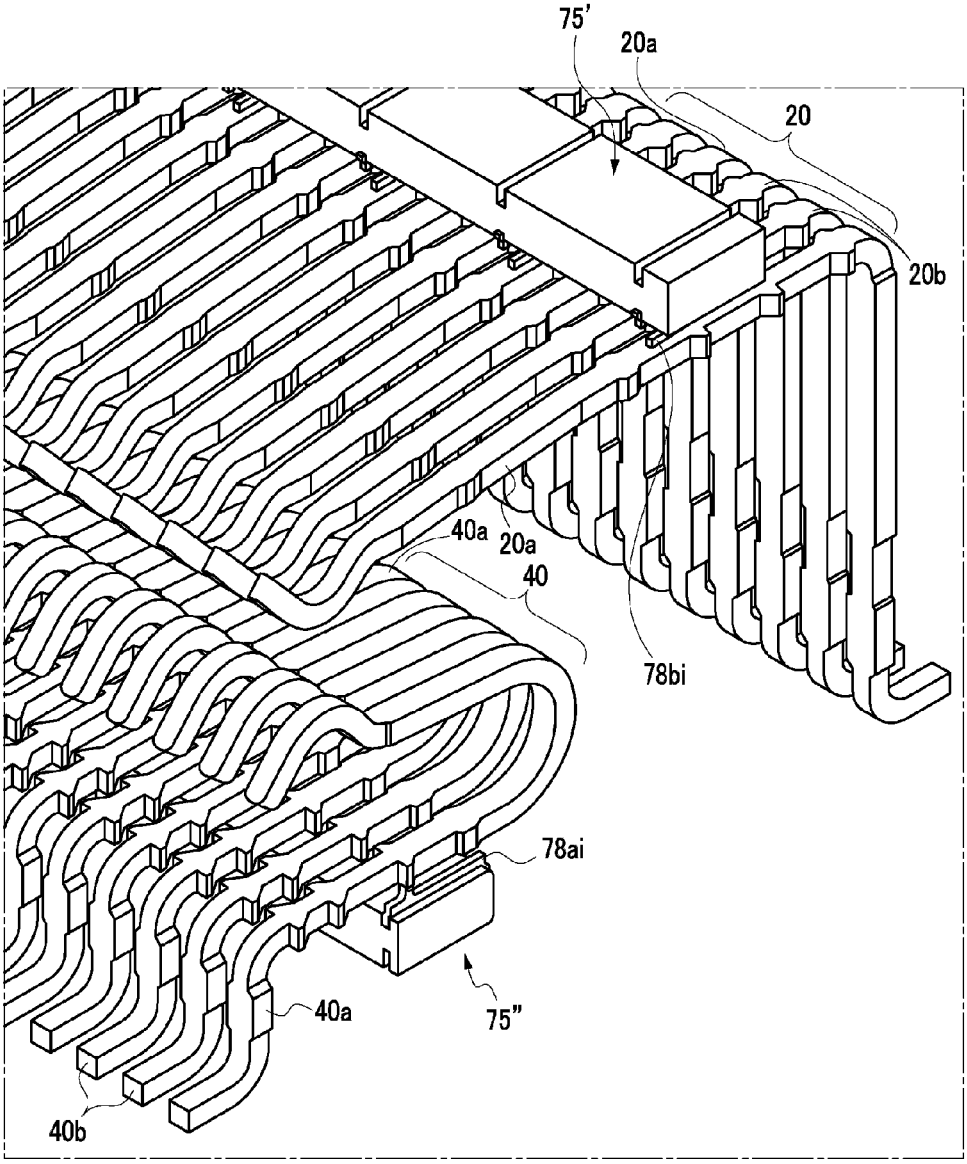
FIG. 30 is a perspective view illustrating conductive members together with array of the plurality of contacts in the seventh embodiment of the receptacle connector shown in FIG. 20.

As illustrated in FIG. 20, the receptacle connector 60 of the seventh embodiment, to which the plug connector 70 provided with the plug-side conductive member 75 of the integrated type described above is detachably attached, includes a housing 61, the plurality of contacts 20 on the first row, the plurality of contacts 40 on the second row, a first conductive member 75', and a second conductive member 75" (see FIG. 30).

The housing 6*l* is made of an electrically insulative synthetic resin material such as LCP (liquid crystal polymer). A profile of the housing 61 has a substantially rectangular parallelepiped shape, and includes an upper wall 61*a*, a lower wall 61*b*, a left side wall 61*c*, and a right side wall 61*d*.

A plurality of first slits for receiving part of the plurality of contacts 20 on the first row, respectively, are provided extending from the front side toward the back side of the housing 61. The first slits are formed at given intervals in a right-left direction of the housing 61. Every adjacent pair of the first slits are partitioned by a partition wall. A plurality of second slits for receiving part of the plurality of contacts 40 on the second row, respectively, and a first accommodating space into which the plug connector 70 is inserted are provided on the front side of the housing 61. The second slits to be formed below the first slits are formed at given intervals in the right-left direction of the housing 61 so as to face the corresponding first slits. Every adjacent pair of the second slits are partitioned by a partition wall. A second accommodating space, which receives the plurality of contacts 20 on the first row and a support portion that fixes and supports the plurality of contacts 20 on the first row, is provided on the back side of the housing 61. A hollow portion, into which the second conductive member 75" is inserted, is provided in the lower wall 61*b* of the housing 61.

The first conductive member 75' and the second conductive member 75" each of the integrated type constituting part of the receptacle connector 60 will be described with reference to FIG. 30 and FIG. 31. Note that in FIG. 30, constituents which are the same as those in FIG. 3, FIG. 22A, and FIG. 22B will be denoted by the same reference signs and overlapping descriptions thereof will be omitted.

The first conductive member 75' provided with the contact terminals 78*bi* and the second conductive member 75" provided with the contact terminals 78*ai* have the same structure except for the contact terminals. Accordingly, the first conductive member 75' will be hereinbelow described while the description of the second conductive member 75" will be omitted.

Figure 31:
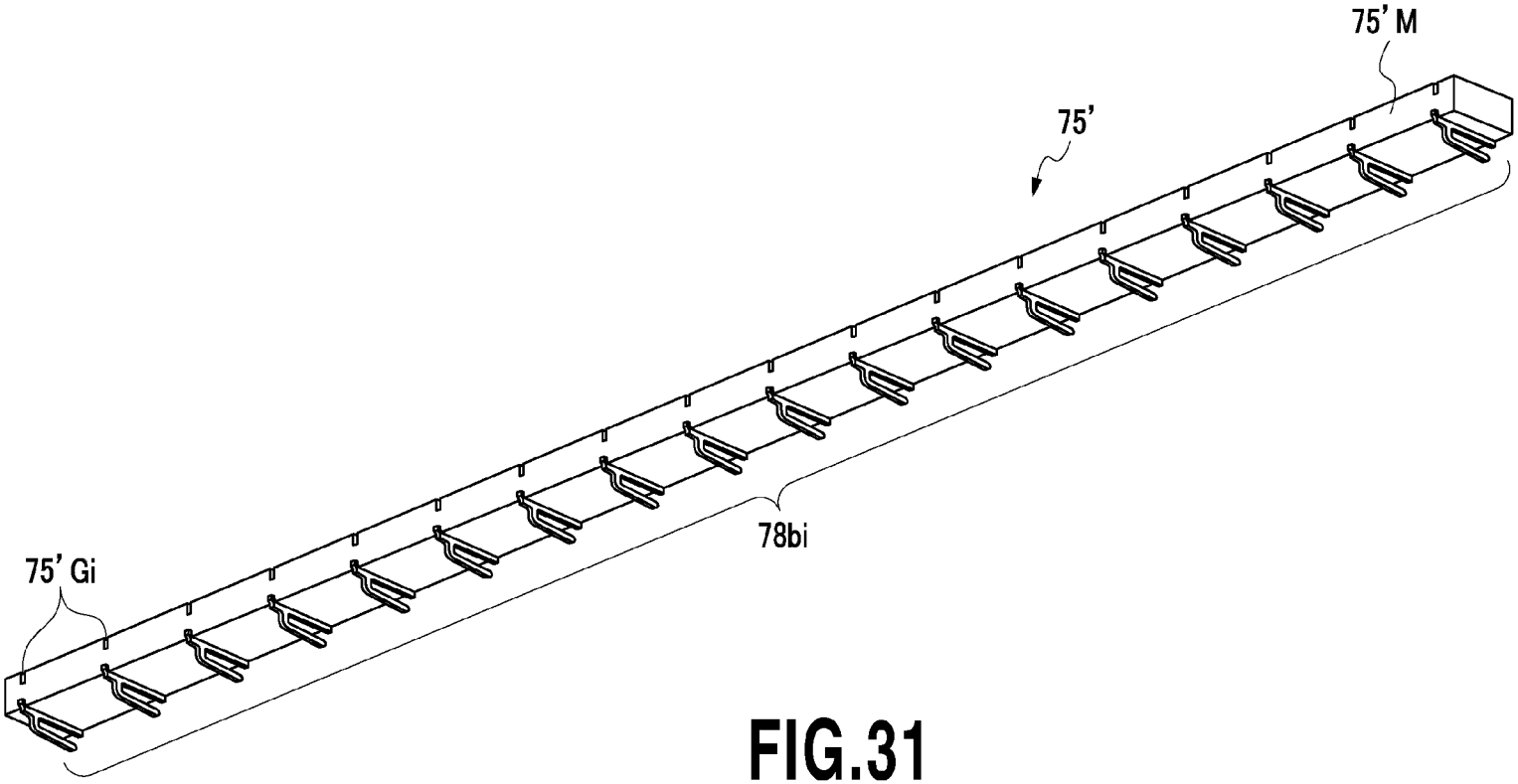
FIG. 31 is a perspective view illustrating a conductive member used in the seventh embodiment of the receptacle connector shown in FIG. 20.

As illustrated in an enlarged manner in FIG. 31, the first conductive member 75' includes a conductive resin member 75'M and the contact terminals 78*bi* (i=1 to 18).

The first conductive resin member 75'M is made of a conductive resin material having low conductivity that is as low as being adequate for preventing static charges, or in other words, with volume resistivity in a range from about 1 to 10 ohms/cm, for example. The conductive resin member 75'M is formed by injection molding into a flat and elongated shape in such a way as to extend in the right-left direction. The conductive resin material is a conductive resin material prepared, for example, by blending fine particles or fibers of a conductive material such as carbon or nickel with a synthetic resin material such as LCP (liquid crystal polymer) or PPS (polyphenylene sulfide). Moreover, the conductive resin member 75'M having a rectangular cross section includes grooves 75'Gi (i=1 to 18) which are provided on its top surface and bottom surface, respectively, at given intervals corresponding to the intervals of the ground contacts along the direction of arrangement of the contacts 20. The contact terminals 78*bi* (i=1 to 18) are respectively inserted into the grooves 75'Gi in the bottom surface.

Figure 32A:
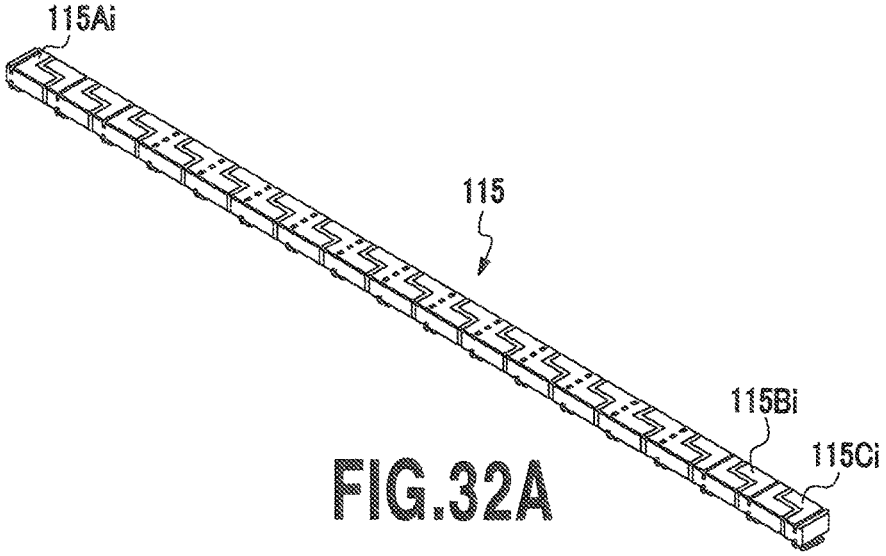
FIG. 32A is a perspective view illustrating another example of the conductive member used in the seventh embodiment of the receptacle connector shown in FIG. 20.

The first conductive member 75' of the integrated type is not limited to this example. For instance, as illustrated in FIG. 32A, the first conductive member may be replaced by a first conductive member 115 having a structure in which a block 115Ai, a plurality of blocks 115Bi, and a block 115Ci are fusion bonded to one another at positions between the contact terminals 78*bi* by using crank-shaped joining pieces 116. Each joining piece 116 is made of an insulative resin material (a plastic) (a non-conductive resin), and is fusion bonded by double molding (two-color molding).

Figure 32B:
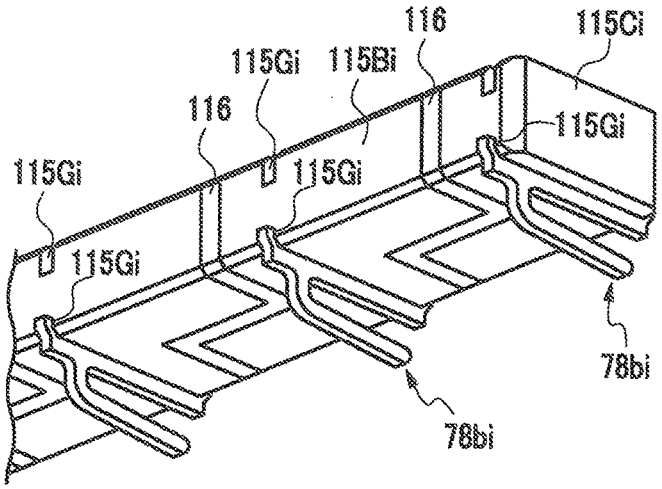
FIG. 32B is an enlarged view illustrating part of the example shown in FIG. 32A.

As illustrated in a partially enlarged manner in FIG. 32B, the block 115Ai constituting the left end of the first conductive member 75' is made of the aforementioned conductive resin material and formed into an angular shape having an angle at a lower left corner. The block 115Ai is also provided with grooves 115Gi respectively in surfaces opposite from each other.

The block 115Ci constituting the right end of the first conductive member 75' is made of the aforementioned conductive resin material and formed into an angular shape having an angle at an upper right corner. The block 115Ci is also provided with grooves 115Gi respectively in surfaces opposite from each other.

As illustrated in an enlarged manner in FIG. 32B, each block 115Bi is made of the aforementioned conductive resin material and formed into a crank shape having a first side and a second side. The block 115Bi is also provided with grooves 115Gi respectively at central parts in surfaces in the vertical direction opposite from each other.

Each of the blocks 115Ai, 115Bi, and 115Ci having the same width and the same thickness is provided with one contact terminal 78*bi*. The contact terminal 78*bi* is inserted into the groove 115Gi formed in the lower surface.

The block 115Ci is placed such that one of its sides is opposed to the first side of the block 115Bi. The one side of the block 115Ci and the first side of the block 115Bi are welded to each other by using a joining piece 116 which is illustrated in an enlarged manner in FIG. 32C.

The block 115Ai is placed such that one of its sides is opposed to the second side of the block 115Bi. The one side of the block 115Ai and the second side of the block 115Bi are welded to each other by using another joining piece 116.

Between every two adjacent blocks 115Bi, one of the blocks 115Bi is placed such that its first side is opposed to the second side of the other block 115Bi. The first side of the one block 115Bi and the second side of the other block 115Bi are welded to each other by using another joining piece 116.

Thus, the blocks 115Ai, 115Bi, and 115Ci are linearly and continuously joined to one another, thereby forming the first conductive member 115. Since each joining piece 116 has the crank shape, the area opposed to the conductive resin is increased whereby the crosstalk is further reduced.

Note that the second conductive member 75" of the integrated type may also have the same structure as that of the above-described first conductive resin member 115 except for the contact terminals.

Note that the inventor of the present application has confirmed that there is no difference in transmission characteristic among the first conductive resin member 115 of the integrated type, the plug-side conductive member 75 of the integrated type, and the plug-side conductive block unit 95 of the separated type.

Figure 33:
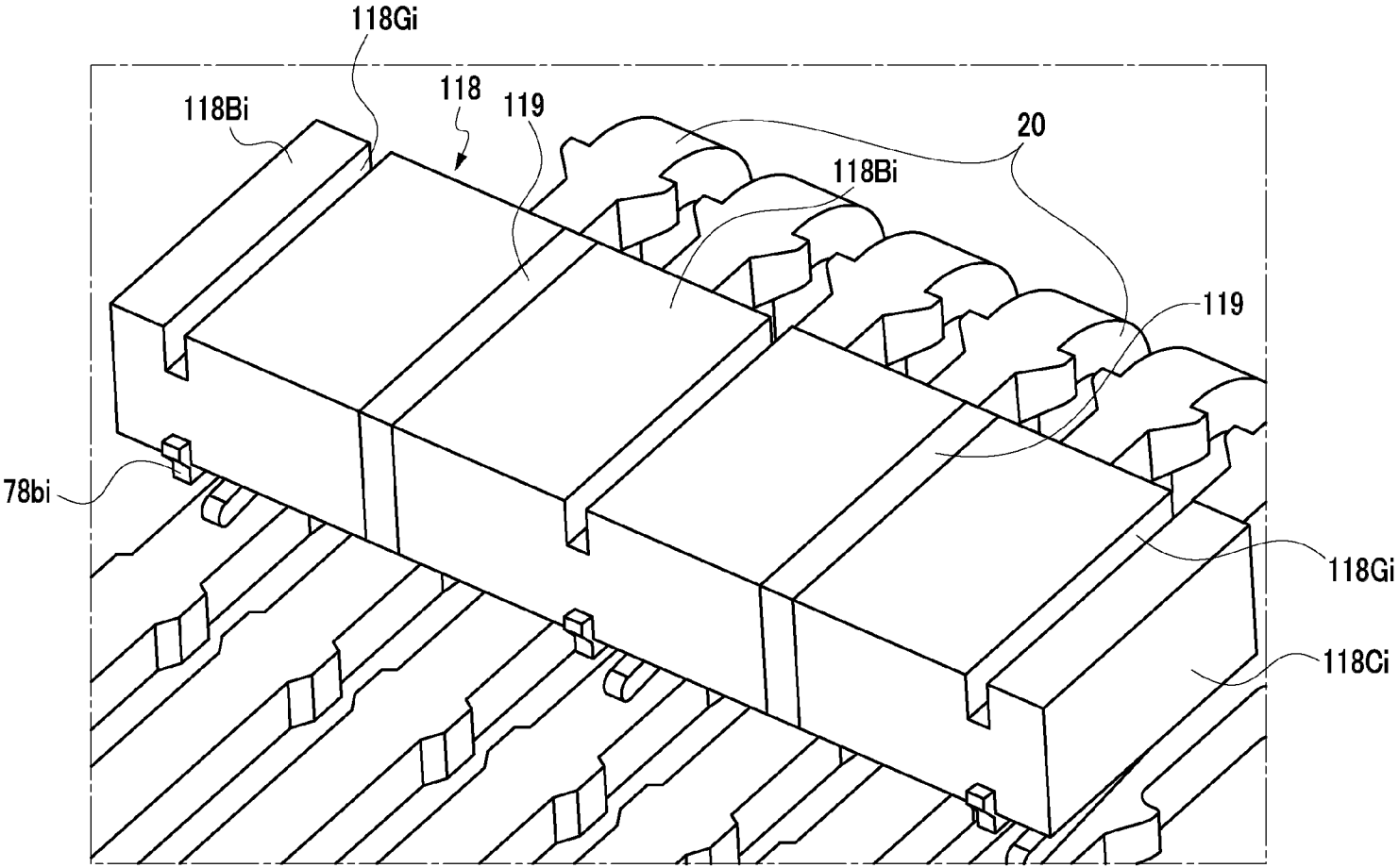
FIG. 33 is a perspective view illustrating yet another example of the conductive member used in the seventh embodiment of the receptacle connector shown in FIG. 20.

FIG. 33 illustrates a first conductive resin member 118 as a variant example of the first conductive resin member 115.

Figure 32C:
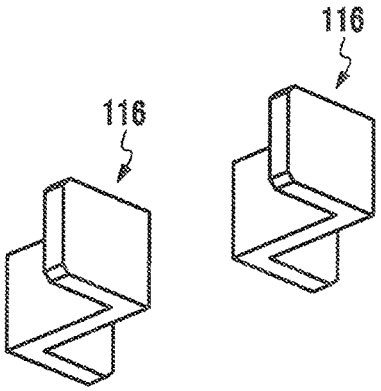
FIG. 32C is a perspective view illustrating joining layers used in the example shown in FIG. 32A.

In the first conductive resin member 118 illustrated in FIG. 33, ends of adjacent rectangular parallelepiped blocks 118Bi opposed to each other may be fusion bonded to each other using a thin plate-shaped joining layer 119 by double molding (two-color molding), for example, instead of using the crank-shaped joining piece 116 illustrated in FIG. 32C.

The first conductive resin member 118 includes a block 118Ci on a right end, a block on a left end which is not illustrated, and a plurality of blocks 118Bi connecting the block 118Ci on the right end to the block on the left end. The block 118Ci on the right end and the not-illustrated block on the left end have the same shape. Each of the block 118Ci and the blocks 118Bi is provided with grooves 118Gi located at end portions in the vertical direction thereof. Each contact terminal 78*bi* is inserted into the groove 118Gi on the lower end of each of the block 118Ci, the blocks 118Bi, and the block on the left end.

Eighth Embodiment

Figure 34:
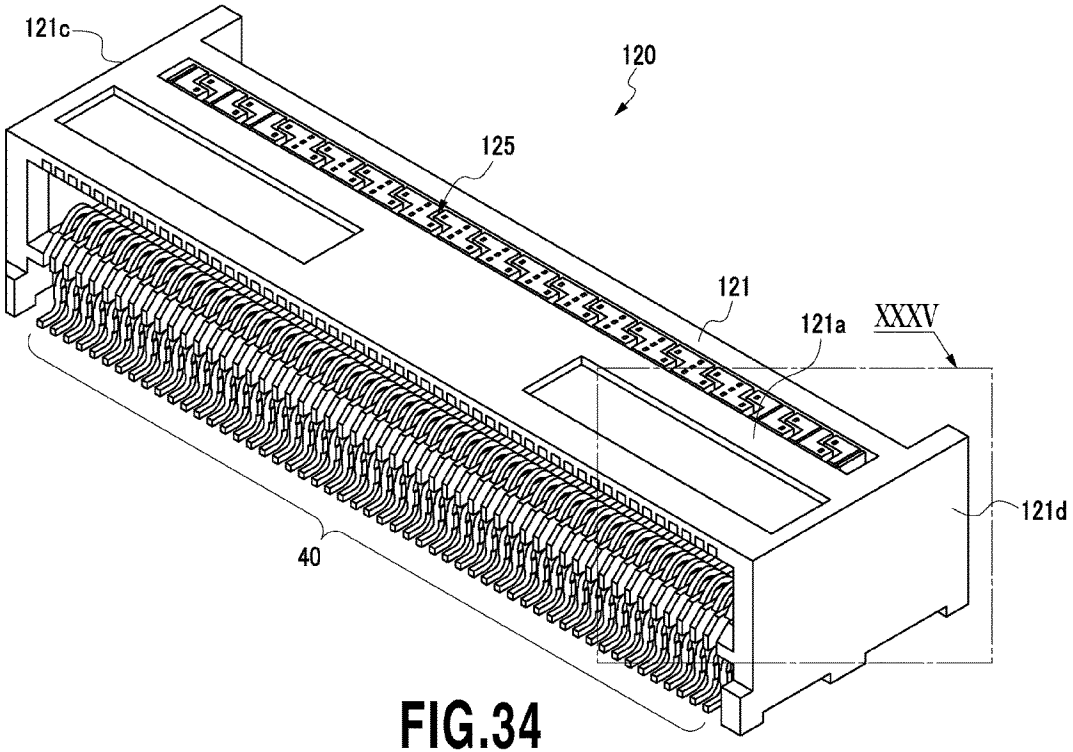
FIG. 34 is a perspective view illustrating external appearance of an eighth embodiment of the receptacle connector constituting part of the electrical connector according to the present invention.

FIG. 34 illustrates external appearance of an eighth embodiment of the receptacle connector constituting part of the electrical connector according to the present invention.

The plug connector 70 (see FIG. 19) including the plug-side conductive block unit 95 illustrated in FIG. 23 is assumed to be detachably connected to the receptacle connector illustrated in FIG. 34. Note that in FIG. 39 and FIG. 40, constituents which are the same as those in FIG. 3 will be denoted by the same reference signs and overlapping description thereof will be omitted.

A receptacle connector 120 includes a housing 121, the plurality of contacts 20 on the first row, the plurality of contacts 40 on the second row, a receptacle-side conductive block unit 125 as the first conductive member, and a receptacle-side conductive block unit (not illustrated) as the second conductive member.

The housing 121 is made of an electrically insulative synthetic resin material such as LCP (liquid crystal polymer). A profile of the housing 121 has a substantially rectangular parallelepiped shape, and includes an upper wall 121*a*, a lower wall 121*b*, a left side wall 121*c*, and a right side wall 121*d*.

A plurality of first slits for accommodating part of the plurality of contacts 20 on the first row, respectively, are provided extending from the front side toward the back side of the housing 121. The first slits are formed at given intervals in a right-left direction of the housing 121. Every adjacent pair of the first slits are partitioned by a partition wall. A plurality of second slits for accommodating part of the plurality of contacts 40 on the second row, respectively, and a first accommodating space into which the plug connector 70 is inserted are provided on the front side of the housing 121. The second slits to be formed below the first slits are formed at given intervals in the right-left direction of the housing 121 so as to face the corresponding first slits. Every adjacent pair of the second slits are partitioned by a partition wall. A second accommodating space, which receives the plurality of contacts 20 on the first row and a support portion that fixes and supports the plurality of contacts 20 on the first row, is provided on the back side of the housing 121. A hollow portion, into which the receptacle-side conductive block unit (not illustrated) as the second conductive member is inserted, is provided in the lower wall 121*b* of the housing 121.

The plurality of first slits are each located on an upper side of the first accommodating space and extend in the front-back direction of the housing 121. The front side of each of the plurality of first slits is opened toward the first accommodating space while the backside thereof is opened toward the second accommodating space. Accordingly, each of the plurality of first slits is designed to connect the first accommodating space to the second accommodating space.

The plurality of second slits provided on the front side of the housing 121 respectively extend in the front-back direction below the first accommodating space, and the front side of each of the plurality of second slits is opened toward the first accommodating space. Each of the plurality of second slits is formed such that the corresponding one of the plurality of contacts 40 on the second row can be inserted from the front side when assembling the receptacle connector 120.

Figure 35:
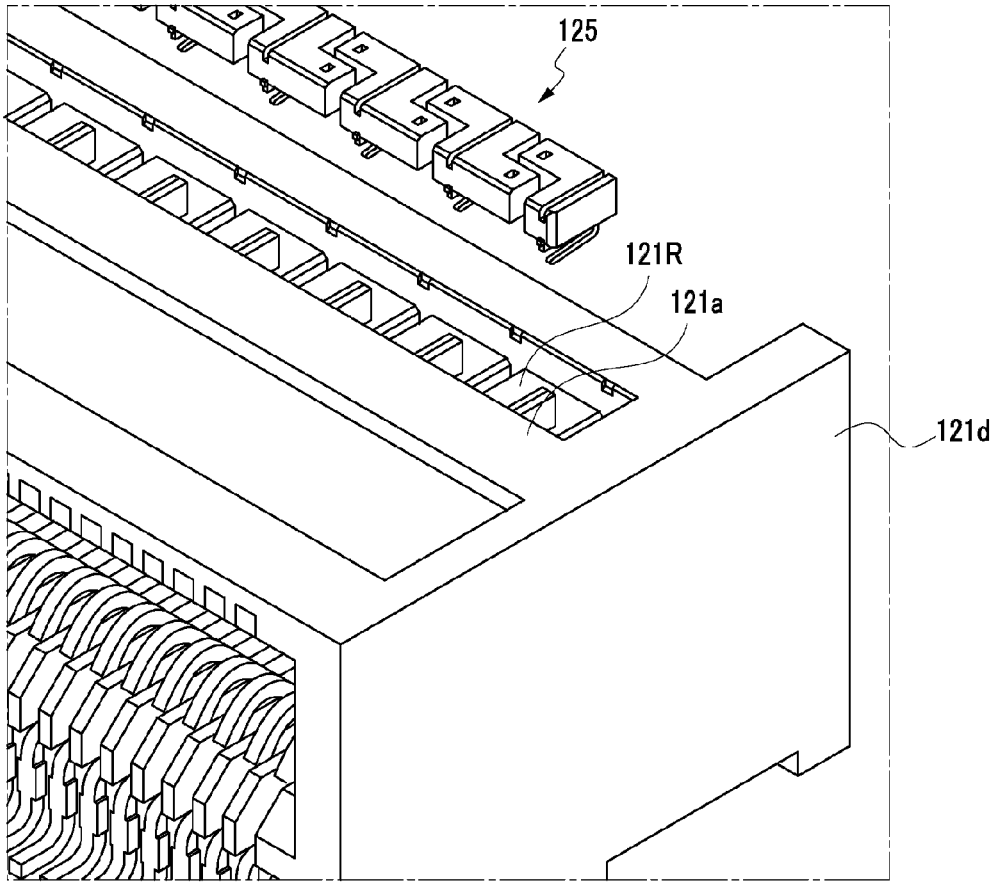
FIG. 35 is an enlarged perspective view illustrating a portion XXXV in the example shown in FIG. 34.

As illustrated in a partially enlarged manner in FIG. 35, a block unit accommodating portion 121R, to which the receptacle-side conductive block unit 125 as the first conductive member to be described later is attached, is formed on a back surface side in the upper wall 121*a* of the housing 121.

The receptacle-side conductive block unit 125 as the first conductive member and the receptacle-side conductive block unit (not illustrated) as the second conductive member have the same structure except for the contact terminals 78*ai* and 78*bi*. Accordingly, the receptacle-side conductive block unit 125 will be hereinbelow described while the description of the receptacle-side conductive block unit as the second conductive member will be omitted. Here, the receptacle-side conductive block unit as the second conductive member is to be provided with the plurality of contact terminals 78*ai* on its upper end surface instead of the plurality of contact terminals 78*bi*.

Figure 36:
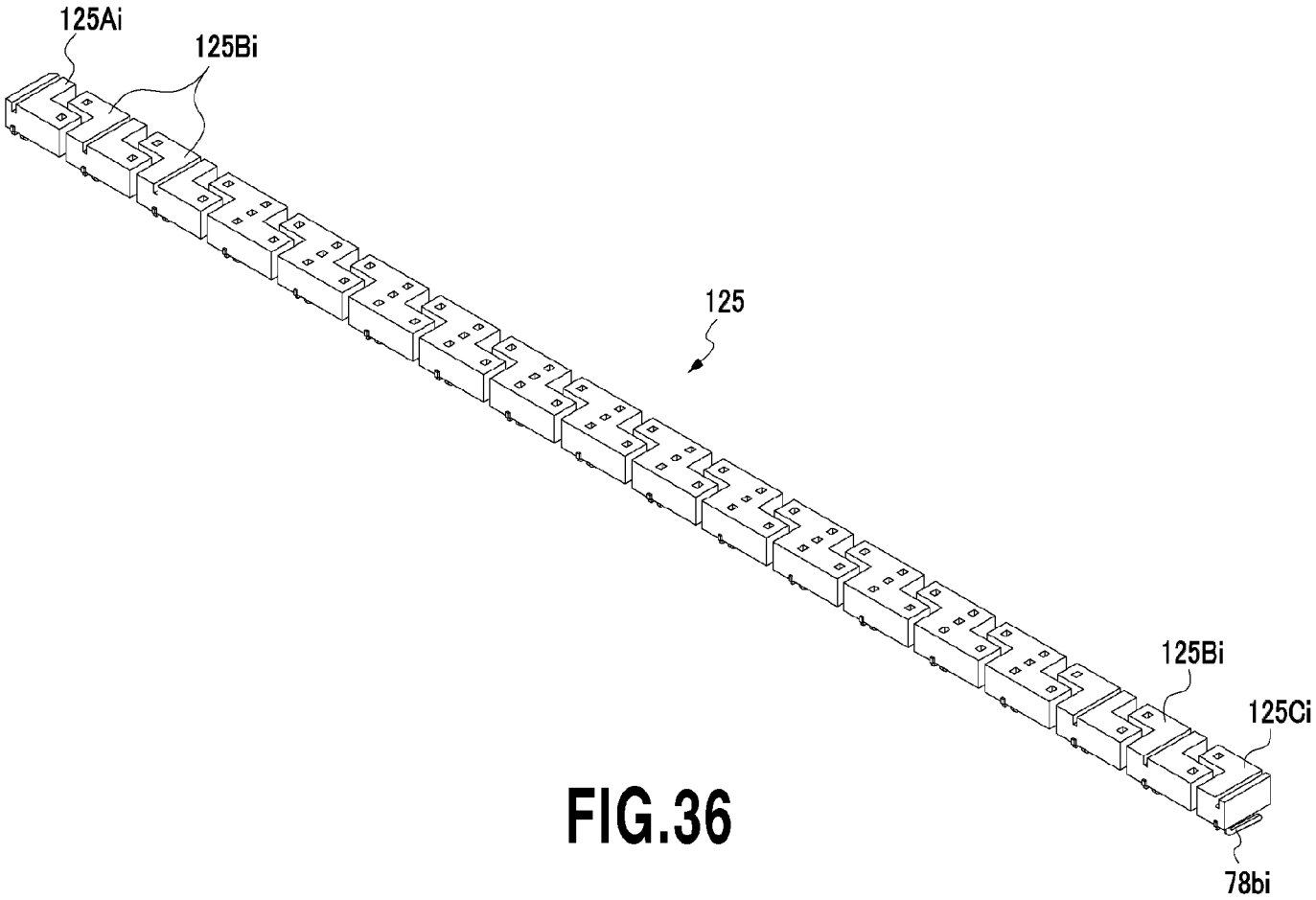
FIG. 36 is a perspective view illustrating a conductive member used in the eighth embodiment of the receptacle connector shown in FIG. 34.

As illustrated in an enlarged manner in FIG. 36, the receptacle-side conductive block unit 125 is formed as a separated type, which includes blocks 125Ai and 125Ci constituting two ends, and a plurality of blocks 125Bi having the same shape and designed to join the block 125Ai to the block 125Ci.

Figure 39:
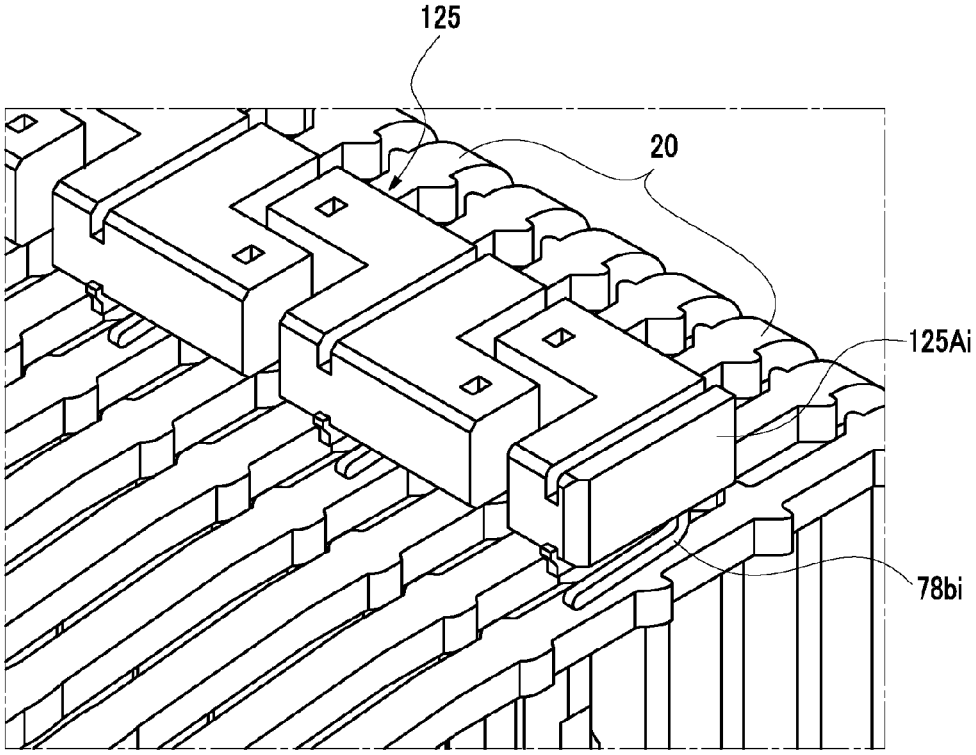
FIG. 39 is a perspective view illustrating a state where the conductive member shown in FIG. 36 is disposed in the eighth embodiment of the receptacle connector shown in FIG. 34.
Figure 40:
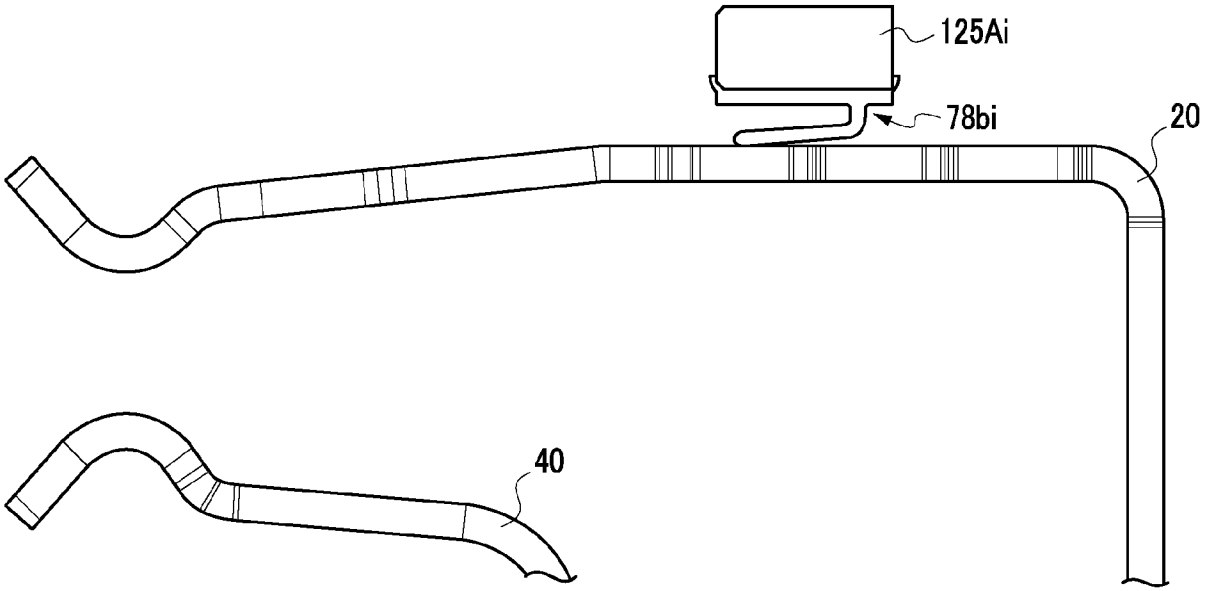
FIG. 40 is a diagram schematically showing the conductive member shown in FIG. 39 in a disposed state together with contacts.

As illustrated in FIG. 39 and FIG. 40, the receptacle-side conductive block unit 125 is disposed inside the above-described block unit accommodating portion 121R located above the plurality of contacts 20.

Figure 37A:
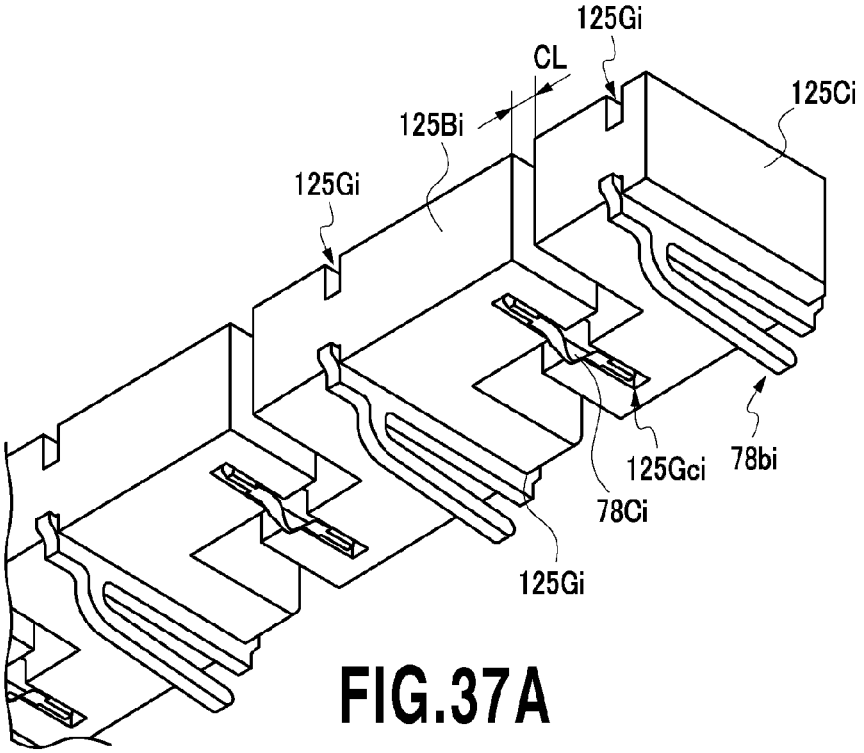
FIG. 37A is an enlarged perspective view illustrating part of the example shown in FIG. 36, which is viewed from a bottom surface.
Figure 37B:
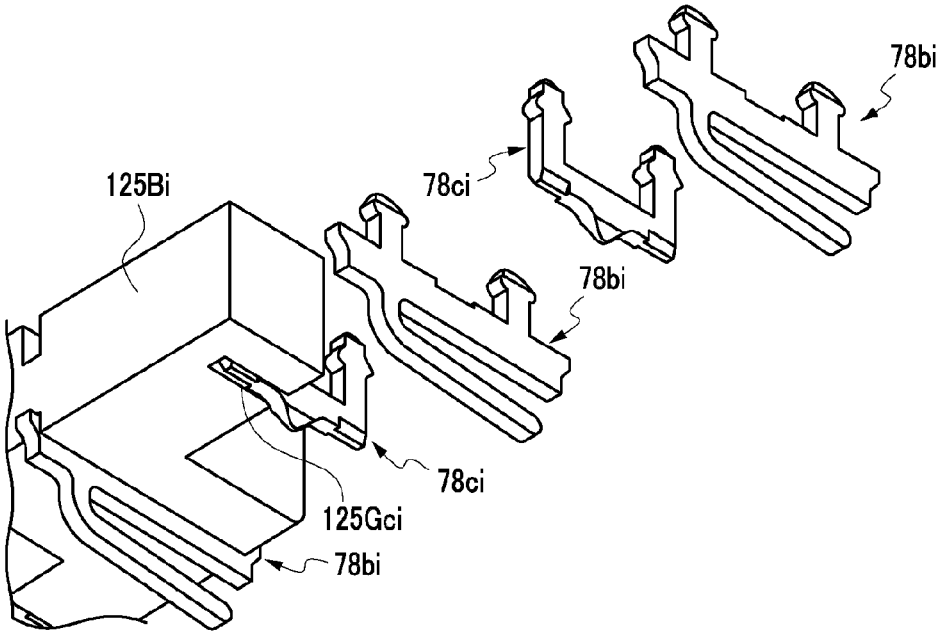
FIG. 37B is an enlarged and exploded perspective view illustrating the example shown in FIG. 36.

In FIG. 36, the block 125Ai constituting the left end of the receptacle-side conductive block unit 125 is made of the aforementioned conductive resin material and formed into an angular shape having an angle at a lower left corner. The block 125Ai is also provided with grooves 125Gi respectively in surfaces opposite from each other. Moreover, a groove 125Gci into which one end of a metallic joining piece 78*ci* to be described later is inserted is formed at a lower part in one side of the block 125Ai as illustrated in FIG. 37A and FIG. 37B.

The block 125Ci constituting the right end of the receptacle-side conductive block unit 125 is made of the aforementioned conductive resin material and formed into an angular shape having an angle at an upper right corner. The block 125Ci is also provided with grooves 125Gi respectively in surfaces opposite from each other. Moreover, as illustrated in an enlarged manner in FIG. 37B, a groove 125Gci into which one end of another metallic joining piece 78*ci* is inserted is formed at a lower part in one side of the block 125Ci.

As illustrated in an enlarged manner in FIG. 36, each block 125Bi is made of the aforementioned conductive resin material and formed into a crank shape having a first side and a second side. The block 125Bi is also provided with grooves 125Gi respectively at central parts in surfaces in the vertical direction opposite from each other. Moreover, a groove 125Gci into which one end of the metallic joining piece 78*ci* is inserted is formed in a lower part of each of the first side and the second side of each block 125Bi.

Each of the blocks 125Ai, 125Bi, and 125Ci having the same width and the same thickness is provided with one contact terminal 78*bi*. As illustrated in an enlarged manner in FIG. 37A, the contact terminal 78*bi* is inserted into the groove 125Gi.

The block 125Ci is placed such that one of its sides is opposed to the first side of the block 125Bi with a predetermined clearance CL in between. The one side of the block 125Ci and the first side of the block 125Bi are joined to each other by using one of the joining pieces 78*ci*. As illustrated in an enlarged manner in FIG. 37B, the joining piece 78*ci* is formed into a staple shape and is provided with a pair of catch parts 78*n*.

The block 125Ai is placed such that one of its sides is opposed to the second side of the block 125Bi with a predetermined clearance CL in between. The one side of the block 125Ai and the second side of the block 125Bi are joined to each other by using another one of the joining pieces 78*ci*.

Between every two adjacent blocks 125Bi, one of the blocks 125Bi is placed such that its first side is opposed to the second side of the other block 125Bi with a predetermined clearance CL in between. The first side of the one block 125Bi and the second side of the other block 125Bi are joined to each other by using another one of the joining pieces 78*ci*.

Thus, the blocks 125Ai, 125Bi, and 125Ci are linearly and continuously joined to one another, thereby forming the receptacle-side conductive block unit 125 serving as the receptacle-side conductive member.

Figure 38:
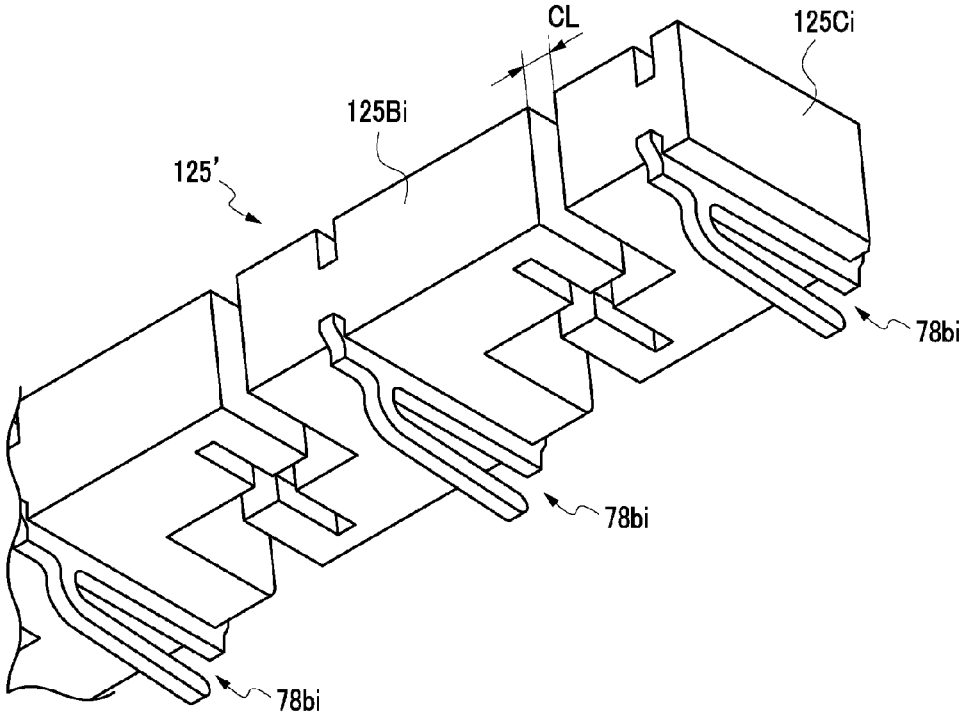
FIG. 38 is a partial perspective view illustrating a variant example of the example shown in FIG. 36.

FIG. 38 illustrates a variant example of the above-described receptacle-side conductive block unit 125. In the example illustrated in FIG. 36, the blocks 125Ai, 125Bi, and 125Ci are joined to one another by using the joining pieces 78*ci*. In contrast, in a receptacle-side conductive block unit 125' illustrated in FIG. 38, the blocks 125Ai, 125Bi, and 125Ci constituting the receptacle-side conductive block unit 125 are disposed with the same layout at the predetermined clearances CL without the plurality of blocks being joined to one another by using the joining pieces 78*ci*.

The inventor of the present application has verified that, even when the receptacle-side conductive block unit 125 in which the blocks are not joined together by using the joining pieces 78*ci* as in the example of FIG. 38 is assembled into the block unit accommodating portion 121R, there seems to be no difference between the transmission characteristic of this receptacle connector 120 and the transmission characteristic of the receptacle connector 120 into which the receptacle-side conductive block unit 125 illustrated in FIG. 36 is assembled.

Figure 41A:
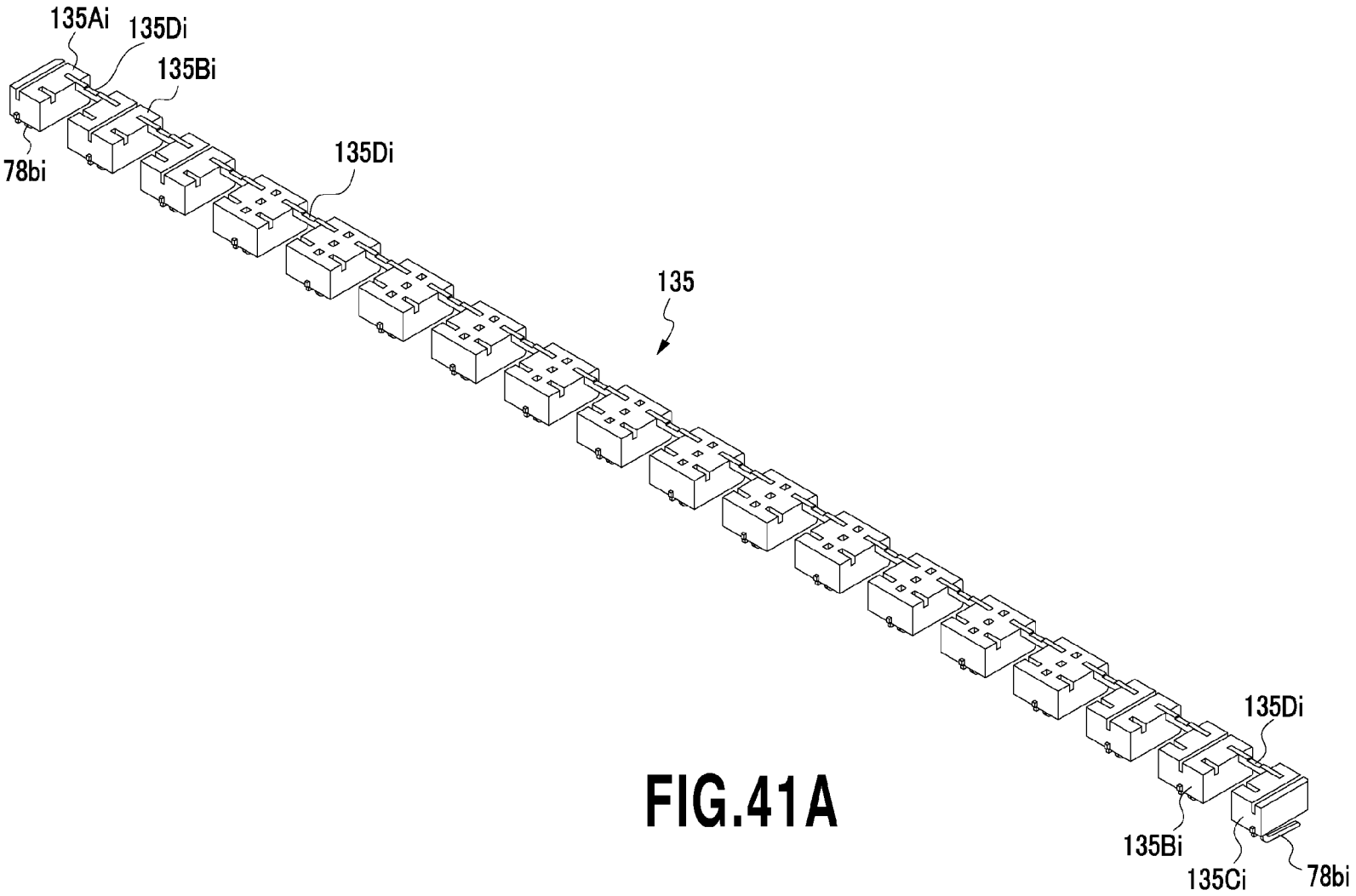
FIG. 41A is a perspective view illustrating another example of the conductive member used in the eighth embodiment of the receptacle connector shown in FIG. 34.

FIG. 41A illustrates another example of the receptacle-side conductive block unit of a separated type.

The plug connector 70 including the plug-side conductive block unit 105 illustrated in FIG. 29 is detachably connected to the receptacle connector 120 including the receptacle-side conductive block unit illustrated in FIG. 41A.

Note that in FIG. 41A, constituents which are the same as those in FIG. 36 will be denoted by the same reference signs and overlapping description thereof will be omitted.

A receptacle-side conductive block unit 135 is formed as a separated type, which includes blocks 135Ai and 135Ci constituting two ends, and a plurality of blocks 135Bi having the same shape and designed to join the block 135Ai to the block 135Ci.

The block 135Ai constituting the left end of the receptacle-side conductive block unit 135 is made of the aforementioned conductive resin material and formed into a rectangular parallelepiped shape. The block 135Ai is provided with grooves respectively in surfaces opposite from each other. One contact terminal 78*bi* is inserted into the groove in the lower surface of the block 135Ai. Moreover, the block 135Ai also includes a pair of grooves provided on the upper surface in such a way as to intersect with the aforementioned grooves, into which an end of a joining piece 135Di to be described later is inserted.

The block 135Ci constituting the right end of the receptacle-side conductive block unit 135 is made of the aforementioned conductive resin material and formed into a rectangular parallelepiped shape. The block 135Ci is provided with grooves respectively in surfaces opposite from each other. Moreover, the block 135Ci also includes a pair of grooves provided on the upper surface in such a way as to intersect with the aforementioned grooves, into which an end of another joining piece 135Di is inserted.

Each block 135Bi is made of the aforementioned conductive resin material and formed into a rectangular parallelepiped shape. The block 135Bi is provided with grooves respectively at central parts in surfaces opposite from each other. Moreover, the block 135Bi also includes two pairs of grooves provided on the upper surface in such a way as to intersect with the aforementioned grooves, into which ends of joining pieces 135Di are inserted.

Each of the blocks 135Ai, 135Bi, and 135Ci having the same width and the same thickness is provided with one contact terminal 78*bi* in its lower surface. The contact terminal 78*bi* is inserted into the corresponding groove described above.

The block 135Ci is placed opposite to the block 135Bi with a predetermined clearance in between. The block 135Ci and its adjacent block 135Bi are joined to each other by using one of the joining pieces 135Di.

The block 135Ai is placed opposite to the block 135Bi with a predetermined clearance in between. The block 135Ai and its adjacent block 135Bi are joined to each other by using another one of the joining pieces 135Di.

Between every two adjacent blocks 135Bi, one of the blocks 135Bi is placed opposite to the other block 135Bi with a predetermined clearance in between. The one block 135Bi and the other block 135Bi are joined to each other by using another one of the joining pieces 135Di.

Thus, the blocks 135Ai, 135Bi, and 135Ci are linearly and continuously joined to one another, thereby forming the receptacle-side conductive block unit 135 serving as the receptacle-side conductive member.

Figure 41B:
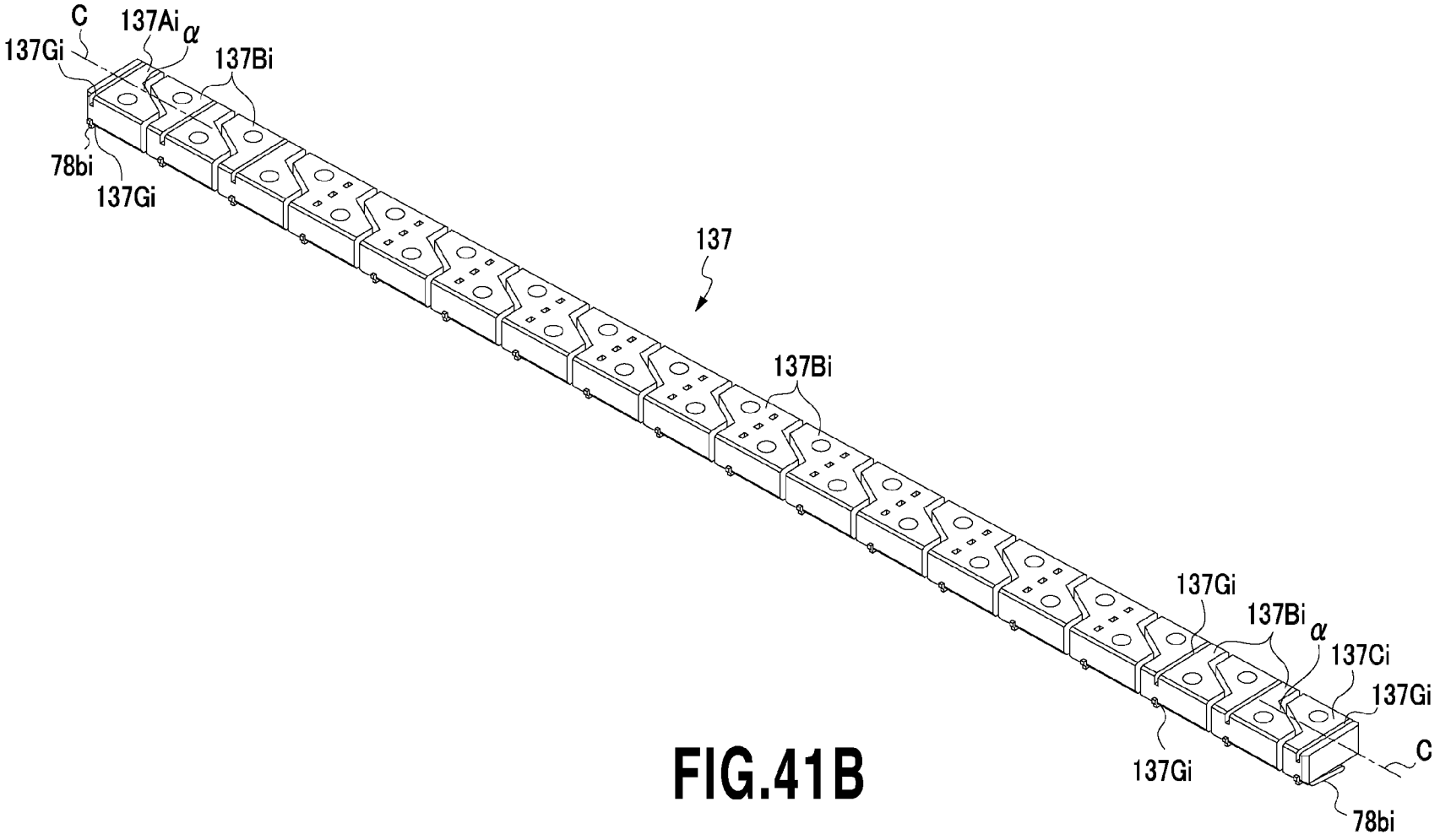
FIG. 41B is a perspective view illustrating yet another example of the conductive member used in the eighth embodiment of the receptacle connector shown in FIG. 34.

FIG. 41B illustrates another example of the receptacle-side conductive block unit of a separated type.

The receptacle-side conductive block unit illustrated in FIG. 41B is connected to the receptacle connector 120 illustrated in FIG. 34, for example. Although illustration is omitted, the plug connector is detachably connected to the receptacle connector 120 as described later.

The block 125Bi illustrated in FIG. 36 is made of the aforementioned conductive resin material and formed into the crank shape provided with a joining portion perpendicularly intersecting with the first side and the second side that are parallel to each other. In addition, in a receptacle-side conductive block unit 137 illustrated in FIG. 41B, each block 137Bi is formed into a crank shape provided with a joining portion intersecting with the first side and the second side that are parallel to each other at a given angle α smaller than 90°.

The receptacle-side conductive block unit 137 is formed as a separated type, which includes blocks 137Ai and 137Ci constituting two ends, and a plurality of blocks 137Bi having the same shape and disposed between the block 137Ai and the block 137Ci.

The receptacle-side conductive block unit 137 is disposed inside the above-described block unit accommodating portion 121R located above the plurality of contacts 20.

The block 137Ai constituting the left end of the receptacle-side conductive block unit 137 is made of the aforementioned conductive resin material and formed into an angular shape having an angle at a lower left corner. The block 137Ai is also provided with grooves 137Gi respectively in surfaces opposite from each other, and in such a way as to be orthogonal to the direction of arrangement of the blocks. One of the contact terminals 78*bi* is inserted into the groove 137Gi in the lower surface. An end surface of the block 137Ai opposed to its adjacent block 137Bi is formed by joining a pair of surfaces parallel to the groove 137Gi to each other through the intermediary of an inclined surface. In FIG. 41B, the inclined surface intersects with the center axis C of the receptacle-side conductive block unit 137 at the given angle α.

The block 137Ci constituting the right end of the receptacle-side conductive block unit 137 is made of the aforementioned conductive resin material and formed into an angular shape having an angle at an upper right corner. The block 137Ci is also provided with grooves 137Gi respectively in surfaces opposite from each other, and in such a way as to be orthogonal to the direction of arrangement of the blocks. Another one of the contact terminals 78*bi* is inserted into the groove 137Gi in the lower surface. An end surface of the block 137Ai opposed to its adjacent block 137Bi is formed by joining a pair of surfaces parallel to the groove 137Gi through the intermediary of an inclined surface. In FIG. 41B, the inclined surface intersects with the center axis C of the receptacle-side conductive block unit 137 at the given angle α.

As described previously, each block 137Bi is formed into the crank shape provided with the joining portion intersecting with the center axis C of the receptacle-side conductive block unit 137 at the given angle α smaller than 90°. The block 137Bi is also provided with grooves 137Gi respectively at central parts in surfaces in the vertical direction opposite from each other. One end surface of the block 137Bi opposed to another block 137Bi is formed by joining a pair of surfaces parallel to the groove 137Gi through the intermediary of an inclined surface. In FIG. 41B, the inclined surface intersects with the center axis C of the receptacle-side conductive block unit 137 at the given angle α. The other end surface of the block 137Bi opposed to still another block 137Bi is formed substantially parallel to the aforementioned end surface on the one side.

Each of the blocks 137Ai, 137Bi, and 137Ci having the same width and the same thickness is provided with one contact terminal 78*bi*.

The block 137Ci is placed such that one of its end surfaces is opposed to a facing surface of the block 135Bi with a predetermined clearance in between.

The block 137Ai is placed such that one of its end surfaces is opposed to a facing surface of the block 135Bi with a predetermined clearance in between.

Between every two adjacent blocks 137Bi, one of the blocks 137Bi is placed such that one of its end surfaces is opposed to an end surface of the other block 137Bi with a predetermined clearance CL in between.

Thus, the blocks 137Ai, 137Bi, and 137Ci are linearly and continuously joined to one another, thereby forming the receptacle-side conductive block unit 137 serving as the receptacle-side conductive member. In the meantime, as the area of the opposed end surfaces between the two adjacent blocks 137Bi is larger, absorption of radiated noise becomes greater so that ripples can be reduced further. Nonetheless, each block 137Bi is formed into the crank shape provided with the joining portion intersecting with the center axis C of the receptacle-side conductive block unit 137 at the given angle $\alpha$ smaller than 90°. Accordingly, the formation of the blocks 137Bi is easier than the formation of the blocks 125Ai, 125Bi, and 125Ci illustrated in FIG. 36.

In the above-described example, the blocks are arranged with the given clearances in between. However, the present invention is not limited to this example. For instance, as a variant example of the receptacle-side conductive block unit 137, the receptacle-side conductive member may be formed into an integrated type by fusion bonding the blocks together by two-color molding so as to fill each clearance, as shown in FIG. 32A, while using a joining piece made of an insulative resin material and having a shape in accordance with the clearance.

Here, any of the receptacle-side conductive block unit 137 and the above-described variant example of the integrated type may naturally be formed into a plug-side conductive block unit of a separated type by additionally inserting the contact terminals 78*ai* into the grooves 137Gi on the upper surfaces of the blocks 137Ai, 137Bi, and 137Ci. In this case, the plug-side conductive block unit is made attachable to the plug connector 70. The above-described plug connector 70 is detachably connected to the aforementioned receptacle connector 120.

Figure 42B:
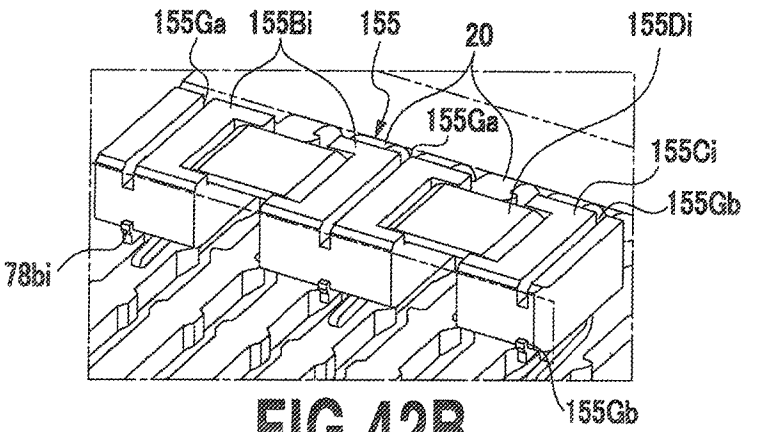
FIG. 42B is a perspective view in which yet another example of the conductive member used in the eighth embodiment of the receptacle connector shown in FIG. 34 is illustrated together with the contacts.
Figure 42D:
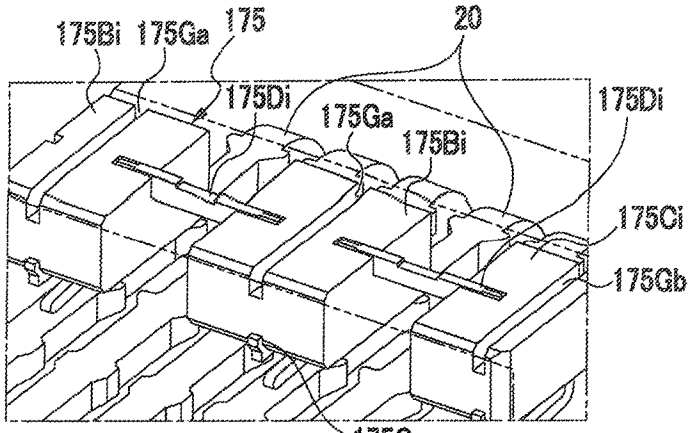
FIG. 42D is a perspective view in which yet another example of the conductive member used in the eighth embodiment of the receptacle connector shown in FIG. 34 is illustrated together with the contacts.
Figure 42A:
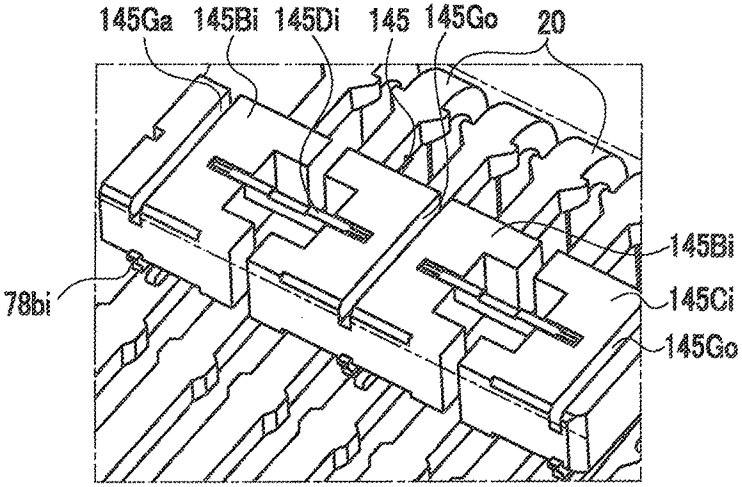
FIG. 42A is a perspective view in which yet another example of the conductive member used in the eighth embodiment of the receptacle connector shown in FIG. 34 is illustrated together with the contacts.
Figure 42C:
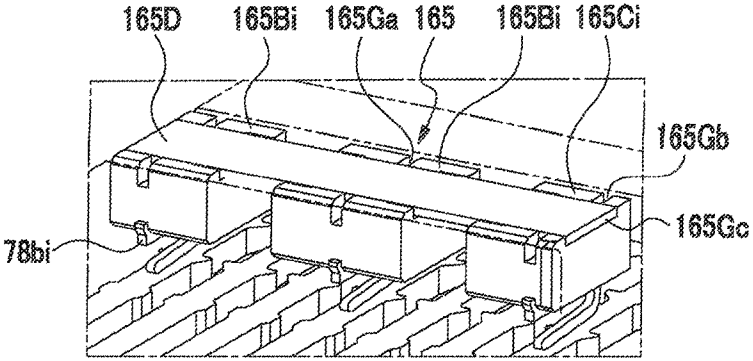
FIG. 42C is a perspective view in which yet another example of the conductive member used in the eighth embodiment of the receptacle connector shown in FIG. 34 is illustrated together with the contacts.
Figure 43A:
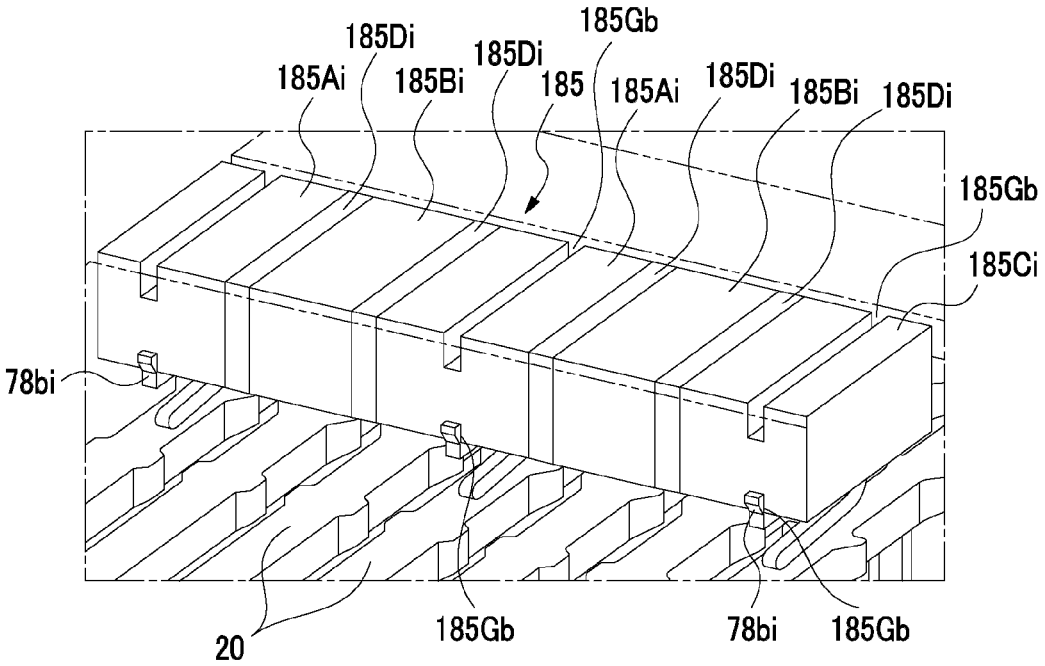
FIG. 43A is a perspective view in which yet another example of the conductive member used in the eighth embodiment of the receptacle connector shown in FIG. 34 is illustrated together with the contacts.
Figure 43B:
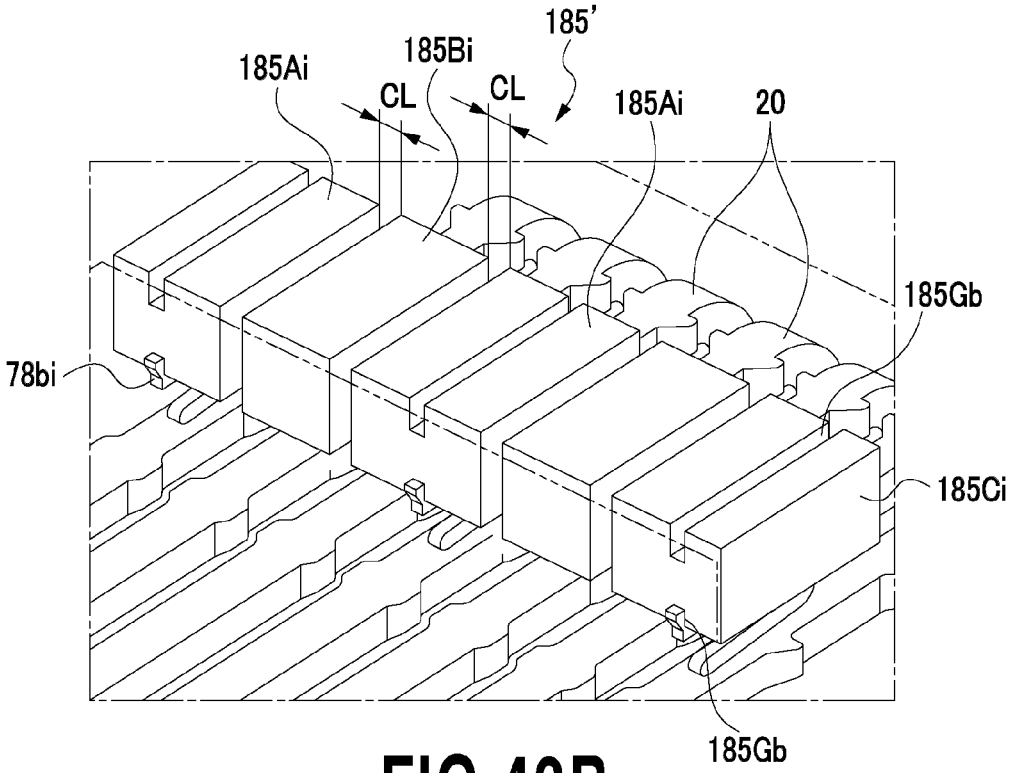
FIG. 43B is a perspective view in which yet another example of the conductive member used in the eighth embodiment of the receptacle connector shown in FIG. 34 is illustrated together with the contacts.

FIG. 42A to FIG. 42D as well as FIG. 43A and FIG. 43B respectively illustrate other examples of the receptacle-side conductive block unit of a separated type.

A receptacle-side conductive block unit 145 illustrated in FIG. 42A includes U-shaped blocks 145Ai (not illustrated) and 145Ci having the same structure and constituting two ends, and a plurality of H-shaped blocks 145Bi having the same shape and designed to join the block 145Ai to the block 145Ci.

The block 145Ci constituting the right end of the receptacle-side conductive block unit 145 is made of the aforementioned conductive resin material and formed into the U-shape. The block 145Ci is also provided with grooves 145Go respectively in surfaces opposite from each other. Moreover, a groove into which one end of a joining piece 145Di is inserted is provided substantially at a central part of an upper surface of the block 145Ci in such a way as to intersect with the aforementioned grooves.

Each block 145Bi is made of the aforementioned conductive resin material and formed into the H-shape. The block 145Bi is also provided with grooves 145Go respectively at central parts in surfaces opposite from each other. Moreover, grooves into which ends of another joining piece 145Di are respectively inserted are formed at two positions away from each other in the upper surface of the block 145Bi.

Each of the blocks 145Ai, 145Bi, and 145Ci having the same width and the same thickness is provided with one contact terminal 78*bi* in its lower surface. The contact terminal 78*bi* is inserted into each groove 145Go described above.

The block 145Ci is placed opposite to the block 145Bi with a predetermined clearance in between. The block 145Ci and the adjacent block 145Bi are joined to each other by using one of the joining pieces 145Di.

Between every two adjacent blocks 145Bi, one of the blocks 145Bi is placed opposite to the other block 145Bi with a predetermined clearance in between. The one block 145Bi and the other block 145Bi are joined to each other by using another one of the joining pieces 145Di.

Thus, the blocks 145Ai (not illustrated), 145Bi, and 145Ci are linearly and continuously joined to one another, thereby forming the receptacle-side conductive block unit 145 serving as the receptacle-side conductive member.

A receptacle-side conductive block unit 155 illustrated in FIG. 42B includes blocks 155Ai (not illustrated) and 155Ci having the same structure and constituting two ends, and a plurality of blocks 155Bi having the same shape and designed to join the block 155Ai to the block 155Ci.

The block 155Ci constituting the right end of the receptacle-side conductive block unit 155 is made of the aforementioned conductive resin material and formed into a rectangular parallelepiped shape. The block 155Ci is also provided with grooves 155Gb respectively in surfaces opposite from each other. Moreover, a recessed part into which one end of a metallic joining plate 155Di is inserted is provided substantially at a central part of an upper surface of the block 155Ci in such a way as to intersect with the grooves.

Each block 155Bi is made of the aforementioned conductive resin material and formed into a rectangular parallelepiped shape. The block 155Bi is also provided with grooves 155Ga respectively at central parts in surfaces opposite from each other. Moreover, recessed portions into which ends of other joining plate 155Di are respectively inserted are formed at two positions opposite and away from each other in the upper surface of the block 155Bi, in such a way as to intersect with the grooves 155Ga.

Each of the blocks 155Bi and 155Ci having the same width and the same thickness is provided with one contact terminal 78*bi* in its lower surface. The contact terminal 78*bi* is inserted into each of the grooves 155Gb described above.

The block 155Ci is placed opposite to the block 155Bi with a predetermined clearance in between. The block 155Ci and the adjacent block 155Bi are joined to each other by using one of the joining plates 155Di.

Between every two adjacent blocks 155Bi, one of the blocks 155Bi is placed opposite to the other block 155Bi with a predetermined clearance in between. The one block 155Bi and the other block 155Bi are joined to each other by using another one of the joining plates 155Di. This clearance is set greater than the distance between the two adjacent blocks 145Bi in the example illustrated in FIG. 42A.

Thus, the blocks 155Ai (not illustrated), 155Bi, and 155Ci are linearly and continuously joined to one another, thereby forming the receptacle-side conductive block unit 155 serving as the receptacle-side conductive member.

A receptacle-side conductive block unit 165 illustrated in FIG. 42C includes blocks 165Ai (not illustrated) and 165Ci having the same structure and constituting two ends, and a plurality of blocks 165Bi having the same shape and designed to join the block 165Ai to the block 165Ci.

The block 165Ci constituting the right end of the receptacle-side conductive block unit 165 is made of the aforementioned conductive resin material and formed into a rectangular parallelepiped shape. The block 165Ci is also provided with grooves 165Gb respectively in surfaces opposite from each other. Moreover, a shallow groove 165Gc into which one end of a metallic joining plate 165D, which extends across the two ends of the receptacle-side conductive block unit 165, is inserted is provided substantially at a central part of an upper surface of the block 165Ci in such a way as to intersect with the aforementioned grooves.

Each block 165Bi is made of the aforementioned conductive resin material and formed into a rectangular parallelepiped shape. The block 165Bi is also provided with grooves 165Ga respectively at central parts in surfaces opposite from each other. Moreover, a shallow groove into which an intermediate portion of the joining plate 165D is inserted is formed in the upper surface of the block 165Bi in such a way as to intersect with the grooves 165Ga.

Each of the blocks 165Bi and 165Ci having the same width and the same thickness is provided with one contact terminal 78*bi* in its lower surface. The contact terminal 78*bi* is inserted into each of the grooves 165Ga and 165Gb described above.

The block 165Ci is placed opposite to the block 165Bi with a predetermined clearance in between. The block 165Ci and the adjacent block 165Bi are joined to each other by using the joining plate 165D.

Between every two adjacent blocks 165Bi, one of the blocks 165Bi is placed opposite to the other block 165Bi with a predetermined clearance in between. The one block 165Bi and the other block 165Bi are joined to each other by using the common joining plate 165D.

Thus, the blocks 165Ai (not illustrated), 165Bi, and 165Ci are linearly and continuously joined to one another, thereby the receptacle-side conductive block unit 165 serving as the receptacle-side conductive member.

A receptacle-side conductive block unit 175 illustrated in FIG. 42D includes blocks 175Ai (not illustrated) and 175Ci having the same structure and constituting two ends, and a plurality of blocks 175Bi having the same shape and designed to join the block 175Ai to the block 175Ci.

The block 175Ci constituting the right end of the receptacle-side conductive block unit 175 is made of the aforementioned conductive resin material and formed into a rectangular parallelepiped shape. The block 175Ci is also provided with grooves 175Gb respectively in surfaces opposite from each other. Moreover, a groove into which one end of a joining piece 175Di is inserted is provided substantially at a central part of an upper surface in each of the opposite surfaces of the block 175Ci in such a way as to intersect with the aforementioned grooves.

Each block 175Bi is made of the aforementioned conductive resin material and formed into a rectangular parallelepiped shape. The block 175Bi is also provided with grooves 175Ga respectively at central parts in surfaces opposite from each other. Moreover, grooves into which ends of the joining piece 175Di are respectively inserted are provided at two positions on the upper surface located away from each other while interposing the grooves 175Ga in between in such a way as to intersect with the grooves 175Ga.

Each of the blocks 175Bi and 175Ci having the same width and the same thickness is provided with one contact terminal 78*bi* in its lower surface. The contact terminal 78*bi* is inserted into each of the grooves 175Ga and 175Gb described above.

The block 175Ci is placed opposite to the block 175Bi with a predetermined clearance in between. The block 175Ci and the adjacent block 175Bi are joined to each other by using one of the joining pieces 175Di.

Between every two adjacent blocks 175Bi, one of the blocks 175Bi is placed opposite to the other block 175Bi with a predetermined clearance in between. The one block 175Bi and the other block 175Bi are joined to each other by using another one of the joining pieces 175Di.

Thus, the blocks 175Ai (not illustrated), 175Bi, and 175Ci are linearly and continuously joined to one another, thereby the receptacle-side conductive block unit 175 serving as the receptacle-side conductive member.

A receptacle-side conductive block unit 185 illustrated in FIG. 43A includes blocks 185Ci having the same structure and constituting two ends, blocks 185Ai each disposed above an intermediate position between two signal line contacts 20*b*, blocks 185Bi each disposed above a ground contact 20*a*, and a plurality of insulating layers 185Di each designed to join the block 185Ai to the block 185Bi or to connect the block 185Bi to the block 185Ci.

The block 185Ci constituting the right end of the receptacle-side conductive block unit 185 is made of the aforementioned conductive resin material and formed into a rectangular parallelepiped shape. The block 185Ci is also provided with grooves 185Gb respectively in surfaces opposite from each other.

Each block 185Ai is made of the aforementioned conductive resin material and formed into a rectangular parallelepiped shape. The block 185Ai is also provided with grooves 185Gb respectively at central parts in surfaces opposite from each other.

Each of the blocks 185Ai, and 185Ci having the same width and the same thickness is provided with one contact terminal 78*bi* in its lower surface. The contact terminal 78*bi* is inserted into each of the grooves 185Gb described above.

The block 185Ci is placed opposite to the block 185Bi through the intermediary of one of the insulating layers 185Di. The insulating layer 185Di is fusion bonded to end portions of the block 185Ci and the block 185Bi.

Between every two adjacent blocks 185Ai, one of the blocks 185Ai is placed opposite to the other block 185Ai through the intermediary of two insulating layers 185Di and the block 185Bi.

Thus, the blocks 185Ai, 185Bi, and 185Ci are linearly and continuously joined to one another with the intermediary of the insulating layers 185Di, thereby forming the receptacle-side conductive block unit 185 serving as the receptacle-side conductive member.

Note that in the above-mentioned example, the blocks may be joined to one another through the intermediary of air layers each having a predetermined clearance CL or metallic members instead of the insulating layers 185Di.

Figure 44:
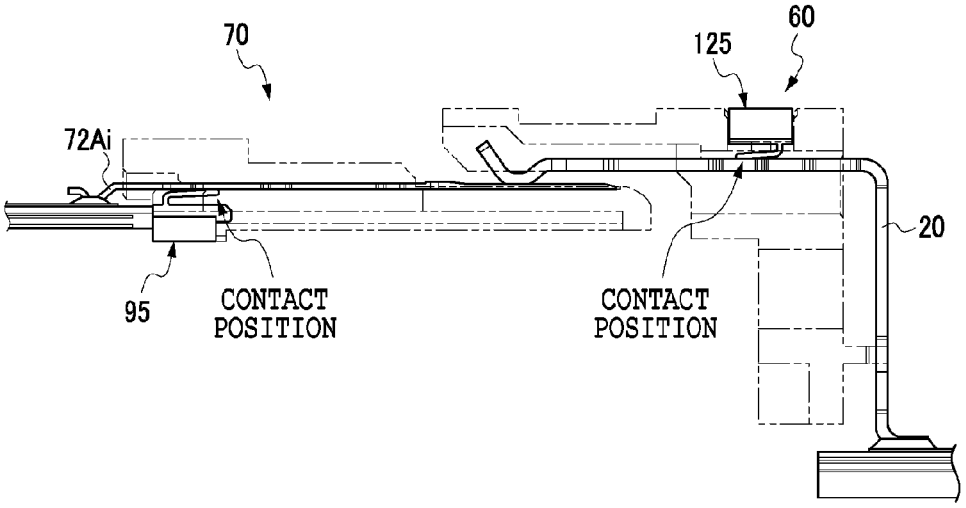
FIG. 44 is a configuration diagram depicting a virtual model in a simulator.

By using a prescribed simulator, the inventor of the present application has conducted simulative experiments concerning a change in peak of insertion loss and a change in peak of crosstalk in the case where the above-described plug connector 70 is connected to the receptacle connector 60 as illustrated in FIG. 44. The plug connector 70 is assumed to include the plug-side conductive block unit 95 provided with the plurality of contact terminals 78*ai* and 78*bi*, while the receptacle connector 60 is assumed to include the receptacle-side conductive block unit 125 provided with the plurality of contact terminals 78*bi*.

The above-mentioned simulator conducts simulative experiments by creating a virtual model in the case where the plug connector 70 is connected to the receptacle connector 60, in accordance with a prescribed program.

Figure 45A:
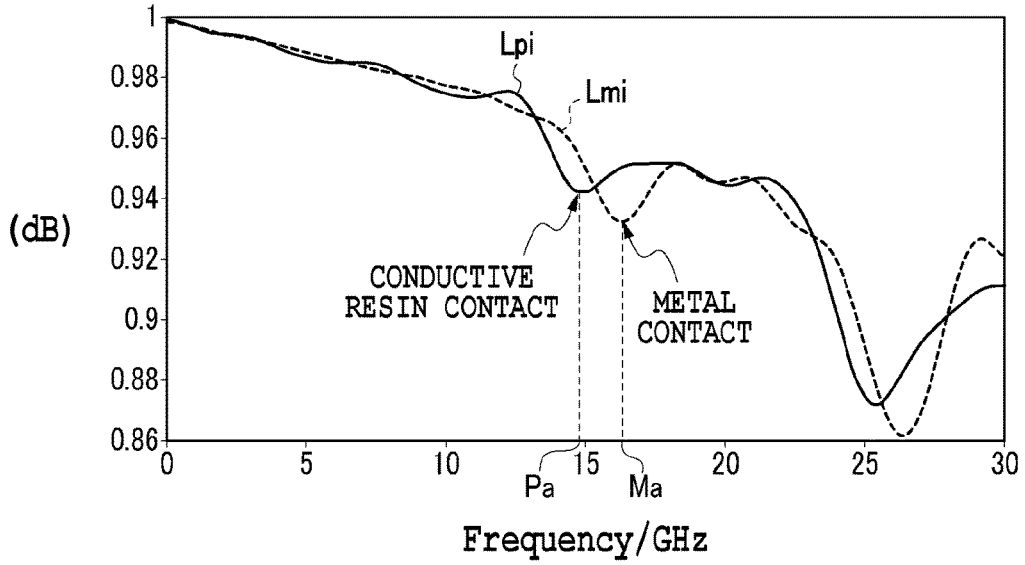
FIG. 45A is a characteristic diagram depicting a change in peak of insertion loss obtained by using the simulator.
Figure 45B:
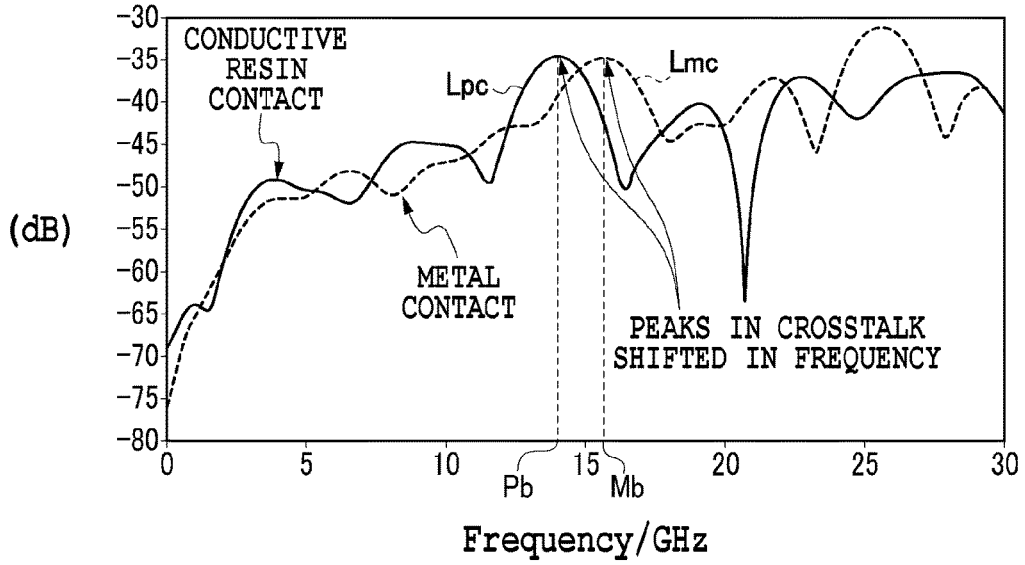
FIG. 45B is a characteristic diagram depicting a change in peak of crosstalk obtained by using the simulator.

In FIG. 45A, the vertical axis indicates peak value (dB) of the insertion loss and the horizontal axis indicates frequency (GHz). FIG. 45A depicts a characteristic line Lmi and a characteristic line Lpi each representing the change in peak value of the insertion loss. In FIG. 45B, the vertical axis indicates peak value (dB) of the crosstalk and the horizontal axis indicates frequency (GHz). FIG. 45B depicts a characteristic line Lmc and a characteristic line Lpc each representing the change in peak value of the crosstalk.

The characteristic line Lmi in FIG. 45A and the characteristic line Lmc in FIG. 45B were obtained by the simulator in accordance with a virtual model corresponding to the seventh embodiment of the present invention.

The characteristic line Lpi in FIG. 45A and the characteristic line Lpc in FIG. 45B were obtained by the simulator in accordance with a virtual model corresponding to a comparative example which is different from the seventh embodiment of the present invention. As for the different comparative example, in a plug connector and a receptacle connector having the same structures as the plug connector 70 and the receptacle connector 60 except for the contact terminals, a plug-side conductive member and a receptacle-side conductive member therein as shown in the above-mentioned Patent Document 1, for example, are directly brought into contact with the ground contacts 20*a* and 40*a* without the intermediary of the metallic contact terminals. The plug-side conductive member and the receptacle-side conductive member are each made of a conductive resin material having volume resistivity in a range from about 1 to 10 ohms/cm, for example.

In the comparative example, as clear from the characteristic line Lpi in FIG. 45A, when the frequency changes from about 12 GHz to a value Pa around 15 GHz, the peak of the insertion loss is attenuated to about 0.94 (dB). Hence, as clear from the characteristic line Lpc in FIG. 45B, the peak value of the crosstalk is increased to 35 (dB) at a frequency value Pb around 14 GHz. Accordingly, the crosstalk will be increased if the frequency (a specification frequency) of a signal to be transmitted is in a range from 10 GHz to 15 GHz, for example.

On the other hand, in the seventh embodiment of the present invention, as clear from the characteristic line Lmi in FIG. 45A, when the frequency changes from about 14 GHz to a value Ma around 16 GHz, the peak of the insertion loss is attenuated to about 0.93 (dB). Hence, as clear from the characteristic line Lmc in FIG. 45B, the peak value of the crosstalk is gradually increased from the frequency of 14 GHz, up to 35 (dB) at a frequency value Mb around 16 GHz in excess of the 15 GHz. Accordingly, the peak in crosstalk is shifted to the value Mb around the 16 GHz in excess of the 15 GHz when the frequency (the specification frequency) of the signal to be transmitted is in the range from 10 GHz to 15 GHz, for example. As a consequence, it turns out that the crosstalk is reduced by about 5 (dB) as compared to the above-described comparative example. Since it has been confirmed that, if the plug-side conductive member and the receptacle-side conductive member do not come into contact with the ground contacts, ripples occur due to insufficient absorption of the radiation, and a loss attributed to the ripples causes the radiation that increases the crosstalk. Accordingly, the metallic contact terminals 78*ai* and 78*bi* having elasticity provided in this embodiment can secure and stabilize the electrical connection to the ground contacts 20*a* and 40*a*.

As a consequence, the frequency at which a loss occurs can be shifted by increasing a length between a contact position of a ground contact and a contact terminal by using a metal. Accordingly, it is possible to improve a transmission characteristic in a required frequency range. Here, it is to be noted that the above-described frequency adjustment is infeasible merely by the connection using a conductive resin as mentioned above in the comparative example.

Ninth Embodiment

Figure 46:
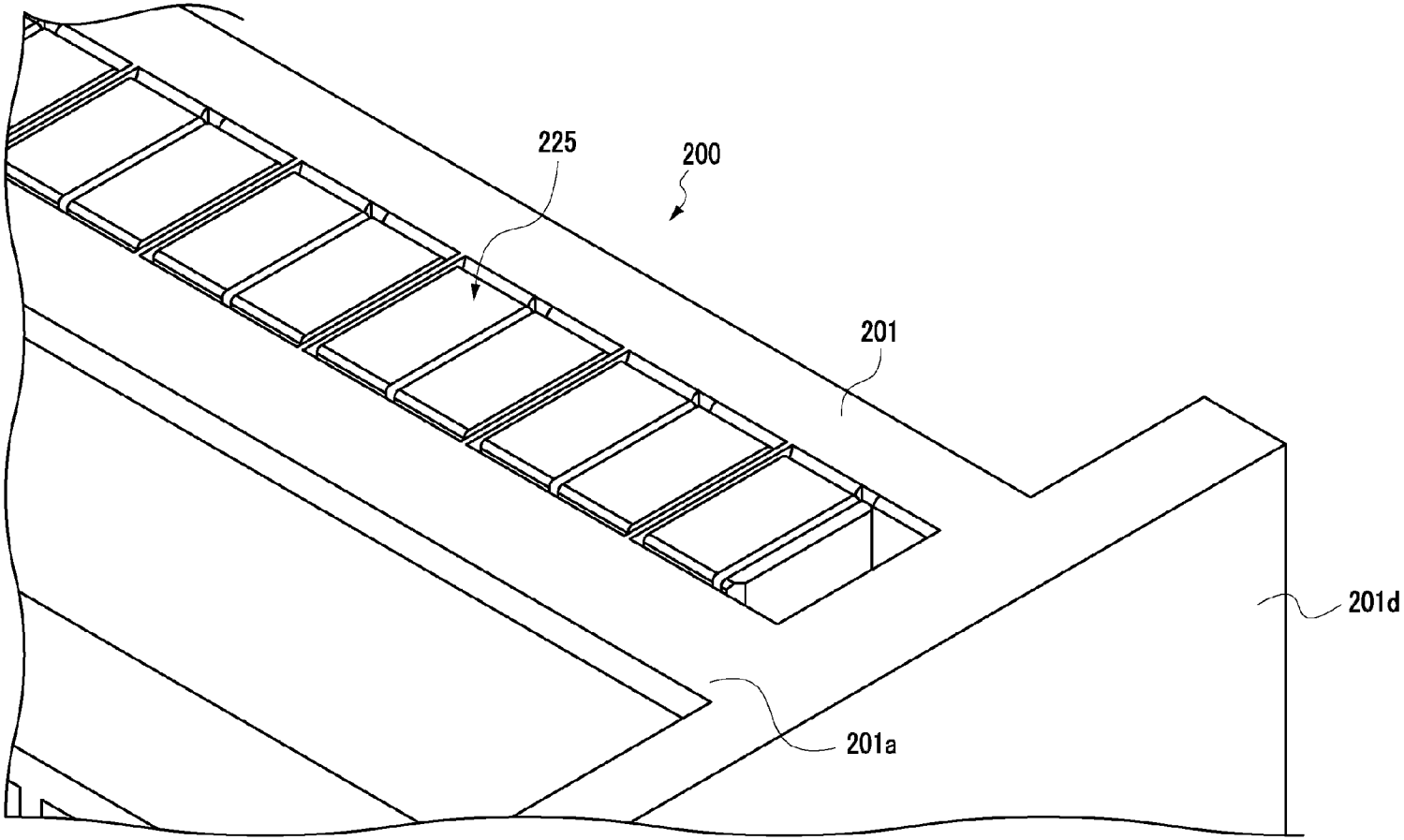
FIG. 46 is a perspective view illustrating main part of a ninth embodiment of the receptacle connector constituting part of the electrical connector according to the present invention.

FIG. 46 illustrates principal part of a ninth embodiment of the receptacle connector constituting part of the electrical connector according to the present invention.

A not-illustrated plug connector including a plug-side conductive block unit is detachably connected to the receptacle connector illustrated in FIG. 46.

A receptacle connector 200 includes a housing 201, a receptacle-side conductive block unit 225 (see FIG. 48) as the first conductive member, a receptacle-side conductive block unit (not illustrated) as the second conductive member, the above-described a plurality of contacts 20 on the first row, and the above-described a plurality of contacts 40 on the second row.

The housing 201 is made of an electrically insulative synthetic resin material such as LCP (liquid crystal polymer). A profile of the housing 201 has a substantially rectangular parallelepiped shape, and includes an upper wall 201*a*, a lower wall (not illustrated), a left side wall (not illustrated), and a right side wall 201*d*.

A plurality of first slits for accommodating part of the plurality of contacts 20 on the first row, respectively, are provided extending from the front side toward the back side of the housing 201. The first slits are formed at given intervals in a right-left direction of the housing 201. Every adjacent pair of the first slits are partitioned by a partition wall. A plurality of second slits for accommodating part of the plurality of contacts 40 on the second row, respectively, and a first accommodating space into which the above-described plug connector is inserted are provided on the front side of the housing 201. The second slits to be formed below the first slits are formed at given intervals in the right-left direction of the housing 201 so as to face the corresponding first slits. Every adjacent pair of the second slits are partitioned by a partition wall. A second accommodating space, which receives the plurality of contacts 20 on the first row and a support portion that fixes and supports the plurality of contacts 20 on the first row, is provided on the back side of the housing 201. A hollow portion, into which a receptacle-side conductive block unit (not illustrated) as the second conductive member is inserted, is provided in the lower wall (not illustrated) of the housing 201.

The plurality of first slits are each located on an upper side of the first accommodating space and extend in the front-back direction of the housing 201. The front side of each of the plurality of first slits is opened toward the first accommodating space while the backside thereof is opened toward the second accommodating space. Accordingly, each of the plurality of first slits is designed to connect the first accommodating space to the second accommodating space.

The plurality of second slits provided on the front side of the housing 201 respectively extend in the front-back direction below the first accommodating space, and the front side of each of the plurality of second slits is opened toward the first accommodating space. Each of the plurality of second slits is formed such that the corresponding one of the plurality of contacts 40 on the second row can be inserted from the front side when assembling the receptacle connector 200.

Figure 47:
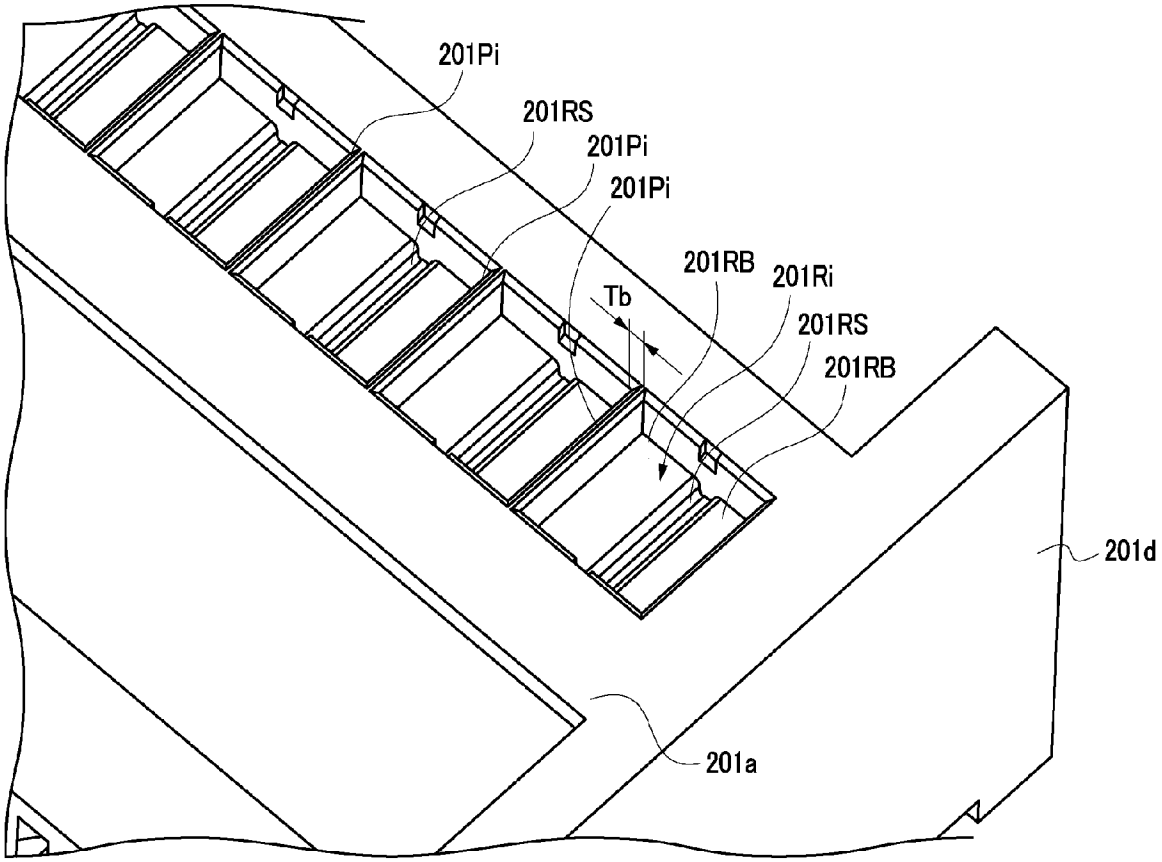
FIG. 47 is a perspective view illustrating a state where a receptacle-side conductive block unit is detached in the example shown in FIG. 46.

As illustrated in a partially enlarged manner in FIG. 47, a block unit accommodating portion, to which the receptacle-side conductive block unit 225 as the first conductive member to be described later is attached, is formed on a back surface side in the upper wall 201*a* of the housing 201.

The block unit accommodating portion includes compartments 201Ri (i=1 to 18) to which respective blocks to be described later are attached. Every adjacent pair of the compartments 201Ri are partitioned by a partition wall 201Pi (i=1 to 17) having a thickness Tb. A slit 201RS, which allows a movable contact portion 89*a* of a contact terminal 88*bi* to be described later to penetrate to reach the corresponding contact 20, is formed at a central part of a flat bottom portion 201RB that forms each compartment 201Ri that is opened upward.

The receptacle-side conductive block unit 225 as the first conductive member and the receptacle-side conductive block unit (not illustrated) as the second conductive member have the same structure except for the positions of attachment of the contact terminals 88*bi*. Accordingly, the receptacle-side conductive block unit 225 will be hereinbelow described while the description of the receptacle-side conductive block unit as the second conductive member will be omitted. Here, the receptacle-side conductive block unit as the second conductive member is to be provided with the plurality of contact terminals 88*bi* on its upper end surface.

Figure 48:
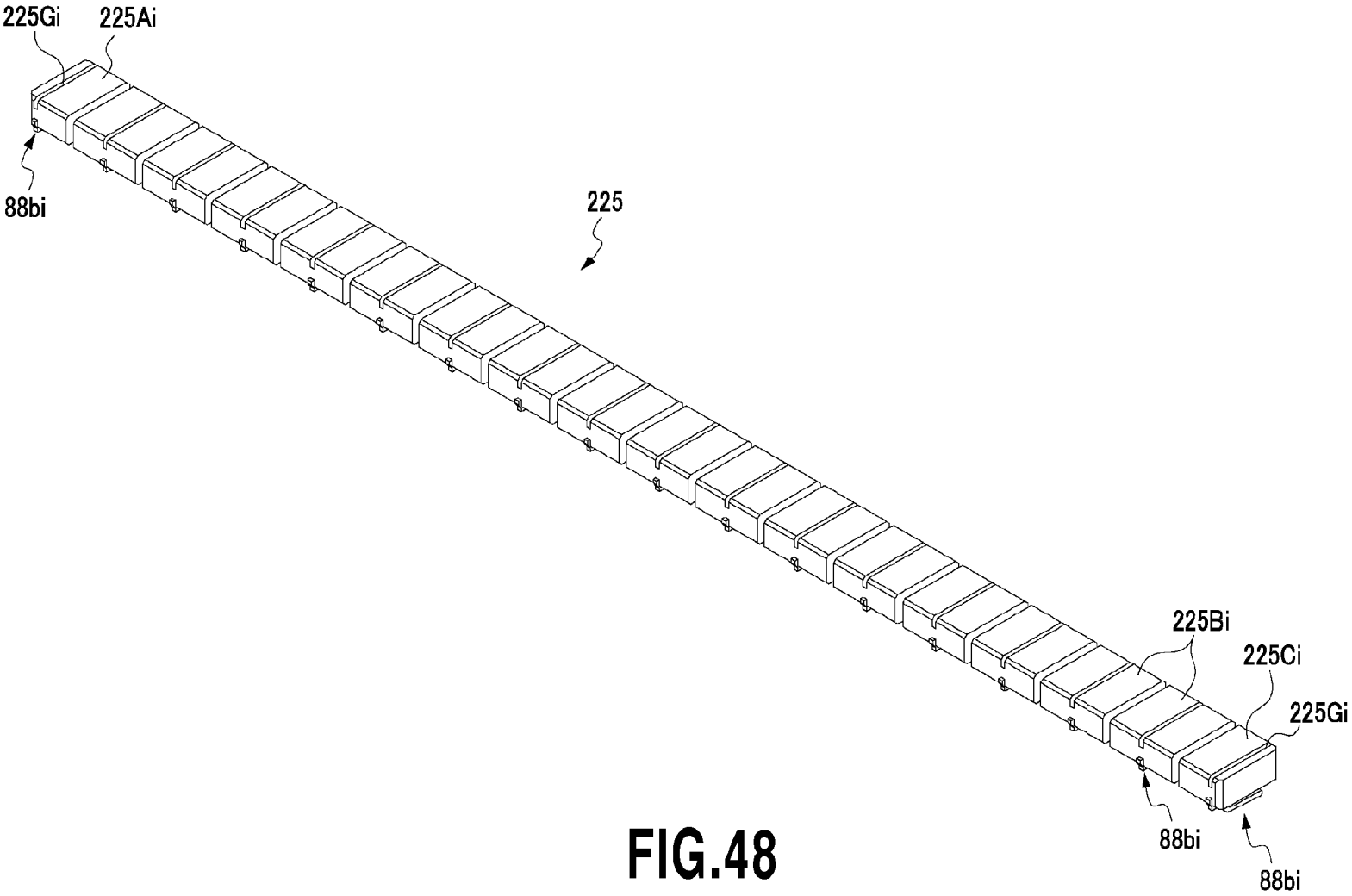
FIG. 48 is a perspective view illustrating the receptacle-side conductive block unit used in the example shown in FIG. 46.

As illustrated in an enlarged manner in FIG. 48, the receptacle-side conductive block unit 225 is formed as a separated type, which includes blocks 225Ai and 225Ci constituting two ends, and a plurality of blocks 225Bi having the same shape and disposed between the block 225Ai to the block 225Ci.

As illustrated in FIG. 46, the blocks of the receptacle-side conductive block unit 225 are respectively disposed inside the aforementioned compartments 201Ri located above the contacts 20.

The block 225Ai constituting the left end of the receptacle-side conductive block unit 225 is made of the aforementioned conductive resin material and formed into a parallelepiped shape. The block 225Ai is also provided with grooves 225Gi respectively in surfaces opposite from each other. The contact terminal 88*bi* is inserted into the groove 225Gi in the lower end surface.

Each contact terminal 88*bi* is made of a thin metal sheet material and is formed by press working, for example. As illustrated in an enlarged manner in FIG. 49B, the contact terminal 88*bi* includes a fixing portion 89*b* to be inserted into the groove 225Gi, and the elastically deformable movable contact portion 89*a* whose one end is connected to the fixing portion 89*b*. The other end of the movable contact portion 89*a* to come into contact with the contact 20 extends obliquely backward. The fixing portion 89*b* includes catch parts 89*c* provided on two sides, which are to be locked with an inner peripheral part of a wall portion that defines the above-described compartment 201Ri.

The block 225Ci constituting the right end of the receptacle-side conductive block unit 225 is made of the aforementioned conductive resin material and formed into a parallelepiped shape having the same size as the size of the block 225Ai. The block 225Ci is also provided with grooves 225Gi respectively in surfaces opposite from each other. The contact terminal 88*bi* is inserted into the groove 225Gi in the lower end surface.

Figure 49A:
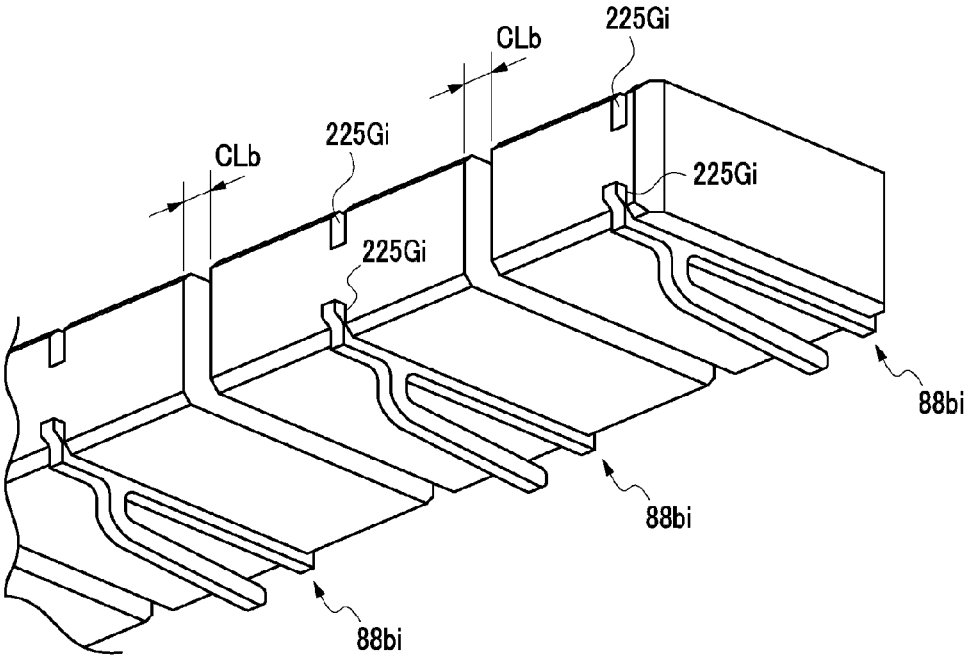
FIG. 49A is a partial enlarged perspective view illustrating part in the example shown in FIG. 48.
Figure 49B:
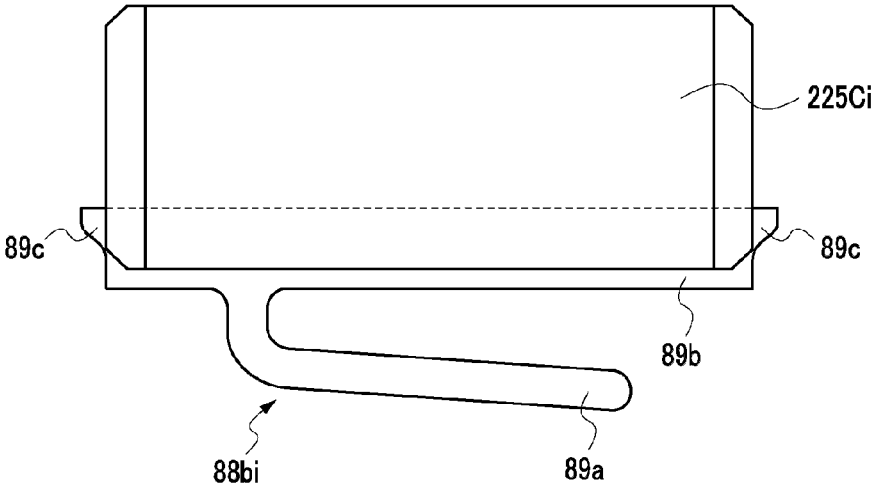
FIG. 49B is aside view of the example shown in FIG. 49A.

As illustrated in an enlarged manner in FIG. 49A, each block 225Bi is made of the aforementioned conductive resin material and formed into a rectangular parallelepiped shape having a larger size than the size of the blocks 225Ai and 225Gi. The block 225Bi is provided with grooves 225Gi respectively at central parts in surfaces in the vertical direction opposite from each other. The contact terminal 88*bi* is inserted into the groove 225Gi in the lower end surface.

Accordingly, each of the blocks 225Ai, 225Bi, and 225Ci having the same width and the same thickness is provided with one contact terminal 88*bi*.

The block 225Ci is placed opposite to an end surface of the block 225Bi with a predetermined clearance CLb in between. The clearance CLb is set substantially equal to the above-described thickness Tb of the partition wall 201Pi.

As with the block 225Ci, the block 225Ai is placed opposite to an end surface of the block 225Bi with a predetermined clearance CLb in between.

As illustrated in an enlarged manner in FIG. 49A, between every two adjacent blocks 225Bi, one of the blocks 225Bi is placed such that an end surface thereof is opposed to an end surface of the other block 225Bi with a predetermined clearance CLb in between.

Thus, the blocks 225Ai, 225Bi, and 225Ci are linearly and continuously disposed in the compartments 201Ri of the block unit accommodating portion partitioned by the partition walls 201Pi, thereby forming the receptacle-side conductive block unit 225 serving as the receptacle-side conductive member.

As described above, in several embodiments of the electrical connector according to the present invention, the plug connectors and the receptacle connectors respectively include the plug-side conductive member of either an integrated type or a separated type, and the receptacle-side conductive member of either an integrated type or a separated type. In these cases, in an example of the electrical connector according to the present invention, the plug connector including the plug-side conductive member of an integrated type may naturally be combined with the receptacle connector including the receptacle-side conductive member of a separated type in order to reduce manufacturing cost. Likewise, the plug connector including the plug-side conductive member of a separated type may naturally be combined with the receptacle connector including the receptacle-side conductive member of an integrated type.

REFERENCE SIGNS LIST

10 receptacle connector
11 housing
16 first accommodating space
18 second accommodating space
20 contact on first row
30 first conductive member
31 conductive resin member
32, 52 connection part
35 support portion
40 contact on second row
50 second conductive member
51 conductive resin member
80 plug connector
81 blade
82*a* first pad
82*b* second pad
85 plug-side conductive member

The invention claimed is:

1. A receptacle connector used in an electrical connector to connect two circuit boards to each other, the receptacle connector comprising:

a housing comprised of an insulative resin material and defines an accommodating space having an opening into which an object to be connected is to be inserted;

a plurality of contacts each comprised of a metal material and to be accommodated in the accommodating space while being arranged adjacent to one another, the contacts including a plurality of signal line contacts and a plurality of ground contacts; and a conductive member including at least one first connection part comprised of a metal material and configured to be electrically connected to at least one ground contact among the plurality of ground contacts, and a conductive resin member configured to be electrically connected to the first connection part;

wherein the receptacle connector includes a plurality of the first connection parts, and the conductive resin member is split into a plurality of segments for each of the plurality of the first connection parts.

2. The receptacle connector according to claim 1, wherein the first connection part is in physical contact with the conductive resin member.

3. The receptacle connector according to claim 1, wherein the first connection part is in physical contact with the ground contacts.

4. The receptacle connector according to claim 3, wherein the first connection part is inserted into an opening provided in the conductive resin member, such that a position of the first connection part is made adjustable by reason that the first connection part comes into physical contact with the ground contact.

5. The receptacle connector according to claim 1, wherein adjacent segments of the conductive resin member, into which the conductive resin member is split into the plurality of segments with respect to each of adjacent first connection parts, are joined to each other through a joining layer made of an insulative resin.

6. The receptacle connector according to claim 1, wherein an air layer is formed between adjacent segments of the conductive resin member, into which the conductive resin member is split into the plurality of segments with respect to each of adjacent first connection parts.

7. The receptacle connector according to claim 1, wherein adjacent segments of the conductive resin member, into which the conductive resin member is split into the plurality of segments with respect to each of adjacent first connection parts, are joined to each other by using a metallic joining piece.

8. The receptacle connector according to claim 1, wherein each segment of the conductive resin member, into which the conductive resin member is split into the plurality of segments with respect to each of adjacent first connection parts, are accommodated in compartments of the housing which are partitioned by partition walls each made of an insulative resin.

9. A plug connector used in an electrical connector to connect two circuit boards to each other, the plug connector comprising:

a blade to be inserted into an accommodating space of a receptacle connector being an object to be connected;

a plurality of signal line external contact points provided on at least one surface of the blade and disposed corresponding to a plurality of signal line contacts of the receptacle connector;

a plurality of ground external contact points arranged adjacent to the plurality of signal line external contact points and disposed corresponding to a plurality of ground contacts of the receptacle connector; and a plug-side conductive member including at least one first plug-side connection part comprised of a metal material and configured to be electrically connected to at least one ground external contact point among the plurality of ground external contact points, and a plug-side conductive resin member configured to be electrically connected to the first plug-side connection part;

wherein the plug connector includes a plurality of the first plug-side connection parts, and the plug-side conductive resin member is split into a plurality of segments for each of the plurality of the first plug-side connection parts.

10. The plug connector according to claim 9, wherein the first plug-side connection part is in physical contact with the plug-side conductive resin member.

11. The plug connector according to claim 9, wherein the first plug-side connection part is in physical contact with the ground external contact points.

12. The plug connector according to claim 11, wherein the first plug-side connection part is inserted into an opening provided in the plug-side conductive resin member, such that a position of the first plug-side connection part is made adjustable by reason that the first plug-side connection part comes into physical contact with the ground external contact point.

13. The plug connector according to claim 9, wherein the first plug-side connection part has a pair of metallic contact terminals opposed to each other.

14. The plug connector according to claim 9, wherein an air layer is formed between adjacent segments of the conductive resin member, into which the conductive resin member is split into the plurality of segments with respect to each of adjacent first plug-side connection parts.

15. The plug connector according to claim 9, wherein adjacent segments of the conductive resin member, into which the conductive resin member is split into the plurality of segments with respect to each of adjacent first plug-side connection parts, are joined to each other by using a metallic joining piece.

16. An electrical connector comprising:

a receptacle connector used in the electrical connector to connect two circuit boards to each other, the receptacle connector including a housing comprised of an insulative resin material and defines an accommodating space having an opening into which a plug connector to be connected is to be inserted;

a plurality of contacts each comprised of a metal material and to be accommodated in the accommodating space while being arranged adjacent to one another, the contacts including a plurality of signal line contacts and a plurality of ground contacts; and a conductive member including at least one first connection part comprised of a metal material and configured to be electrically connected to at least one ground contact among the plurality of ground contacts, and a conductive resin member configured to be electrically connected to the first connection part;

wherein the receptacle connector includes a plurality of the first connection parts, and the conductive resin member is split into a plurality of segments for each of the plurality of the first connection parts; and the plug connector used in the electrical connector to connect two circuit boards to each other, the plug connector including a blade to be inserted into an accommodating space of the receptacle connector being the object to be connected;

a plurality of signal line external contact points provided on at least one surface of the blade and disposed corresponding to a plurality of signal line contacts of the receptacle connector;

a plurality of ground external contact points arranged adjacent to the plurality of signal line external contact points and disposed corresponding to a plurality of ground contacts of the receptacle connector; and a plug-side conductive member including at least one first plug-side connection part comprised of a metal material and configured to be electrically connected to at least one ground external contact point among the plurality of ground external contact points, and a plug-side conductive resin member configured to be electrically connected to the first plug-side connection part.

* * * * *